US012782024B2

(12) United States Patent
Terzic et al.

(10) Patent No.: US 12,782,024 B2
(45) **Date of Patent: *Nov. 3, 2026**

(54) AUTOMATIC MAINTENANCE AND FLOW CONTROL OF HEAT EXCHANGER

(71) Applicant: S. A. Armstrong Limited, Toronto (CA)

(72) Inventors: Zeljko Terzic, Toronto (CA); Redmond Hum, Toronto (CA); Marcelo Javier Acosta Gonzalez, Toronto (CA); Ritesh Patel, Toronto (CA)

(73) Assignee: S.A. Armstrong Limited, Toronto (CA)

( * ) Notice: Subject to any disclaimer, the term of this patent is extended or adjusted under 35 U.S.C. 154(b) by 115 days.

This patent is subject to a terminal disclaimer.

(21) Appl. No.: 18/767,415

(22) Filed: Jul. 9, 2024

(65) Prior Publication Data

US 2024/0361058 A1 Oct. 31, 2024

Related U.S. Application Data

(63) Continuation of application No. 17/041,241, filed as application No. PCT/CA2018/051555 on Dec. 5, 2018, now Pat. No. 12,066,232.

(Continued)

(51) Int. Cl.

| | |
|---|---|
| ***F25B 49/02*** | (2006.01) |
| ***F25B 25/00*** | (2006.01) |
| *F28F 27/00* | (2006.01) |

(52) U.S. Cl.

CPC ..... *F25B 49/027* (2013.01); *F25B 25/005* (2013.01); *F25B 2339/047* (2013.01);

(Continued)

(58) Field of Classification Search

CPC ..... F25B 49/027; F25B 25/005; F25B 2339/047; F25B 2400/06; F25B 2400/13;

(Continued)

(56) References Cited

U.S. PATENT DOCUMENTS 1,951,420 A * 3/1934 Jones ..... F28G 5/00 165/95
3,319,704 A * 5/1967 Nasse ..... F28G 1/12 165/95

(Continued)

FOREIGN PATENT DOCUMENTS

CN 1045453 A 9/1990
CN 2241320 Y 11/1996

(Continued)

OTHER PUBLICATIONS

Extended European Search Report for European Patent Application No. 18936145.4, mailed May 6, 2022, 6 pages.

(Continued)

*Primary Examiner* — Larry L Furdge
(74) *Attorney, Agent, or Firm* — Bret E. Field; Bozicevic, Field & Francis LLP

(57) ABSTRACT

A heat transfer system that includes one or more heat exchangers and one or more control pumps that control flow through the heat exchangers. In order to source a variable load, the control pumps can be controlled to operate at less than full duty flow. In an example embodiment, a controller can calculate, when each heat exchanger is clean, coefficient values of each respective heat exchanger. The controller can determine, during real-time operation, real-time coefficient values of the heat exchanger to compare with the respective coefficient values when clean, in order to determine whether there is fouling in that heat exchanger. In some examples, the controller can determine that maintenance is required on the heat exchanger due to the fouling, and perform flushing of the heat exchanger by operating one or more of the control pumps at full duty load during real-time operation to source the variable load.

31 Claims, 23 Drawing Sheets

Related U.S. Application Data

(60) Provisional application No. 62/741,943, filed on Oct. 5, 2018.

(52) U.S. Cl.
CPC ..... *F25B 2400/06* (2013.01); *F25B 2400/13* (2013.01); *F25B 2600/0253* (2013.01); *F25B 2700/21161* (2013.01); *F25B 2700/21171* (2013.01); *F28F 27/00* (2013.01)

(58) Field of Classification Search
CPC .... F25B 2600/0253; F25B 2700/21161; F25B 2700/21171; F25B 27/00
See application file for complete search history.

(56) References Cited

U.S. PATENT DOCUMENTS

| | | | |
|---|---|---|---|
| 5,215,704 | A | 6/1993 | Hirota |
| 5,353,653 | A | 10/1994 | Watanabe et al. |
| 5,590,706 | A | 1/1997 | Tsou et al. |
| 6,085,532 | A | 7/2000 | Sibik |
| 6,276,152 | B1 | 8/2001 | Sibik |
| 9,970,720 | B2 | 5/2018 | Vanberg et al. |
| 10,031,535 | B2 | 7/2018 | Rollins et al. |
| 12,066,232 | B2 * | 8/2024 | Terzic ..... F25B 25/005 |
| 2003/0062149 | A1 | 4/2003 | Goodson et al. |
| 2009/0133412 | A1 | 5/2009 | Narayanamurthy et al. |
| 2011/0114284 | A1 | 5/2011 | Siegenthaler |
| 2012/0096874 | A1 | 4/2012 | Goodfellow |
| 2012/0102991 | A1 | 5/2012 | Lee et al. |
| 2015/0144323 | A1 | 5/2015 | Cho et al. |
| 2015/0226453 | A1 | 8/2015 | Nomoto et al. |
| 2015/0338129 | A1 | 11/2015 | Matsuzawa |
| 2017/0130982 | A1 | 5/2017 | Havlena |
| 2017/0167810 | A1 | 6/2017 | Nyander et al. |
| 2018/0283818 | A1 | 10/2018 | Victor et al. |

FOREIGN PATENT DOCUMENTS

| | | | |
|---|---|---|---|
| CN | 201666640 | U | 12/2010 |
| CN | 201885634 | U | 6/2011 |
| CN | 203132091 | U | 8/2013 |
| CN | 103376026 | A | 10/2013 |
| CN | 204007304 | U | 12/2014 |
| CN | 105486164 | A | 4/2016 |
| CN | 105605965 | A | 5/2016 |
| CN | 106872514 | A | 6/2017 |
| CN | 206977905 | U | 2/2018 |
| EP | 2985563 | A1 | 2/2016 |
| IN | 2994/ | | 11/2012 |
| JP | 2005308235 | A | 11/2005 |
| JP | 5972729 | B2 | 8/2016 |
| WO | WO2017185198 | A1 | 11/2017 |

OTHER PUBLICATIONS

Office Action dated May 5, 2022, for Chinese Patent Application No. 201880098399.8, 11 pages.
Search Report dated Nov. 10, 2023, and Written Opinion dated Nov. 15, 2023, of corresponding Singapore application No. 10202250570H, 7 pages.
Office Action of corresponding Canadian Application No. 3187656 dated Oct. 30, 2023, 3 pages.
Search Report dated Nov. 9, 2023, and Written Opinion dated Nov. 15, 2023, of corresponding Singapore Application No. 10202250573G, 7 pages.
Notice of Non-Final Rejection dated Mar. 31, 2026, for United Arab Emirates Patent Application No. P2024-00710, 9 pages.
Notice on Reexamination dated Mar. 25, 2026, for China Patent Application No. 201880098399.8, and its English translation, 88 pages.
Notice of Non-Final Rejection dated Apr. 17, 2026, for United Arab Emirates Patent Application No. P2024-00713, 10 pages.
Notice of Non-Final Rejection dated Apr. 28, 2026, for United Arab Emirates Patent Application No. P2024-00712, 11 pages.
Notice of Non-Final Rejection dated Apr. 28, 2026, for United Arab Emirates Patent Application No. P2024-00711, 11 pages.
Second Office Action issued in corresponding Chinese Patent Application No. 202211462048.5, mailed Jun. 27, 2026, and its English translation, 14 pages.

* cited by examiner

AUTOMATIC MAINTENANCE AND FLOW CONTROL OF HEAT EXCHANGER

CROSS-REFERENCE TO RELATED APPLICATION(S)

This application is a continuation application of U.S. patent application Ser. No. 17/041,241 filed Sep. 24, 2020, which a U.S. nationalization under 35 U.S.C. § 371 of International Application No. PCT/CA2018/051555 filed Dec. 5, 2018, which claims the benefit of priority to U.S. Provisional Patent Application No. 62/741,943 filed Oct. 5, 2018, all the contents of which are herein incorporated by reference into the DETAILED DESCRIPTION OF EXAMPLE EMBODIMENTS, herein below.

TECHNICAL FIELD

Example embodiments generally relate to heat transfer systems and heat exchangers.

BACKGROUND

Building Heating Ventilation and Air Conditioning (HVAC) systems can contain central chilled water plants that are designed to provide air conditioning units with cold water as to reduce the temperature of the air that leaves the conditioned space before it is recycled back into the conditioned space.

Chilled water plants are used to provide cold water or air for a building. Chilled water plants can comprise of active and passive mechanical equipment which work in concert to reduce the temperature of warm return water before supplying it to the distribution circuit. In chilled water plants, a heat exchanger is used to transfer heat energy between two or more circuits of circulation mediums. Similarly, a heating plant can include one or more boilers that provide hot water to the distribution circuit, from one or more boilers or from a secondary circuit having a the heating source.

Buildup of contaminants, referred to as fouling, can occur in components of the chilled water plant or heating plant when operating at partial load.

In order to perform manual maintenance on the heat exchanger of the chilled water plant, the chilled water plant can be shut down, the heat exchanger is removed and disassembled, and the contaminants are manually removed or flushed. The heat exchanger is then re-assembled and installed back into the chilled water plant. This process is inefficient.

In some conventional methods, the manual maintenance on the heat exchanger is typically performed according to a fixed schedule according to the manufacturer or building maintenance administrator. There is a risk of over-maintenance or under-maintenance when a fixed schedule is used for the manual maintenance, which is inefficient.

In some existing methods, the differential pressure is measured across the heat exchanger at full flow conditions and the service person will do a manual cleaning once the differential pressure gets to a certain point for full flow conditions.

Other difficulties with existing systems may be appreciated in view of the Detailed Description of Example Embodiments, herein below.

SUMMARY

An example embodiment is a heat transfer system including a plate and frame counter current heat exchanger and variable control pumps that control flow through the heat exchanger. The heat exchanger can be a smaller design that uses less material, has a smaller footprint, and is dimensioned for turbulent flow at higher pressure circulation. The control pumps have larger power capacity which is used to accommodate the higher pressure differentials through the smaller heat exchanger that are imparted by the control pumps. An example embodiment is a system and method for controlling the control pumps along a control curve.

An example embodiment is a heat transfer system that includes one or more heat exchangers and one or more control pumps that control flow through the heat exchangers. In order to source a variable load, the control pumps can be controlled to operate at less than full flow (e.g., duty flow). In an example embodiment, a controller can calculate, when each heat exchanger is clean, coefficient values of each respective heat exchanger. The controller can determine, during real-time operation, real-time coefficient values of the heat exchanger to compare with the respective coefficient values when clean, in order to determine whether there is fouling in that heat exchanger. In some examples, the controller can determine that maintenance is required on the heat exchanger due to the fouling, and perform flushing of the heat exchanger by operating one or more of the control pumps at full load (duty load) during real-time operation to source the variable load.

An example embodiment is a heat transfer system for sourcing a variable load, comprising: a heat exchanger that defines a first fluid path and a second fluid path; a first variable control pump for providing variable flow of a first circulation medium through the first fluid path of the heat exchanger; at least one controller configured for: controlling the first variable control pump to control the first circulation medium through the heat exchanger in order to source the variable load, determining, based on real-time operation measurement when sourcing the variable load, that the heat exchanger requires maintenance due to fouling of the heat exchanger, and in response to said determining, controlling the first variable control pump, to a first flow amount of the first circulation medium in order to flush the fouling of the heat exchanger.

An example embodiment is a system for tracking heat exchanger performance, comprising: a heat exchanger for installation in a system that has a load; an output subsystem; and at least one controller configured to: determine a clean coefficient value of the heat exchanger when in a clean state, calculate, from measurement of real-time operation measurement when sourcing the load, an actual coefficient value of the heat exchanger, calculate a comparison between the actual coefficient value of the heat exchanger and the clean coefficient value of the heat exchanger, and output to the output subsystem when the comparing satisfies criteria.

An example embodiment is a method for sourcing a variable load using a heat transfer system, the heat transfer system including a heat exchanger that defines a first fluid path and a second fluid path, the heat transfer system including a first variable control pump for providing variable flow of a first circulation medium through the first fluid path of the heat exchanger, the method being performed by at least one controller and comprising: controlling the first variable control pump to control the first circulation medium through the heat exchanger in order to source the variable load, determining, based on real-time operation measurement when sourcing the variable load, that the heat exchanger requires maintenance due to fouling of the heat exchanger, and in response to said determining, controlling the first variable control pump, to a first flow amount of the first circulation medium in order to flush the fouling of the heat exchanger.

An example embodiment is a method for tracking performance of a heat exchanger for installation in a system that has a load, the method being performed by at least one controller and comprising: determining a clean coefficient value of the heat exchanger when in a clean state; calculating, from measurement of real-time operation measurement when sourcing the load, an actual coefficient value of the heat exchanger; calculating a comparison between the actual coefficient value of the heat exchanger and the clean coefficient value of the heat exchanger; and outputting to an output subsystem when the comparing satisfies criteria.

Another example embodiment is a non-transitory computer readable medium having instructions stored thereon executable by one or more controllers for performing the described methods.

BRIEF DESCRIPTION OF THE DRAWINGS

Reference will now be made, by way of example, to the accompanying drawings which show example embodiments, and in which.

Similar reference numerals may have been used in different figures to denote similar components.

DETAILED DESCRIPTION OF EXAMPLE EMBODIMENTS

Figure 1A:
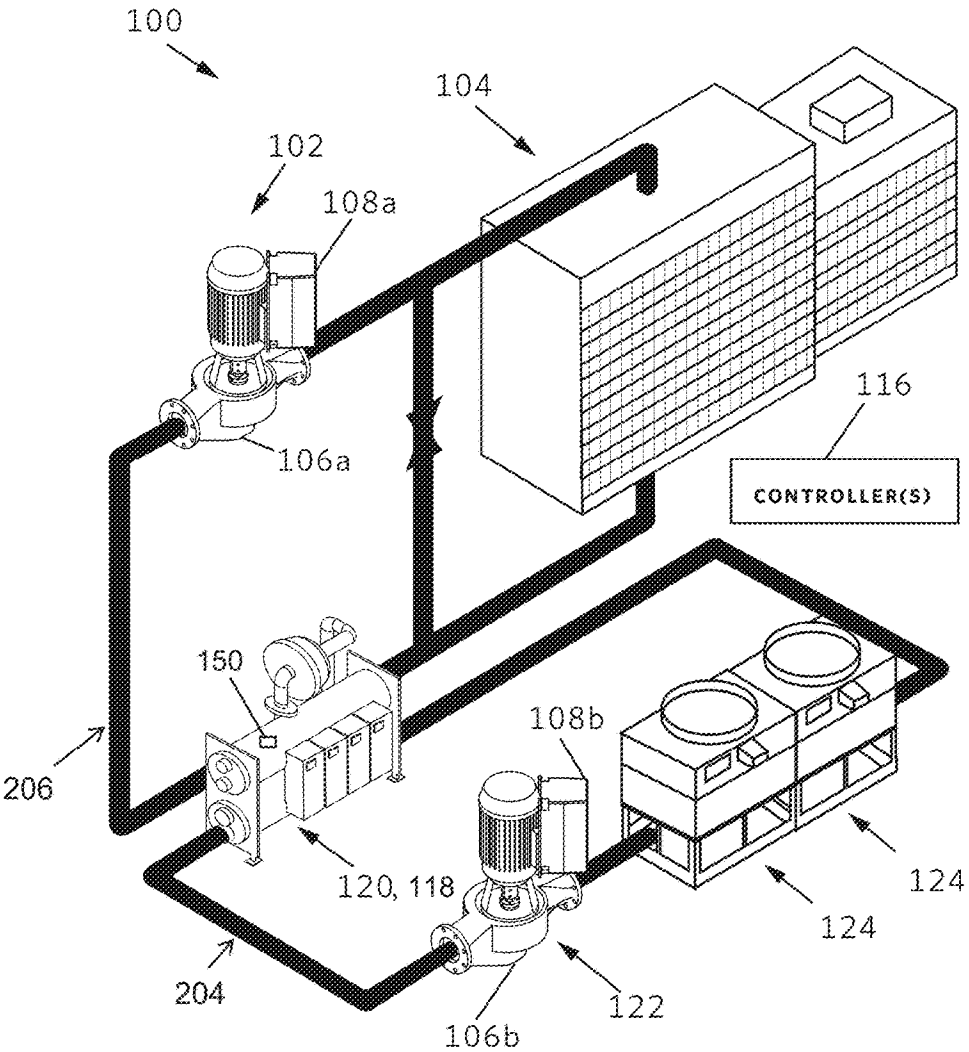
FIG. 1A illustrates a graphical representation of a building system, illustrated as a chilled water plant for providing cold water to a building, to which example embodiments may be applied.

At least some example embodiments relate to processes, process equipment and systems in the industrial sense, meaning a process that outputs product(s) (e.g. hot water, cool water, air) using inputs (e.g. cold water, fuel, air, etc.). In such systems, a heat exchanger or heat transfer system can be used to transfer heat energy between two or more circuits of circulation mediums.

In an example embodiment, architectures for equipment modeling by performance parameter tracking can be deployed on data logging structures, or control management systems implemented by a controller or processor executing instructions stored in a non-transitory computer readable medium. Previously stored equipment performance parameters stored by the computer readable medium can be compared and contrasted to real-time performance parameter values.

In some example embodiments, a performance parameter of each device performance is modeled by way of model values. In some example embodiments, the model values are discrete values that can be stored in a table, map, database, tuple, vector or multi-parameter computer variables. In some other example embodiments, the model values are values of the performance parameter (e.g. the standard unit of measurement for that particular performance parameter, such as in Imperial or SI metric).

The equipment coefficients are used to prescribe the behavioral responses of the individual units within each equipment group category. Each individual unit within each equipment category can individually be modeled by ascribing each coefficient corresponding to a specific set of operating conditions that transcribe the behavioral parameter in question. The equipment coefficients can be used for direct comparison or as part of one or more equations to model the behavioral parameter. It can be appreciated that individual units can have varied individual behavior parameters, and can be individually modeled and monitored in accordance with example embodiments.

Mathematical models prescribing mechanical equipment efficiency performance have constants and coefficients which parameterize the equations. For example, the coefficients can be coefficients of a polynomial or other mathematical equation.

Specifying these coefficients at the time of manufacturing, and tracking their ability to accurately predict real-time performance through the life-cycle of the mechanical item allows for preventative maintenance, fault detection, installation and commissioning verification, as well as energy performance or fluid consumption performance benchmarking and long term monitoring.

In an example embodiment, control schemes dependent on coefficient based plant modeling architectures can be configured to optimize energy consumption or fluid consumption of individual equipment, or the system as a whole, and monitored over the life-cycle of equipment including a heat exchanger or a heat transfer system.

Many HVAC building systems do not operate at full load (duty load). In an example embodiment, based on the determined coefficients, a controller can determine during real-time operation whether there is fouling in the heat exchanger that can build up when the building system is operating at part load for a prolonged duration. In some examples, the controller can determine that maintenance is required on the heat exchanger due to the fouling, and perform flushing of the heat exchanger by operating at full load (duty load) during real-time operation of the building system.

An example embodiment is a heat transfer system that includes one or more heat exchangers and one or more control pumps that control flow through the heat exchangers. In order to source a variable load, the control pumps can be controlled to operate at less than full flow (e.g., duty flow). In an example embodiment, a controller can calculate, when each heat exchanger is clean, coefficient values of each respective heat exchanger. The controller can determine, during real-time operation, real-time coefficient values of the heat exchanger to compare with the respective coefficient values when clean, in order to determine whether there is fouling in that heat exchanger. In some examples, the controller can determine that maintenance is required on the heat exchanger due to the fouling, and perform flushing of the heat exchanger by operating one or more of the control pumps at full load (duty load) during real-time operation to source the variable load.

An example embodiment is a heat transfer system for sourcing a variable load, comprising: a heat exchanger that defines a first fluid path and a second fluid path; a first variable control pump for providing variable flow of a first circulation medium through the first fluid path of the heat exchanger; at least one controller configured for: controlling the first variable control pump to control the first circulation medium through the heat exchanger in order to source the variable load, determining, based on real-time operation measurement when sourcing the variable load, that the heat exchanger requires maintenance due to fouling of the heat exchanger, and in response to said determining, controlling the first variable control pump, to a first flow amount of the first circulation medium in order to flush the fouling of the heat exchanger.

An example embodiment is a system for tracking heat exchanger performance, comprising: a heat exchanger for installation in a system that has a load; an output subsystem; and at least one controller configured to: determine a clean coefficient value of the heat exchanger when in a clean state, calculate, from measurement of real-time operation measurement when sourcing the load, an actual coefficient value of the heat exchanger, calculate a comparison between the actual coefficient value of the heat exchanger and the clean coefficient value of the heat exchanger, and output to the output subsystem when the comparing satisfies criteria.

An example embodiment is a method for sourcing a variable load using a heat transfer system, the heat transfer system including a heat exchanger that defines a first fluid path and a second fluid path, the heat transfer system including a first variable control pump for providing variable flow of a first circulation medium through the first fluid path of the heat exchanger, the method being performed by at least one controller and comprising: controlling the first variable control pump to control the first circulation medium through the heat exchanger in order to source the variable load, determining, based on real-time operation measurement when sourcing the variable load, that the heat exchanger requires maintenance due to fouling of the heat exchanger, and in response to said determining, controlling the first variable control pump, to a first flow amount of the first circulation medium in order to flush the fouling of the heat exchanger.

An example embodiment is a method for tracking performance of a heat exchanger for installation in a system that has a load, the method being performed by at least one controller and comprising: determining a clean coefficient value of the heat exchanger when in a clean state; calculating, from measurement of real-time operation measurement when sourcing the load, an actual coefficient value of the heat exchanger; calculating a comparison between the actual coefficient value of the heat exchanger and the clean coefficient value of the heat exchanger; and outputting to an output subsystem when the comparing satisfies criteria.

FIG. 1A illustrates an example HVAC building system 100 such as a chilled water plant, in accordance with an example embodiment. As shown in FIG. 1A, the building system 100 can include, for example: one chilled water control pump 102, one chiller 120, one control pump 122, and two cooling towers 124. The chilled water control pump 102 can include a heat exchanger 118. The heat exchanger 118 can include sensors 150. The heat exchanger 118 defines a first fluid path 204 (of a first fluid circuit) for a first circulation medium, and a second fluid path 206 (of a second fluid circuit) for a second circulation medium. In an example embodiment, more or less numbers of device can exist within each equipment category. Other types of equipment and rotary devices may be included in the building system 100, in some example embodiments.

The building system 100 can be used to source a building 104 (as shown), campus (multiple buildings), district, vehicle, plant, generator, heat exchanger, or other suitable infrastructure or load, with suitable adaptations. Each control pump 102 may include one or more respective pump devices 106*a* (one shown, whereas two pump devices for a single control pump 102 are illustrated in FIG. 2E) and a control device 108*a* for controlling operation of each respective pump device 106*a*. The particular circulation medium may vary depending on the particular application, and may for example include glycol, water, air, fuel, and the like. The chiller 120 can include at least a condenser and an evaporator, for example, as understood in the art. The condenser of the chiller 120 collects unwanted heat through the circulation medium before the circulation medium is sent to the cooling towers 124. The condenser itself is a heat exchanger, and examples embodiments that refer to a heat exchanger (included automatic maintenance and flushing) can be applied to the condenser, as applicable. The evaporator of the chiller 120 is where the chilled circulation medium is generated, and the chilled circulation medium leaves the evaporator and is flowed to the building 104 by the control pump 102. Each cooling tower 124 can be dimensioned and configured to provide cooling by way of evaporation, and can include a respective fan, for example. Each cooling tower 124 can include one or more cooling tower cells, in an example.

The building system 100 can be configured to provide air conditioning units of the building 104 with cold water to reduce the temperature of the air that leaves the conditioned space before it is recycled back into the conditioned space. The building system 100 can comprise of active and passive mechanical equipment which work in concert to reduce the temperature of warm return water before supplying it to the distribution circuit.

Figure 1B:
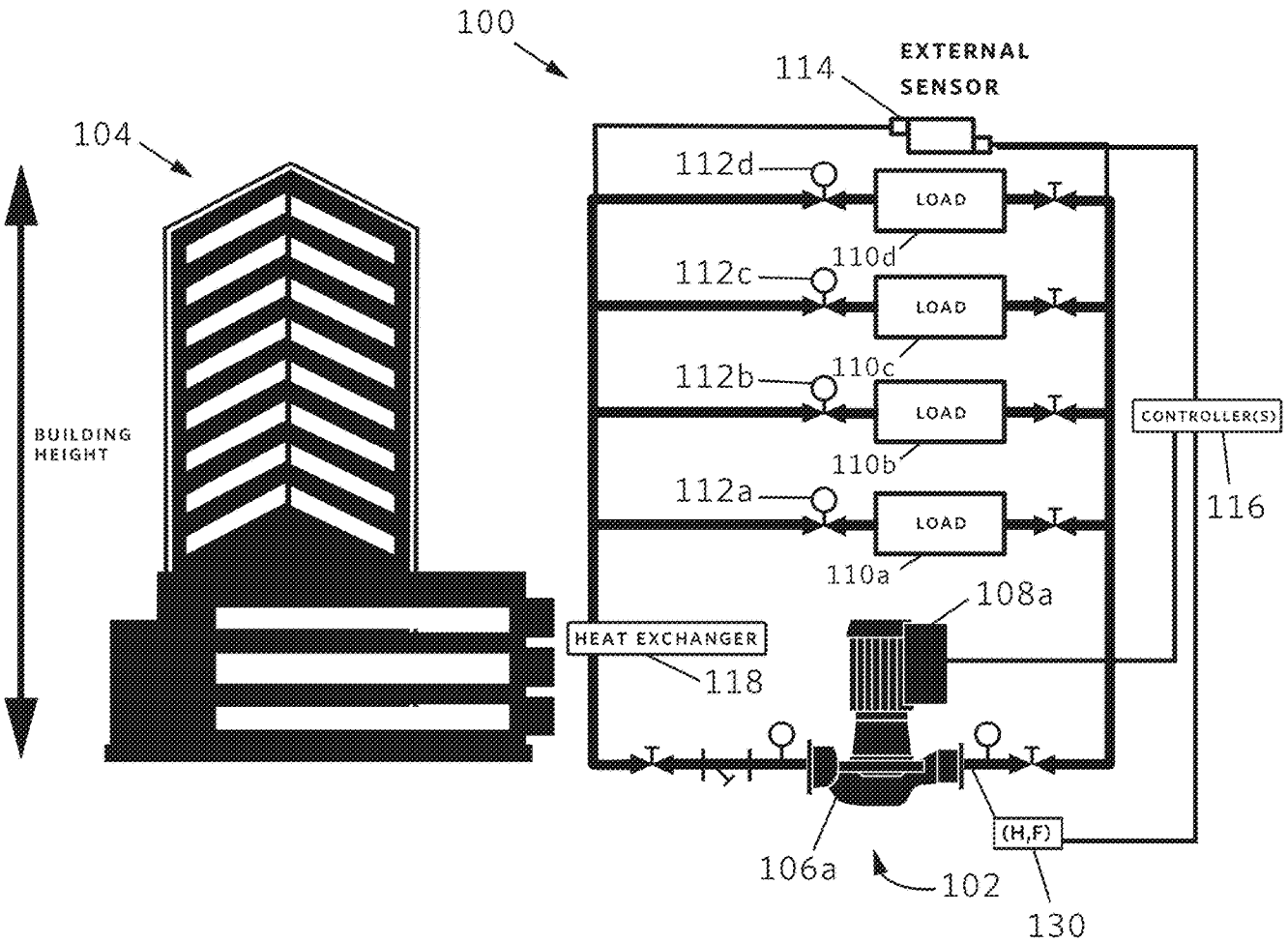
FIG. 1B illustrates a graphical representation of further aspects of the chilled water plant shown in FIG. 1A.

Referring to FIG. 1B, the building system 100 may include a heat exchanger 118 which is an interface in thermal communication with a secondary circulating system, for example via the chiller 120 (FIG. 1A). The heat exchanger 118 can be placed in various positions in the building system 100 of FIG. 1A. The building system 100 may include one or more loads 110*a*, 110*b*, 110*c*, 110*d*, wherein each load 110*a*, 110*b*, 110*c*, 110*d* may be a varying usage requirement based on requirements of an air conditioner, HVAC, plumbing, etc. Each 2-way valve 112*a*, 112*b*, 112*c*, 112*d* may be used to manage the flow rate to each respective load 110*a*, 110*b*, 110*c*, 110*d*. In some example embodiments, as the differential pressure across the load decreases, the control device 108*a* responds to this change by increasing the pump speed of the pump device 106*a* to maintain or achieve the output setpoint (e.g. pressure or temperature). If the differential pressure across the load increases, the control device 108*a* responds to this change by decreasing the pump speed of the pump device 106*a* to maintain or achieve the setpoint. In some example embodiments, an applicable load 110*a*, 110*b*, 110*c*, 110*d* can represent cooling coils to be sourced by the circulation medium the chiller 120, each with associated valves 112*a*, 112*b*, 112*c*, 112*d*, for example. In some examples, an applicable load 110*a*, 110*b*, 110*c*, 110*d* can represent fan coils that each include a cooling coil and a controllable fan (not shown) that blows air across the coiling coils. In some examples, the fan has a variably controllable motor to control temperature in the region to be cooled. In other examples, the fan has a binary controllable motor (i.e., only on state or off state) to control temperature in the region to be cooled. The control devices 108*a* and the control valves 112*a*, 112*b*, 112*c*, 112*d* can respond to changes in the chiller 120 by increasing or decreasing the pump speed of the pump device 106*a*, or variably controlling an amount of opening or closing of the control valves 112*a*, 112*b*, 112*c*, 112*d*, or control of the fans, to achieve the specified output setpoint.

The control pump 122 (more than one control pump is possible) is used to provide flow control from the cooling towers 124 to the chiller 120 and/or the heat exchanger 118. The control pump 122 can have a variably controllable motor, and can include a pump device 106*b* and a control device 108*b*. In various examples, the control pump 122 can be used to control flow from a cooling or heating source to the heat exchanger 118. In some examples, the heat exchanger 118 is separate from the chiller 120. In other examples, the chiller 120 is integrated with the heat exchanger 118. In some examples, the heat exchanger 118 is integrated with one or both control pumps 102, 122 (e.g., see FIG. 2E). In other examples, the heat exchanger 118 is separated from the control pumps 102, 122 using piping, fittings, intermediate devices, etc.

Referring still to FIG. 1B, the output properties of each control pump 102, 122 can be controlled to, for example, achieve a temperature setpoint or pressure setpoint at the combined output properties represented or detected by external sensor 114, shown at the load 110*d* at one point of the building 104 (the highest point in this example). The external sensor 114 represents or detects the aggregate or total of the individual output properties of all of the control pumps 102, 122 at the load, in one example, flow and pressure. Information on flow and pressure local to the control pump 102, 122 can also be represented or detected by a respective sensor 130, in an example embodiment. The external sensor 114 can be used to detect temperature and heat load (Q) in example embodiments. Heat load (Q) can refer to a hot temperature load or a cold temperature load. In an example, the external sensor 114 for temperature and heat load can be placed at each load (110*a*, 110*b*, 110*c*, 110*d*), or one external sensor 114 is placed at the highest point at the load 110*d*. Other example operating parameters are described in greater detail herein.

One or more controllers 116 (e.g. processors) may be used to coordinate the output (e.g. temperature, pressure, and flow) of some or all of the devices of the building system 100. The controllers 116 can include a main centralized controller in some example embodiments, and/or can have some of the functions distributed to one or more of the devices in the overall system of the building system 100 in some example embodiments. In an example embodiment, the controllers 116 are implemented by a processor which executes instructions stored in memory. In an example embodiment, the controllers 116 are configured to control or be in communication with the loads (110*a*, 110*b*, 110*c*, 110*d*), the valves (112*a*, 112*b*, 112*c*, 112*d*), the control pumps 102, 122, the heat exchanger 118, and other devices.

Referring again to FIGS. 1A and 1B, in some example embodiments, the building system 100 can represent a heating circulating system ("heating plant"), with suitable adaptation. The heating plant may include a heat exchanger 118 which is an interface in thermal communication with a secondary circulating system, such as a boiler system. Instead of a chiller 120, the boiler system can include one or more boilers 140 (not shown here). In an example, control valves 112*a*, 112*b*, 112*c*, 112*d* manage the flow rate to heating elements (e.g., loads 110*a*, 110*b*, 110*c*, 110*d*). The control devices 108*a*, 108*b* and the control valves 112*a*, 112*b*, 112*c*, 112*d* can respond to changes in the heating elements (e.g., loads 110*a*, 110*b*, 110*c*, 110*d*) and the boiler system by increasing or decreasing the pump speed of the pump device 106*a*, or variably controlling an amount of opening or closing of the control valves 112*a*, 112*b*, 112*c*, 112*d*, to achieve the specified output setpoint (e.g., temperature or pressure). In some examples, the one or more boilers 140 is separate from the heat exchanger 118. In other examples, the one or more boilers 140 is integrated with the heat exchanger 118.

Each control device 108*a*, 108*b* can be contained in a Pump Controller card 226 ("PC card") that is integrated within the respective control pump 102, 122. A controller (with communication device) of the heat exchanger 118 can be contained in a Heat eXchanger card 222 ("HX card") that is integrated within the heat exchanger 118. In an example, the PC card 226 can be a table style device that includes a touch screen 530*a* (for control pump 102, shown in FIG. 5), processor (controller 506*a*, FIG. 5), and communication subsystem 516*a* (FIG. 5), that can be stand alone manufactured and then integrated into the respective control pump 102, 122. The HX card 222 is integrated with heat exchanger 118, and can be a similar tablet style device as the PC card 226 having a touch screen 228 in some examples, and in some examples does not have the touch screen 228.

Figure 1C:
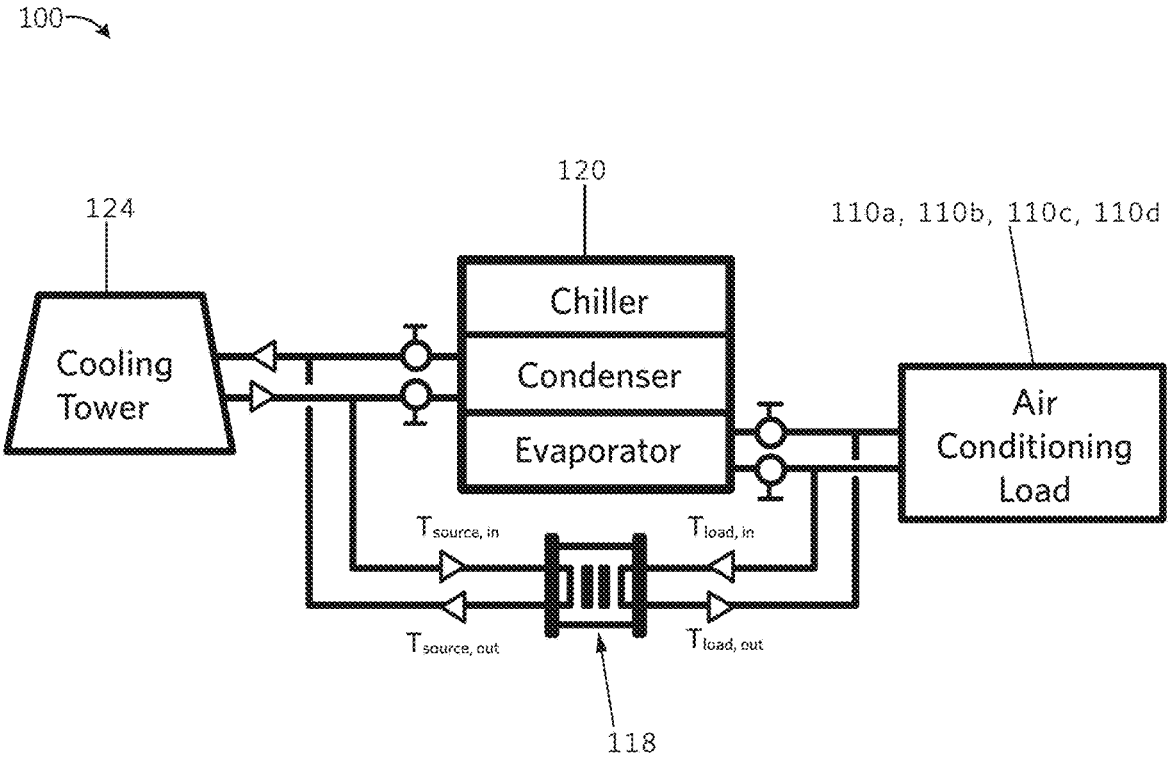
FIG. 1C illustrates a graphical representation of another example chilled water plant, having a waterside economizer with a dedicated cooling tower, with parallel load sharing.

FIG. 1C illustrates a graphical representation of another example chilled water plant, having a waterside economizer with a dedicated cooling tower 124, with parallel load sharing, in accordance with an example embodiment. In this example, the cooling tower 124 sources the chiller 120 and the heat exchanger 118 in parallel. The load 110*a*, 110*b*, 110*c*, 110*d* is an air conditioner load that is sourced by the chiller 120 and the heat exchanger 118 in parallel.

In the configuration of FIG. 1C, the supply flow is usually run at full speed. Since the cooling tower 124 operation is relatively cheap compared to running a chiller 120, running the maximum flow through the cooling tower 124 is preferred. In cases where the cooling tower 124 is used in part loads, then controlling Tload, supply or using a Maximize Source Side Delta T with constant temperature approach and constant load side Delta T is recommended to ensure that the load side is getting their design temperatures. To get additional savings, the user can define the minimum approach between Tsource, in and Tload, out using the Maximize Source Side Delta T with constant temperature approach and constant load side Delta T. An example approach temperature of 1F (or applicable delta in Celsius) can be used so that pump energy is not consumed if additional heat exchange is too low.

Figure 1D:
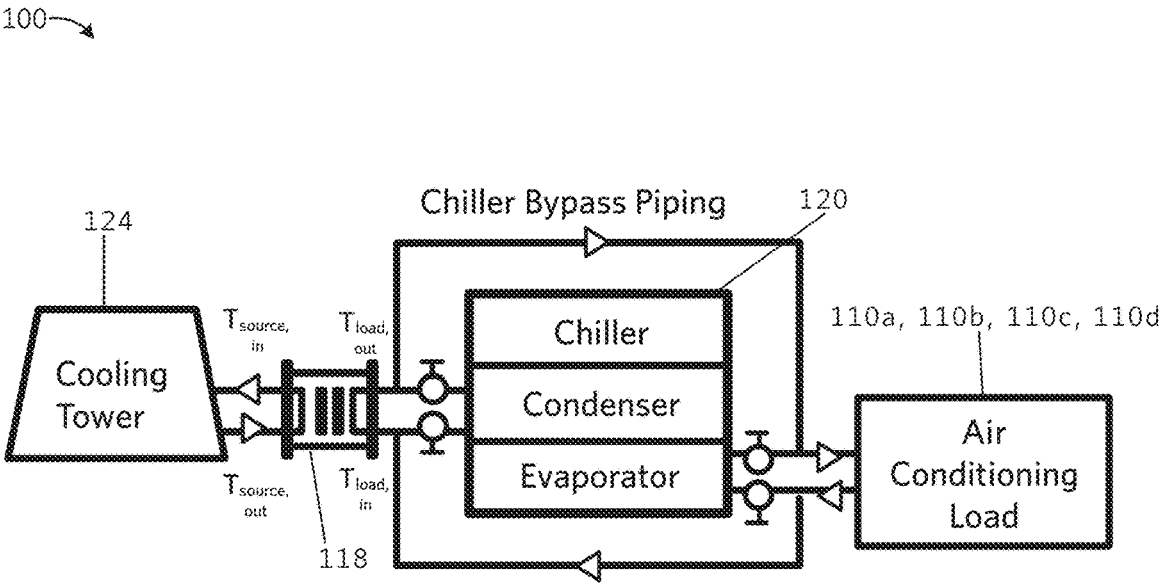
FIG. 1D illustrates a graphical representation of another example chilled water plant, having a waterside economizer with a dedicated cooling tower, with load sharing.

FIG. 1D illustrates a graphical representation of another example chilled water plant, having a waterside economizer with a dedicated cooling tower 124, with load sharing, in accordance with an example embodiment. The cooling tower 124 sources the heat exchanger 118. The heat exchanger 118 provides cooled circulation medium to the chiller 120. The chiller provides further temperature reduction and sources the load 110*a*, 110*b*, 110*c*, 110*d*, which is an air conditioner load. The heat exchanger 118 can also directly source the load 110*a*, 110*b*, 110*c*, 110*d* by way of chiller bypass piping, as shown.

Since the chiller 120 uses the most energy in the system 100, it is advantageous for the pump 122 to run full speed. In cases where the cooling tower 124 is used in part loads, then controlling Tload, supply or using a Maximize Source Side Delta T with constant temperature approach and constant load side Delta T is recommended to ensure that the load side is getting their design temperatures. To get additional savings, the user can define the minimum approach between Tsource, in and Tload, out using a Maximize Source Side Delta T with constant temperature approach and constant load side Delta T. An approach temperature of 1F (or applicable delta in Celsius) is recommended so that pump energy is not consumed if additional heat exchange is too low.

An input on the pump is reserved that allows the system 100 to switch between load sharing and running the cooling tower 124 by itself.

In another example, now shown here, a vehicle system can include a similar system for an air conditioner of a vehicle, in accordance with an example embodiment. The air conditioner, that includes a compressor and condenser, circulates a coolant through the heat exchanger 118 in order to cool ambient air or recirculated air to the passenger interior of the vehicle. The cool ambient air can pass through bypass piping or valves to bypass the heat exchanger 118 in some examples.

Figure 1E:
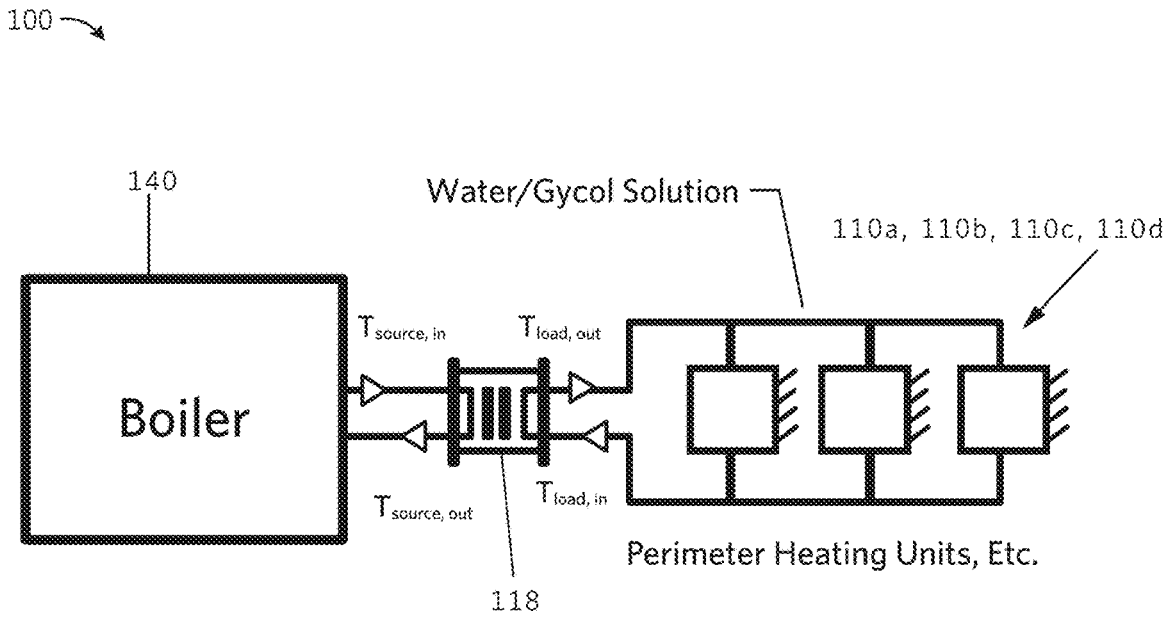
FIG. 1E illustrates a graphical representation of an example heating plant.

FIG. 1E illustrates a graphical representation of an example heating plant, in accordance with an example embodiment. The heating plant includes a boiler 140 that sources the heat exchanger 118. The heat exchanger 118 transfers heat energy to the loads 110*a*, 110*b*, 110*c*, 110*d*, which can be parallel loads that are perimeter heating units.

When the boiler 140 is a condensing boiler, the efficiency of the boiler 140 increases as the return water temperature is lower. To attain the lowest return temperature, the source side flow should be minimized without affecting the load side too adversely. The recommended control methods would be to Maximize Source Side Delta T with constant temperature approach and constant load side Delta T. Further energy efficiency improvements can be obtained using Maximize Source Side Delta T with variable temperature approach and variable load side Delta T if the user is flexible with varying Tload, out.

For non-condensing boilers, the efficiency does not vary much with return temperature, therefore, the recommend method is Maximize Source Side Delta T with constant temperature approach and constant load side Delta T.

Figure 1F:
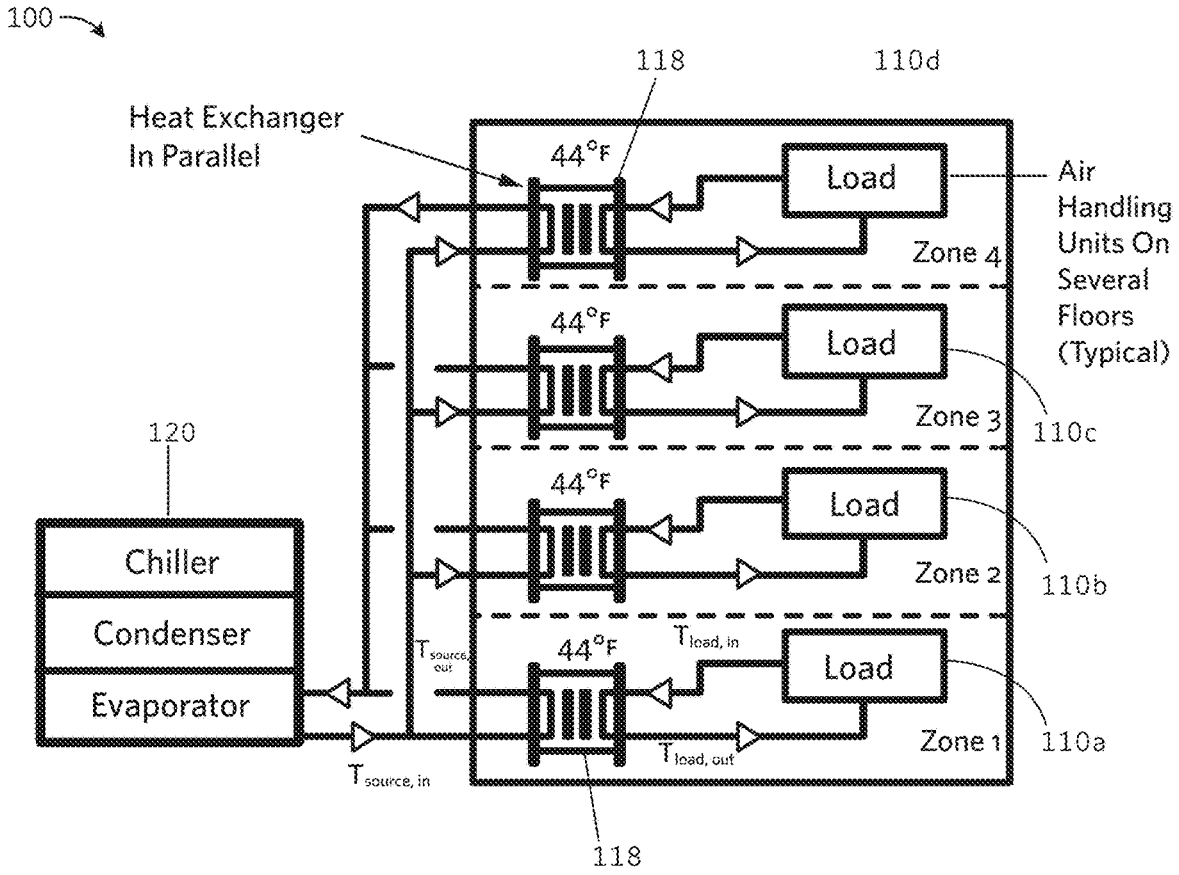
FIG. 1F illustrates a graphical representation of an example chilled water plant having a direct cooling loop.

FIG. 1F illustrates a graphical representation of an example chilled water plant having a direct cooling loop, in accordance with an example embodiment. The chiller 120 sources the heat exchangers 118 that are in parallel. Each heat exchanger 118 transfers heat energy for providing cooled circulation medium to each respective load 110*a*, 110*b*, 110*c*, 110*d*. The loads 110*a*, 110*b*, 110*c*, 110*d* can represent air handling units on a respective floor or zone.

In the configuration of FIG. 1F, the chiller 120 controls the supply temperature, which can be based on ASHRAE®90.1. For the chiller 120, a higher return temperature leads to more efficient operation (approximately 2% efficiency improvement per 1F higher, or equivalent delta Celsius). The recommended control method is Tload, out control or Maximize Source Side Delta T with constant temperature approach and constant load side Delta T. Further energy efficiency improvements can be obtained using Maximize Source Side Delta T with variable temperature approach and variable load side Delta T if the user is flexible with varying Tload, out.

A similar configuration of FIG. 1F can be used for a direct heating loop, in other examples. For condensing boilers 140, the recommended control methods would be Maximize Source Side Delta T with constant temperature approach and constant load side Delta T. Further energy efficiency improvements can be obtained using Maximize Source Side Delta T with variable temperature approach and variable load side Delta T if the user is flexible with varying Tload, out. For non-condensing boilers 140, the efficiency does not vary much with return temperature, therefore, the recommend method is Maximize Source Side Delta T with constant temperature approach and constant load side Delta T.

Figure 1G:
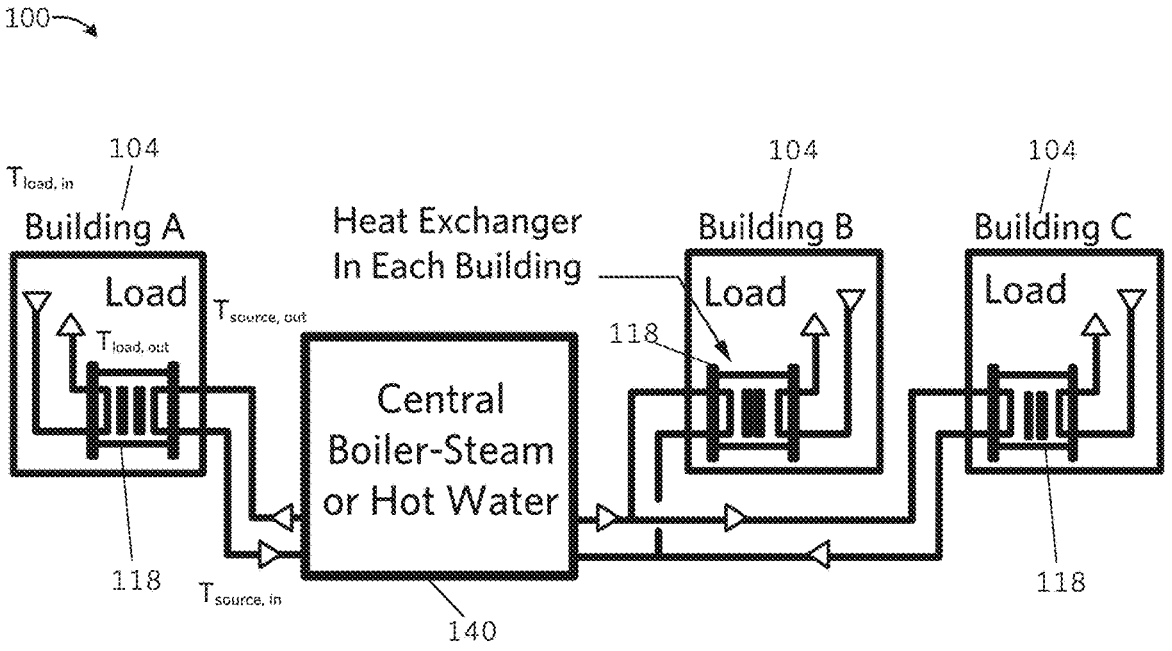
FIG. 1G illustrates a graphical representation of an example heating plant having a district heating loop.

FIG. 1G illustrates a graphical representation of an example heating plant having a district heating loop, in accordance with an example embodiment. The district can be multiple buildings 104. A boiler 140 is used to source the heat exchangers 118 that are in parallel, for example one heat exchanger 118 per respective building 104. Each heat exchanger 118 transfers heat energy to a respective load 110*a*, 110*b*, 110*c*, 110*d* for each building 104. A similar configuration can be used for a district cooling loop, in other examples.

In this configuration, the source side pump 122 is sometimes replaced by a smart energy valve when the application requires. An optimization method is to return the highest temperature on the source side in cooling and return the lowest source side temperature in heating. The recommend control method is Maximize Source Side Delta T with constant temperature approach and constant load side Delta T. Further energy efficiency improvements can be obtained using Maximize Source Side Delta T with variable temperature approach and variable load side Delta T if the user is flexible with varying Tload, out.

Figure 1H:
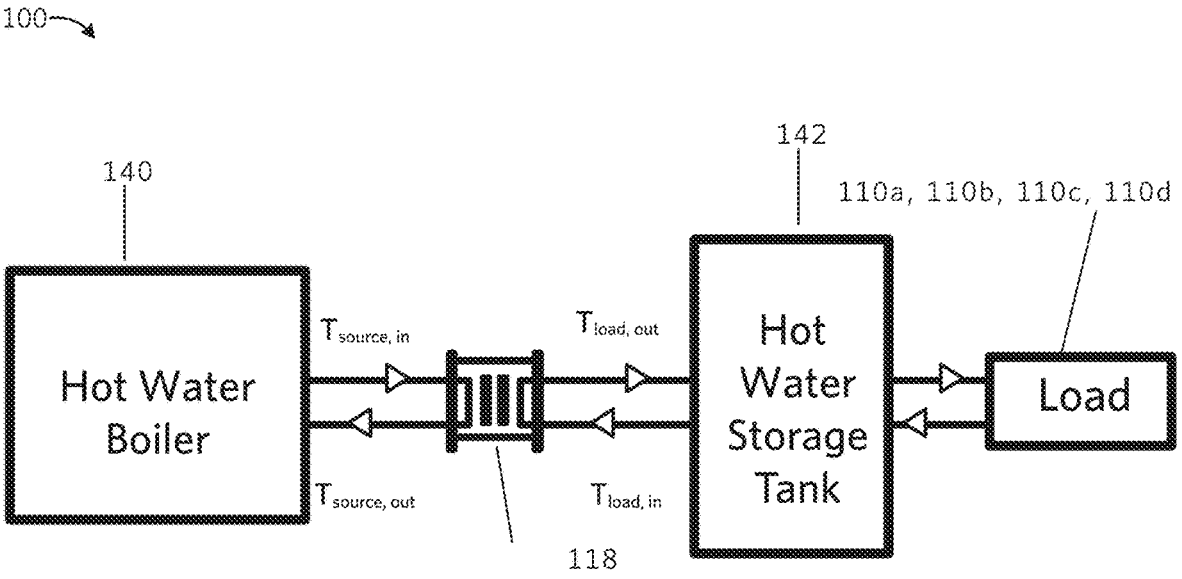
FIG. 1H illustrates a graphical representation of an example heating plant for heating potable water.

FIG. 1H illustrates a graphical representation of an example heating plant for heating potable water, in accordance with an example embodiment. The boiler 140 can be a hot water boiler that sources the heat exchanger 118. The heat exchanger 118 transfers heat energy potable water to a hot water storage tank 142, for sourcing heated potable water to the load 110*a*, 110*b*, 110*c*, 110*d*, which can be faucets, taps, etc. In this configuration the hot water storage tank 142 would usually be required to be kept at a constant temperature. An example control method would be to control Tload, out.

Figure 1I:
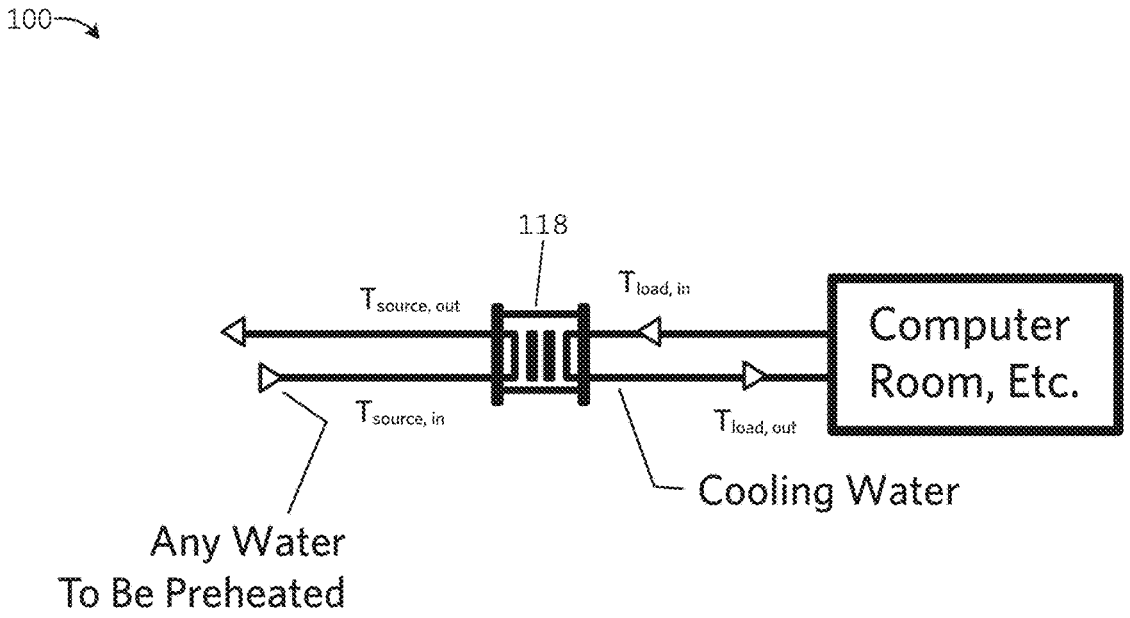
FIG. 1I illustrates a graphical representation of an example building system for waste heat recovery.

FIG. 1I illustrates a graphical representation of an example building system 100 for waste heat recovery, in accordance with an example embodiment. A heat source such as a computer room has heat removed by way of a circulation medium to the heat exchanger 118, in order to cool the computer room. The heat exchanger 118 then transfers the heat to any water to be preheated. In this mode the heat recovery is to be used as much as possible. An example method is to maximize Delta T between Tload, in and Tload, out. Another example method is to control Tsource, out.

In another example, a vehicle system can include a similar system for waste heat recovery, in accordance with an example embodiment. A heat source such as an engine of a vehicle has heat removed by way of a circulation medium to the heat exchanger 118, in order to cool the engine. The heat exchanger 118 then transfers the heat to air of the air circulation system to the passenger interior of the vehicle.

Figure 1J:
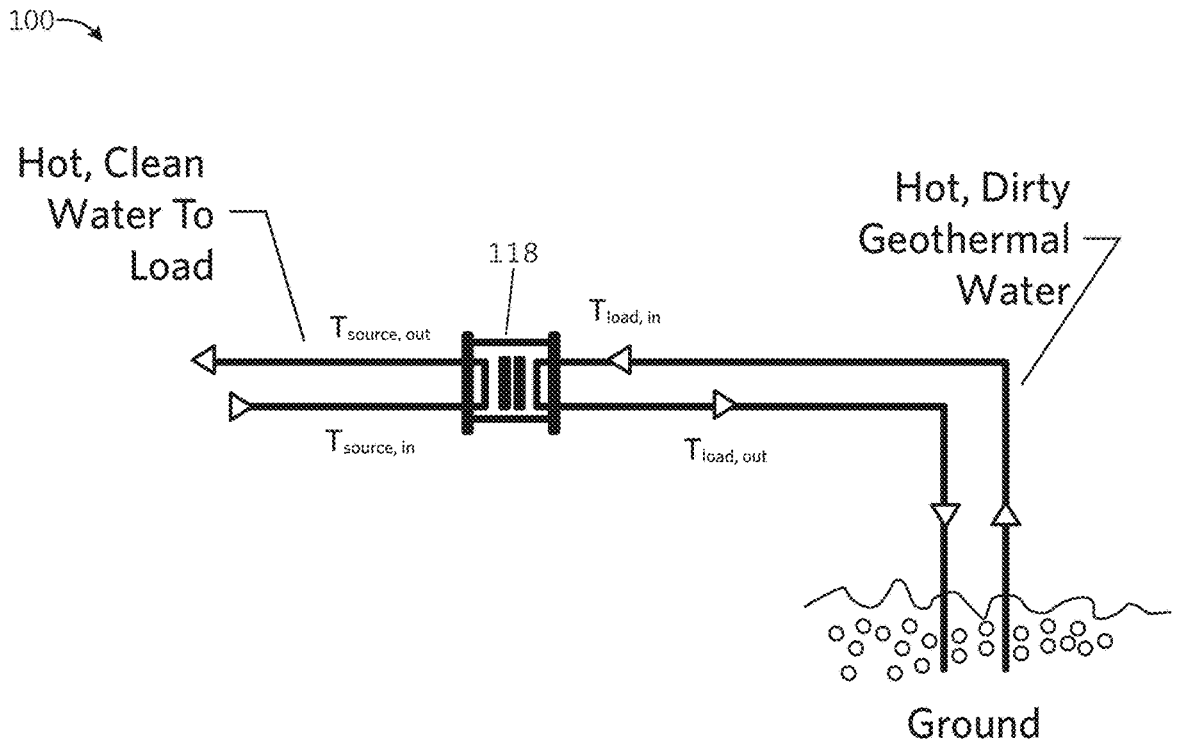
FIG. 1J illustrates a graphical representation of an example building system for geothermal heating isolation.

FIG. 1J illustrates a graphical representation of an example building system 100 for geothermal heating isolation, in accordance with an example embodiment. A heat source such as geothermal is used to heat a circulation medium to the heat exchanger 118. The heat exchanger 118 then transfers the heat to provide hot, clean water to the load(s) 110*a*, 110*b*, 110*c*, 110*d*. In this configuration, it is desired that as much heat is transferred without leaving Tsource, out too cold as it can harm the living organisms in the vicinity. In this case, Tsource, out can be controlled with a minimum temperature set.

If any of the four temperature sensors which measure the port inlet temperatures on the hot and cold side of the heat exchanger 118 are not available or out of range, then the pump controls on the source side control pump 122 can default to constant speed and the pump controls on the load side control pump 102 can default to sensorless mode.

Figure 2A:
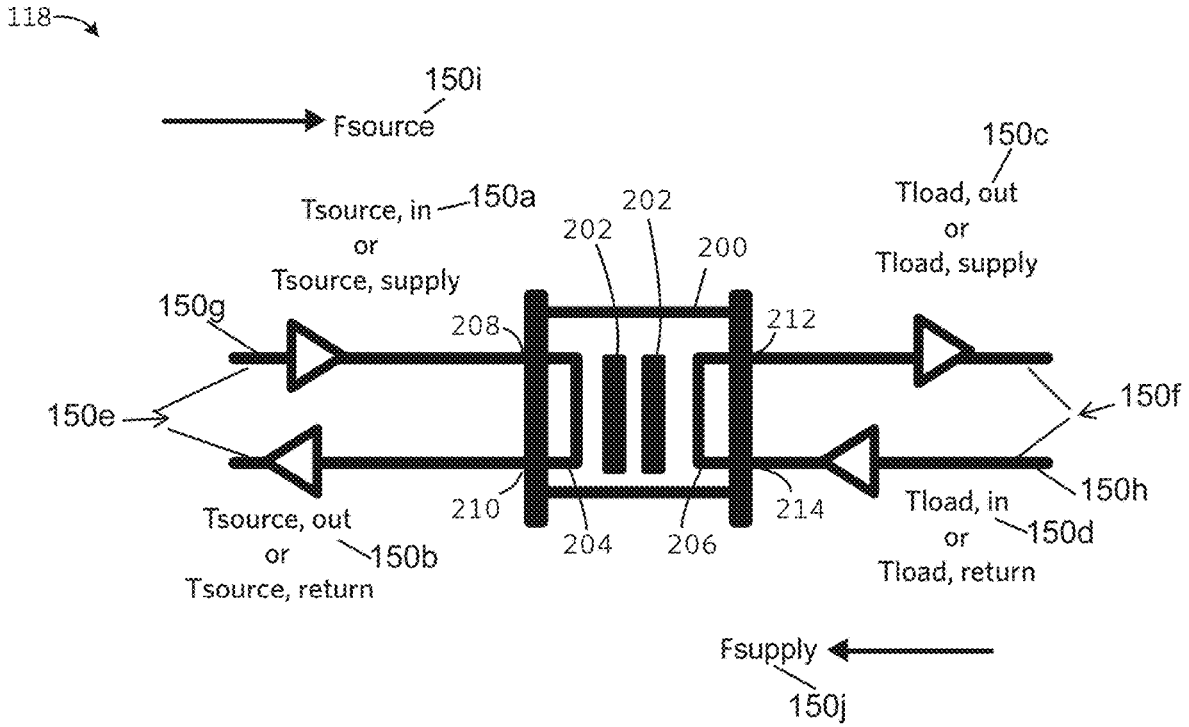
FIG. 2A illustrates a graphical representation of a heat exchanger, in accordance with an example embodiment.

FIG. 2A illustrates a graphical representation of the heat exchanger 118, in accordance with an example embodiment. The heat exchanger 118 is a counter current heat exchanger in an example. The heat exchanger 118 includes a frame 200 that is a sealed casing. The heat exchanger 118 defines a first fluid path 204 (of a first fluid circuit) for a first circulation medium, and a second fluid path 206 (of a second fluid circuit) for a second circulation medium. The first fluid path 204 is not in fluid communication with the second fluid path 206. The first fluid path 204 is in thermal contact with the second fluid path 206. The first fluid path 204 can flow in an opposing flow direction (counter current) to the second fluid path 206. In an example, the heat exchanger 118 is a brazed plate heat exchanger (BPHE). A plurality of brazed plates 202 are parallel plates that facilitate heat transfer between the first fluid path 204 and the second fluid path 206. The first fluid path 204 and the second fluid path 206 flow between the brazed plates 202, typically the first fluid path 204 and the second fluid path 206 are in alternating fluid paths of the brazed plates 202. The plurality of brazed plates 202 are dimensioned with braze patterns for causing turbulence to promote heat transfer between the first fluid path 204 and the second fluid path 206. Turbulent flow in the heat exchanger 118 is increased (decreases probability of turbulent flow), and as a result there is a higher pressure drop across the heat exchanger 118. Turbulent flow promotes loosing of fouling on the braze patterns of the brazed plates 202. For a smaller heat exchanger 118 (which uses less material), a higher pressure drop increases turbulent flow (decreases probability of turbulent flow) but also requires higher pump energy consumption. In other examples, the heat exchanger 118 is a shell and tube (S&T) type heat exchanger or a plate and frame heat exchanger (also known as a gasketed plate heat exchanger (PHE)).

The load side is the side that is connected to the load requiring heat such as a building or room. The source side is connected to the source of heat that is to be transferred such as chiller, boiler, or district fluid. There are two conventions that can be used to notate parameters in heat transfer loops. The first convention, parameters such as temperature and flow are taken with reference to the heat exchanger 118. That is, for example, the water temperature going in to the heat exchanger 118 from the source side is called Tsource, in. The water temperature going out of the heat exchanger 118 from the source side is called Tsource, out.

An alternate convention, parameters are notated such that, on the source side, the supply is taken as the fluid provided from the source to the heat exchanger 118 and the return is taken as the fluid returned to the source. For the load side, the supply is taken as the fluid provided to the load and the return is the fluid returned from the load. This is taken from chiller and fan coil conventions. For the purpose of calculations, this specification will mainly refer to the first convention referencing the in and out looking from the heat exchanger 118.

The frame 200 of the heat exchanger 118 can include four ports 208, 210, 212, 214, as shown in FIG. 2A. Port 208 is for Source, In or Source, Supply. Port 210 is for Source, Out or Source, Return. Port 212 is for Load, Out or Load, Supply. Port 214 is for Load, In or Load, Return. In an example, the frame 200 is an integrated sealed casing that cannot be disassembled, because maintenance is performed by way of flushing through the ports 208, 210, 212, 214.

Various sensors can be used to detect and transmit measurement of the heat exchanger 118. The sensors can include sensors that are integrated with the heat exchanger 118, including sensors for: Temperature Source, In (TSource, In) sensor 150*a*; Temperature Source, Out (TSource, In) sensor 150*b*; Temperature Load, Out (TLoad, Out) sensor 150*c*; Temperature Load, In (TLoad, In) sensor 150*d*; Differential Pressure between Source, In and Source, Out sensor 150*e*; Differential Pressure between Load, In and Load, Out sensor 150*f*; Pressure at Source, In sensor 150*g*; Pressure at Load, In sensor 150*h*. More or fewerof the sensors can be used in various examples, depending on the particular parameter or coefficient being detected or calculated, as applicable. In some examples, the sensors include flow sensors for: Flow, supply (Fsupply) sensor 150*i*; and Flow, source (Fsource) sensor 150*j*, which are typically external to the heat exchanger 118, and can be located at, e.g., the control pump 102, 122, or the external sensor 114, or the load 110*a*, 110*b*, 110*c*, 110*d*.

Baseline measurement from the sensors is stored to memory for comparison with subsequent real-time operation measurement from the sensors. The baseline measurement can be obtained by factory testing using a testing rig, for example. In some examples, the baseline measurement can be obtained during real-time system operation.

Figure 2B:
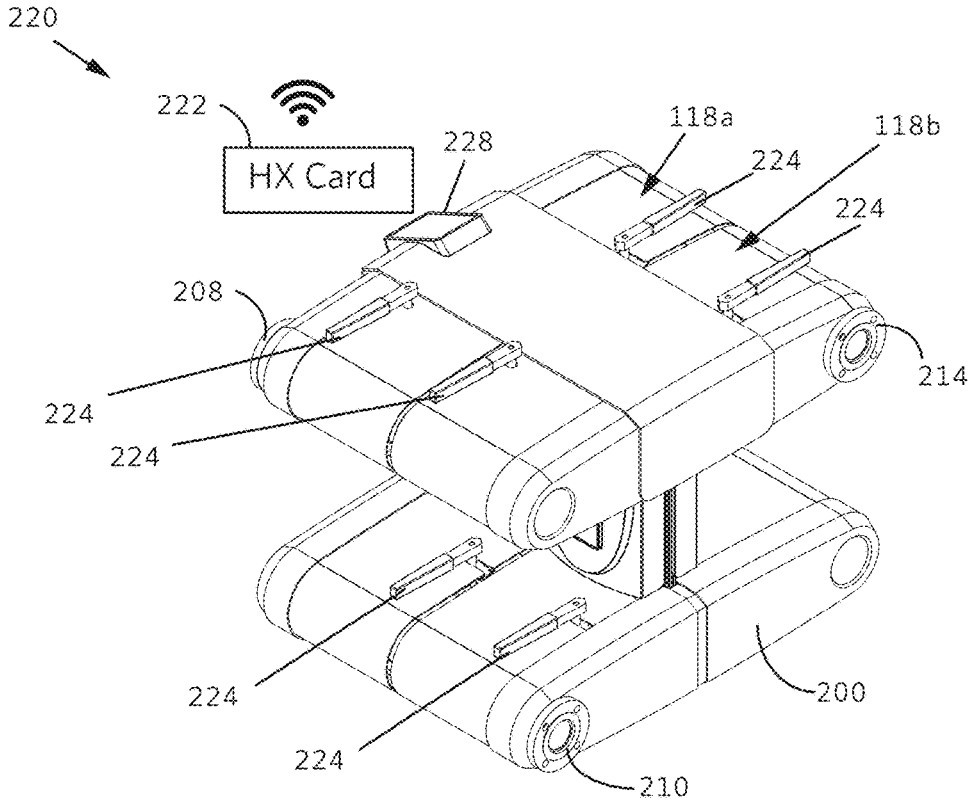
FIG. 2B illustrates a perspective view of an example heat transfer module with two heat exchangers, in accordance with an example embodiment.
Figure 2C:
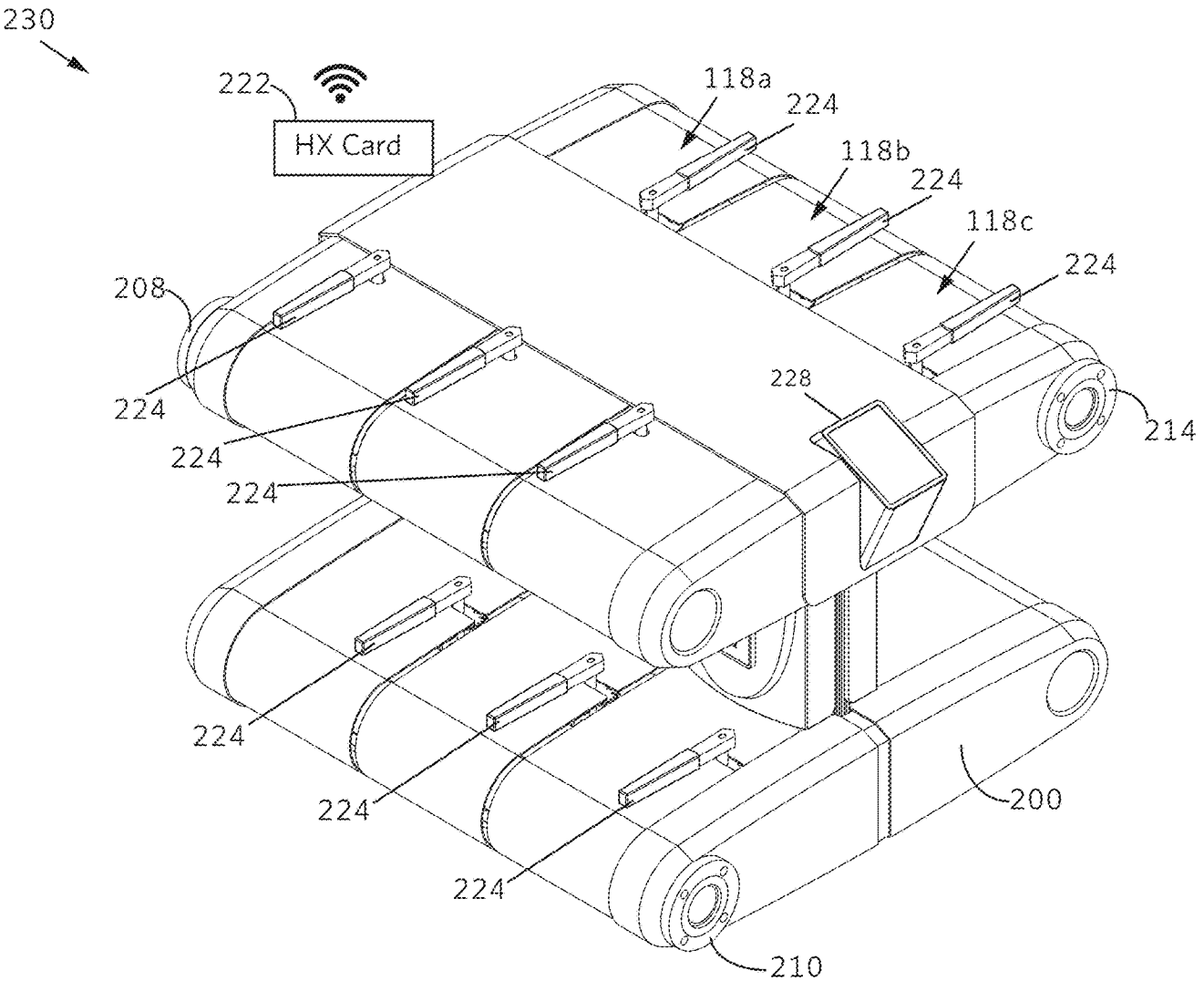
FIG. 2C illustrates a perspective view of an example heat transfer module with three heat exchangers, in accordance with an example embodiment.
Figure 2D:
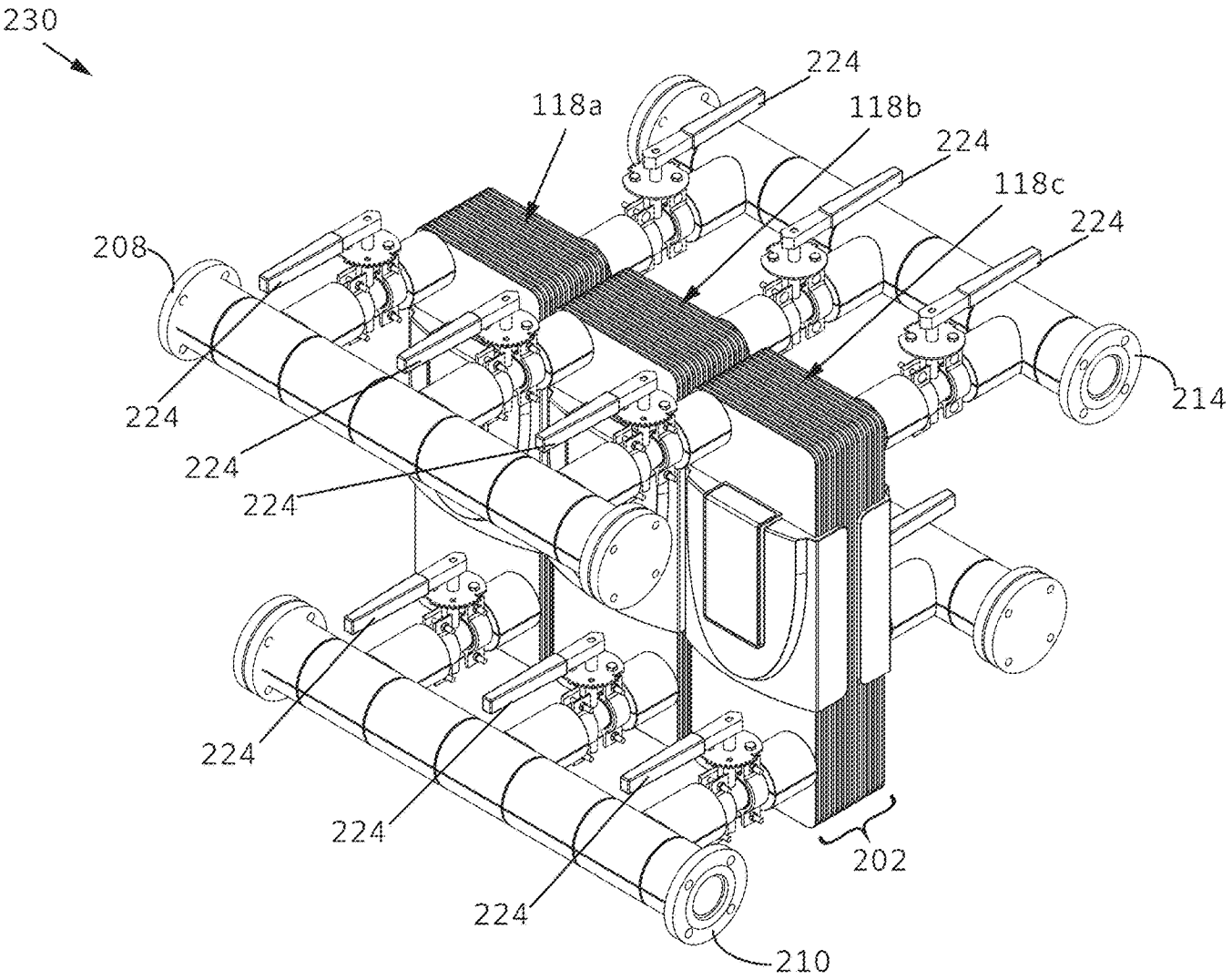
FIG. 2D illustrates a partial breakaway view of contents of the heat transfer module of FIG. 2C.
Figure 2E:
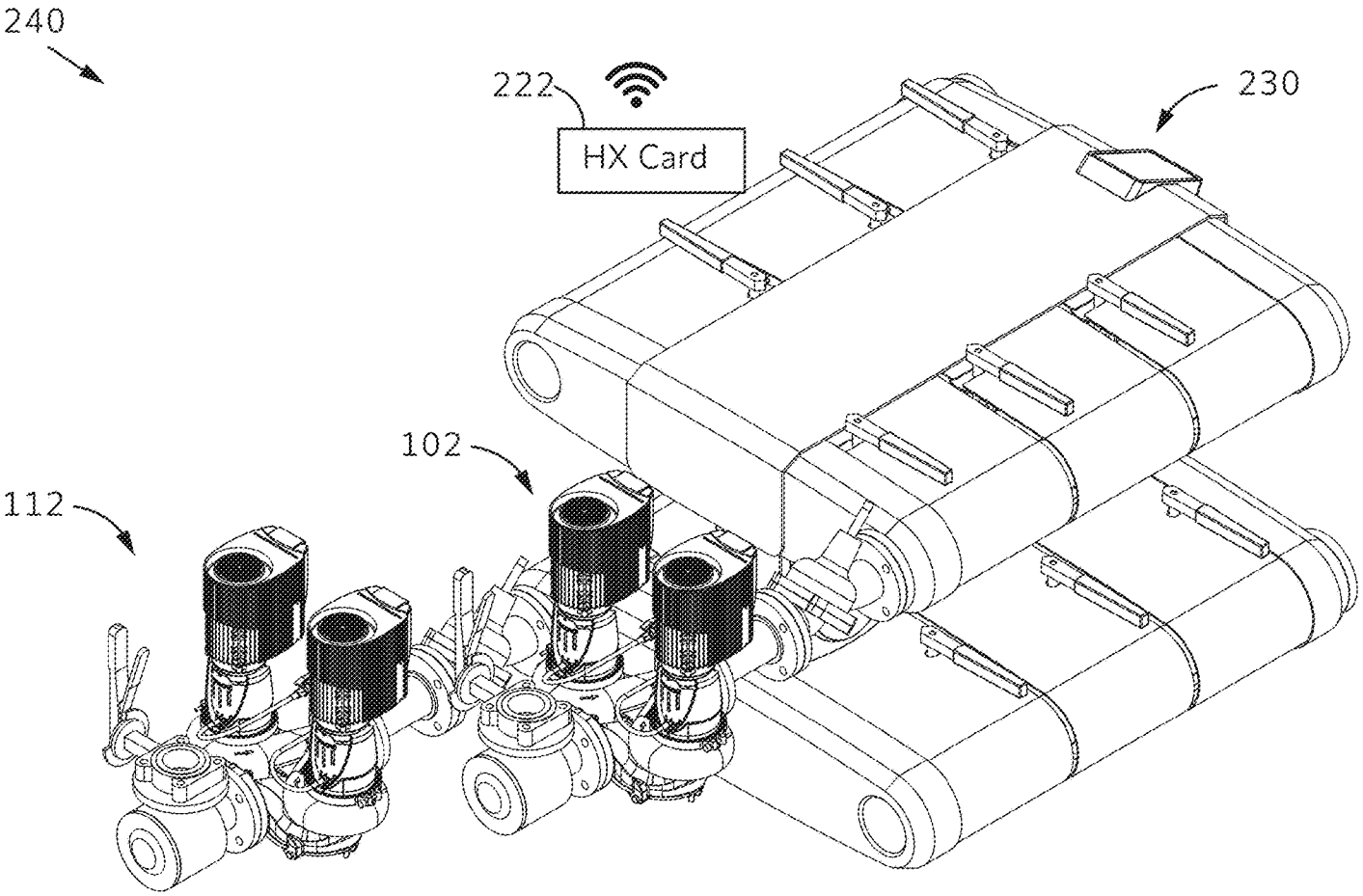
FIG. 2E illustrates a perspective view of an example heat transfer system that includes the heat transfer module of FIG. 2C and two dual control pumps.

Example embodiments include a heat transfer module that can include one or more heat exchangers 118 within a single sealed casing (frame 200), wherein FIG. 2B illustrates a heat transfer module 220 with two heat exchangers 118 and FIGS. 2C and 2D illustrate a heat transfer module 230 with three heat exchangers 118.

FIG. 2E illustrates a heat transfer system 240 that includes the heat transfer module 230 and pumps 102, 122. In examples, the heat transfer module can include one, two, three or more heat exchangers 118 within the single sealed casing (frame 200). The heat transfer system 240 provides a reliable and optimized heat transfer solution comprised of heat exchanger(s) 118 and pumps 102, 122 by providing an optimized heat transfer system solution rather than providing equipment sized for duty conditions only. The heat transfer system 240 can be used for liquid to liquid HVAC applications with typical applications in residential, commercial, industrial and public buildings, district heating, etc. Applications include cooling, heating, water side economizer (e.g., cooling tower), condenser isolation (e.g., lake, river, or ground water), district heating and cooling, pressure break, boiler heating, thermal storage, etc. The heat transfer system 240 can be shipped as a complete package or optionally shipped in modules that can be quickly assembled on site.

FIG. 2B illustrates a perspective view of the heat transfer module 220 with two heat exchangers 118*a*, 118*b*, in accordance with an example embodiment. The heat transfer module 220 includes a HX card 222 for receiving measurement from the various sensors of the heat transfer module 220, determining that maintenance is required on the heat transfer module 220, and communicating that maintenance is required to the controllers 116 or the control pumps 102, 122. Shown are ports 208, 210, 214, note that port 212 is not visible in this view. A touch screen 228 can be used as a user interface for user interaction with the respective heat transfer module 220. The touch screen 228 can be integrated with the HX card 222, in a tablet computer style device.

Each heat exchanger 118*a*, 118*b* can have one or more respective shutoff valves 224 that are controllable by the HX card 222. Therefore, each heat exchanger 118*a*, 118*b* within the heat transfer module 220 is selectively individually openable or closable by the HX card 222. In the examples shown, there are four shutoff valves across 224 each heat exchanger 118*a*, 118*b*.

The various sensors can be used to detect and transmit measurement of parameters of the heat transfer module 220. The sensors can include temperature sensors for Temperature Source, In (TSource, In); Temperature Source, Out (TSource, In); Temperature Load, Out (TLoad, Out); Temperature Load, In (TLoad, In). The temperature sensors can further include temperature sensors, one each for respective Temperature output of the source and load fluid path of each heat exchanger 118*a*, 118*b* (four total in this example). Therefore, eight total temperature sensors can be used in the example heat transfer module 220.

The sensors can also include sensors for: Differential Pressure between Source, In and Source, Out; Differential Pressure between Load, In and Load, Out; Pressure at Source, In; Pressure at Load, In. More or less of the sensors can be used in various examples, depending on the particular parameter or coefficient being detected or calculated, as applicable. Such sensors can be contained within the sealed casing (frame 200). In some examples, the sensors include flow sensors for: Flow, supply (Fsupply); and Flow, source (Fsource), which are typically external to the heat transfer module 220.

FIG. 2C illustrates a perspective view of the heat transfer module 230 with three heat exchangers 118*a*, 118*b*, 118*c*, in accordance with an example embodiment. FIG. 2D illustrates a partial breakaway view of contents of the heat transfer module 230, shown without the frame 200. As can be seen in FIG. 2D, the plurality of brazed plates 202 of each of the heat exchangers 118*a*, 118*b*, 118*c* are oriented vertically.

The heat transfer module 220 includes the HX card 222 for receiving measurement from the various sensors of the heat transfer module 220, determining that maintenance is required on the heat transfer module 220, and communicating that maintenance is required to the controllers 116 or the control pumps 102, 122. Shown are ports 208, 210, 214, note that port 212 is not visible in this view. The various sensors can be used to detect and transmit measurement of parameters of the heat transfer module 230, with such sensors described above in relation to the heat transfer module 220 (FIG. 2B) having the two heat exchangers 118*a*, 118*b*. For example, ten total temperature sensors can be used in the example heat transfer module 230, i.e., one for each port 208, 210, 212, 214 (four total), one for each output of each heat exchanger 118*a*, 118*b*, 118*c* of the source path (three total), and one for each output of each heat exchanger 118*a*, 118*b*, 118*c* of the load path (three total).

FIG. 2E illustrates a perspective view of an example heat transfer system 240 that includes the heat transfer module 230 of FIG. 2C and two control pumps 102, 122. The control pumps 102, 122 are each dual control pumps that each have two pump devices, as shown. A dual control pump allows for redundancy, standby usage, pump device efficiency, etc. The dual control pump can have two separate PC cards 226 in some examples. A similar configuration can be used for the heat transfer module 220 of FIG. 2B or a single heat exchanger 118 as in FIG. 2A. As shown in FIG. 2E, control pump 102 is connected to port 212 for Load, Out or Load, Supply. Control pump 122 is connected to port 208 for Source, In or Source, Supply. In other examples, the control pumps 102, 122 are not directly connected to each port 212, 208 but are rather upstream or downstream of each port 212, 208, and connected through intermediate piping, or other intermediate devices such as strainers, in-line sensors, valves, fittings, tubing, suction guides, boilers, or chillers.

The heat transfer module 230 has a dedicated HX card 222 with WIFI communication capabilities. The HX card 222 can be configured to store a heat transfer performance map of each heat exchanger 118*a*, 118*b*, 118*c* in the heat transfer module 230, based on factory testing. The HX card 222 can poll data from the ten temperature sensors, two pressure sensors, and two differential pressure sensors. The HX card 222 can also poll flow measurement data from the two control pumps 102, 122. If the control pumps 102, 122 are nearby and able to communicate via WIFI (via PC card 226), then data is polled directly from the pumps 102, 122, otherwise flow measurement data is collected using wired connection or through the Local Area Network. The control pumps 102, 122 can receive data from the HX card 222 and show, on the pump display screen, the inlet and outlet temperature of the fluid that the control pump 102, 122 is pumping and the differential pressure across the heat exchanger module 230.

The various sensors allow the controllers 116 to calculate heat exchanged in real time based on the flow measurement (determined by the pumps 102, 122 or external sensor 114) and temperatures on each side of the heat exchanger module 230. Additionally, for heat exchanger modules with two or three heat exchangers 118, each branch on the outlet connection can have a temperature sensor to allow fouling/clogging prediction in each individual heat exchanger 118. For each heat exchanger 118, data collected by the HX card 222 and pump PC cards 226 can be used to calculate overall heat transfer coefficient (U value) in real time and compare that with the overall clean heat transfer coefficient (Uclean) to predict fouling and need for maintenance/cleaning. The collected data will be used to calculate total heat transfer in real time and optimized system operation to minimize energy costs (for pumping and on the source) while meeting load requirements. Internet connectivity will be achieved through the dedicated HX card 22 and pump PC card 226. Data is uploaded to the Cloud 308 for data logging, analysis, and control.

Suction guides (not shown) can be integrated in the heat transfer module 220, 230 with a strainer having a #20 grade (or greater) standard mesh. In an example, the suction guide is a multi-function pump fittings that provide a 900 elbow, guide vanes, and an in-line strainer. Suction guides reduce pump installation cost and floor space requirements. If the suction guide is not available, then a Y-Strainer with the proper mesh can be included. Alternatively, a mesh strainer can be installed on the source side.

Figure 3A:
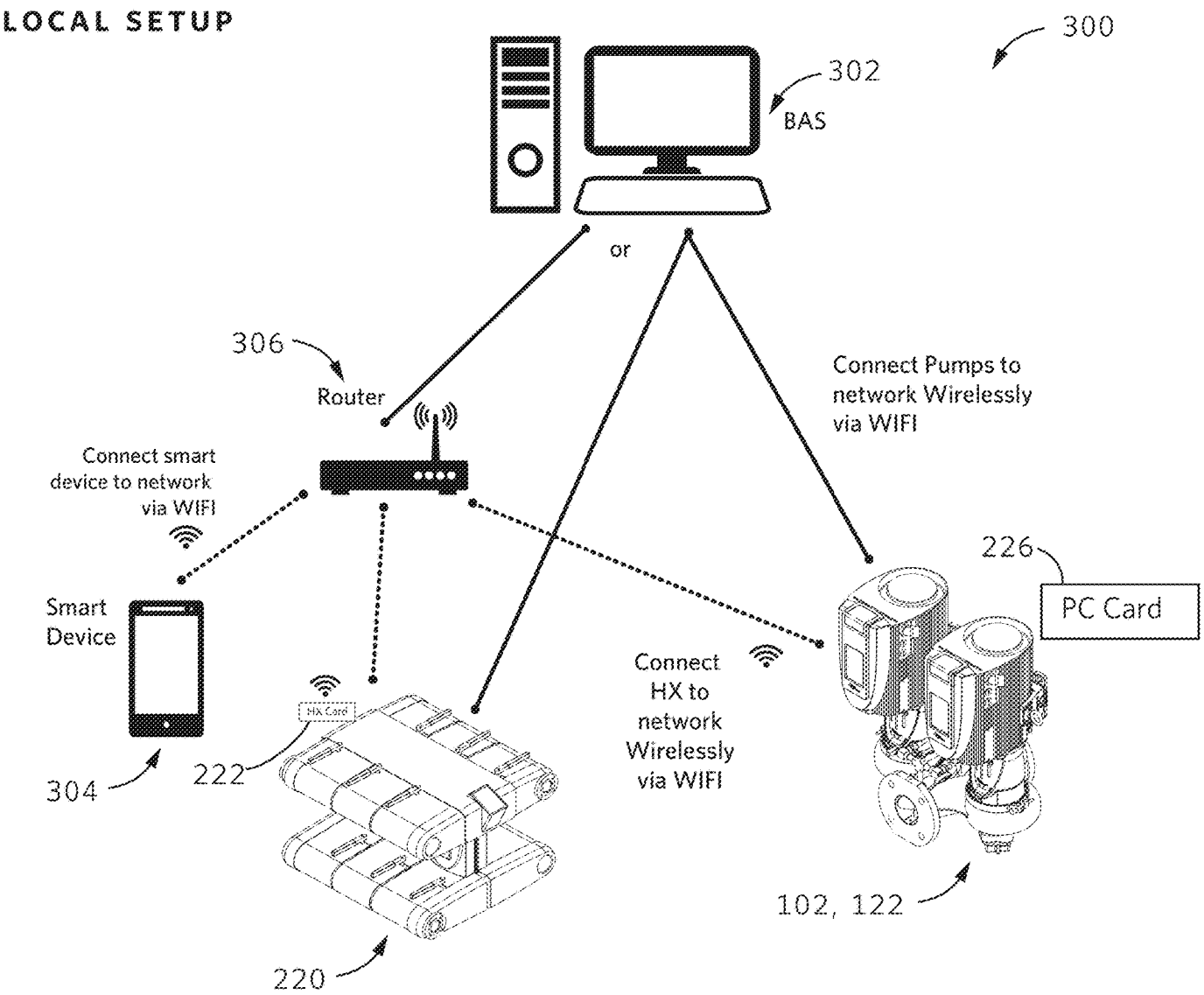
FIG. 3A illustrates a graphical representation of network connectivity of a heat transfer system, having local setup.

FIG. 3A illustrates a graphical representation of network connectivity of a heat transfer system 300, having local system setup. The heat transfer system 300 includes a Building Automation System (BAS) 302 that can include the controllers 116 (FIGS. 1A and 1B). The BAS 302 can communicate with the control pumps 102, 122 and the heat exchanger module 220 by a router 306 or via short-range wireless communication. A smart device 304 can be in communication, directly or indirectly, with the BAS 302, the control pumps 102, 122 and the heat exchanger module 220. The smart device 304 can be used for commissioning, setup, maintenance, alert/notifications, communication and control of the control pumps 102, 122 and the heat exchanger module 220.

Figure 3B:
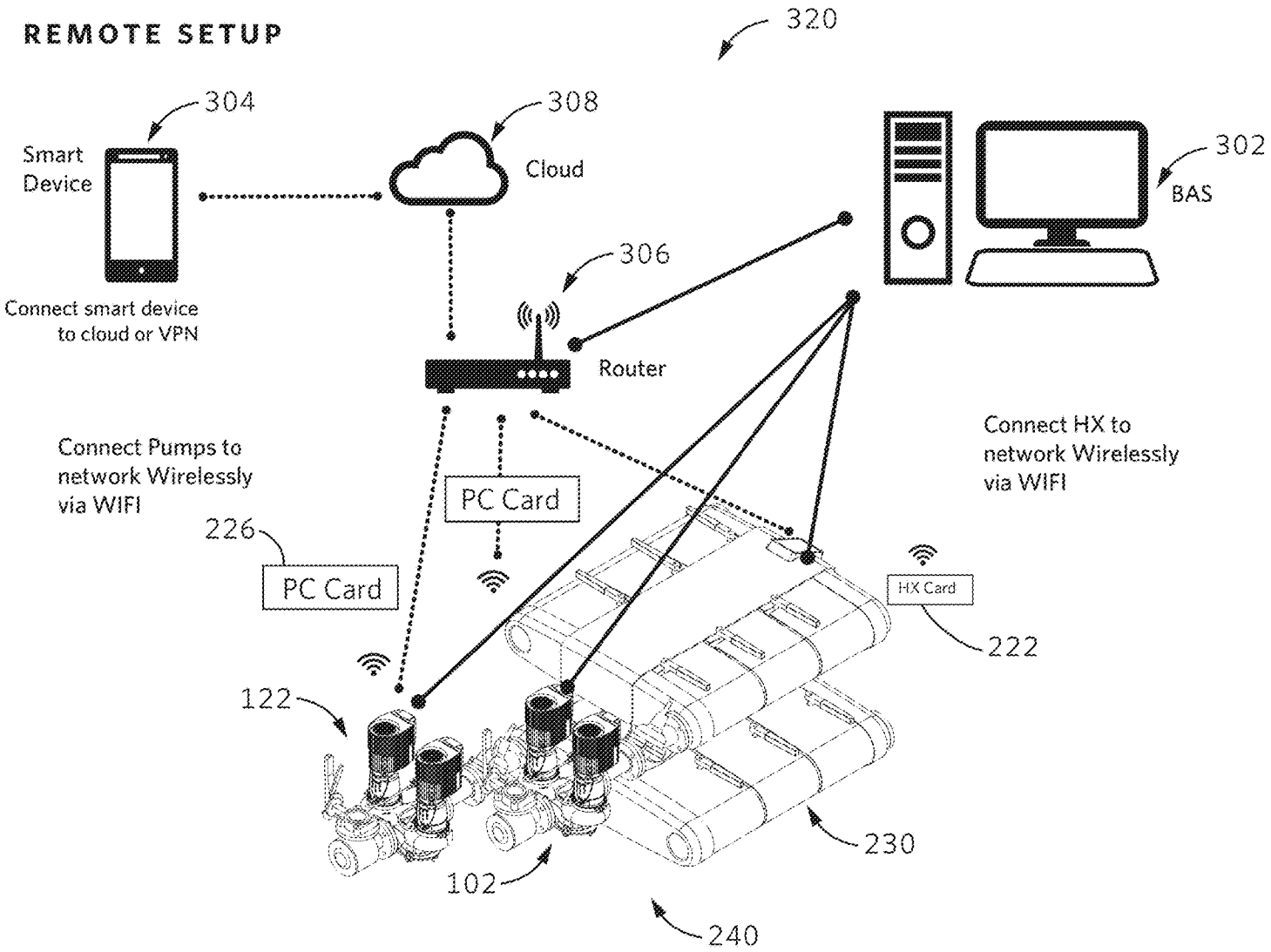
FIG. 3B illustrates a graphical representation of network connectivity of a heat transfer system, having remote setup.

FIG. 3B illustrates a graphical representation of network connectivity of a heat transfer system 320, having remote system setup. The BAS 302 can communicate with the control pumps 102, 122 and the heat exchanger module 220 by a router 306 or via short-range wireless communication. The smart device 304 can access, by way of Internet connection, one or more cloud computer servers over the cloud 308. The smart device 304 can be in communication, directly or indirectly with the BAS 302, the control pumps 102, 122 and the heat exchanger module 230 over the cloud 308. The smart device 304 can be configured for commissioning, setup, maintenance, alert/notifications, communication and control of the control pumps 102, 122 and the heat exchanger module 230. The cloud servers store an active record of measurement of the various equipment, and their serial numbers. When maintenance and service is required, records and notes can be viewed. This can be part of a service application ("app") for the smart device 304.

Each heat transfer module 230 can have a HX card 222. The function of the HX card 222 is to connect to all sensors and devices on the heat transfer module 230 either through a physical connection (Controller Area Network (CAN) bus or direct connection) and/or wirelessly. The HX card 222 can also collect information from the pump PC card 226 either through a physical connection or wirelessly.

The HX card 222 gathers all of the sensor measurement and other information and processes it and controls the flow required to the source side control pump 122. The HX card 222 also sends sensor readings to the source side control pump 122 and the load side control pump 102 so that they can display real-time information on their respective display screens(s). The HX card 222 can also send the sensor measurement information to the Cloud 308. In an example, all heat exchanger related calculations can be handled by the HX card 222 for more immediate processing. In an example, the other devices can be configured as devices for displaying data previous calculated by the HX card 222.

The user can modify settings by connecting to the HX card 222 locally using the wireless smart device 304 or the BAS 302. The user can also modify limited settings remotely by connecting to the Cloud 308. These settings will be limited depending on security restrictions.

When the HX card 222 and the control pumps 102, 122 are connected through the router 306, then the smart device 304, the PC card 226 and the HX card 222 can communicate using the router 306. When the HX card 222 and the control pumps 102, 122 are not connected through on the router 306, then the HX card 222 can automatically open a WIFI hotspot for communication between the smart phone 304, PC card 226 and HX card 222. When the HX card 222 opens the WIFI hotspot, communication to the Cloud 308 can occur either through the built in IoT card, Ethernet connection, SIM card, etc.

The PC card 226 can connect to the HX card 222 either wirelessly or through a physical connection and provide the HX card 222 with pump sensor data. The PC card 226 can receive data from the HX card 222 (measurement, alerts, calculations) to be displayed on the pump display screen.

The PC card 226 can communicate to the HX card 222 wirelessly using the ModBUS protocol, as understood in the art. Other protocols can be used in other examples. For communication to occur between the PC card 226 and the HX card 222, the IP addresses of the PC card 226 and the HX card 222 need to be known. Internal identifiers can also be built into the PC card 226 and the HX card 222 such that they can find each other easily on a local area network. The PC card 226 can send information to other devices and accepting information and control from other devices.

The BAS 302, when used, can connect to the HX card(s) 222 and the PC card(s) 226 wirelessly through the router or through a direct connection. In an example, the BAS 302 has the highest control permissions and can override the HX card(s) 222 and the PC card(s) 226.

The HX card 222 provides to the Cloud 308 historic measurement data for storage. There can an application on the smart device 304 where the user can view data and generate reports. The Cloud 308 can use historic data to create reports and provide performance management services.

The smart device 304 can connect locally through the router 306 to the HX card 222 to modify settings. The smart device 304 can also connect to the Cloud 308 where the user can modify a limited number of settings, in an example.

An application (App), webserver user interface, and/or website can be provided so that the user has all the functionality available on the PC card 226 or the Cloud 308.

The heat transfer system 300, 320 can be configured to provide information to users through the PC card 226, and remotely through online services and a control pump manager. The inputs to the HX card 222 can collect readings and measurements from the two temperature sensors on the cold side fluid and the two temperature sensors on the hot side fluid across the entire heat transfer module 230. Duplex and triplex heat transfer modules 220, 230 can have additional temperature sensors on the outlets of each individual heat exchanger 118*a*, 118*b*, 118*c* to calculate the temperature difference across the single heat exchanger 118*a*, 118*b*, 118*c*. The absolute temperature difference between the two temperature sensors is called the delta T. The HX card 222 and PC card 226 can communicate in real time and provide the data to the Cloud 308 for data logging and processing.

The heat transfer system 300, 320 can operate using demand based controls. Changes in the heat load in the building (load side, in general) will result in changes in flow requirement. In some examples, the control pump(s) 102 on load side will adjust speed to meet the flow requirement in real time based on sensorless (e.g., parallel or coordinated sensorless) operation. In some examples, the control pump 102 calculates the flow in real time and the HX card 222 gets signals from temperature sensors installed on inlet and outlet of heat exchanger(s) 118. The temperature difference is calculated in real time on the HX card 222 and together with flow used to calculate heat load (Q) required in the system load 110*a*, 110*b*, 110*c*, 110*d* of the building 104 in real time.

The HX card 222 calculates the optimal flow and temperatures on the source side to achieve the most energy efficient system operation. The source side fluid flow can be controlled by various methods of heat transfer loop control.

The heat transfer system 300, 320 can monitor the amount of time the system operates at part loads and full loads (duty load) and, when the part load operating time exceeds a set time limit, can operate the pumps 102, 122 at full load flow to automatically flush the heat exchanger 118. Operating the pumps at full load flow activates the heat exchanger's 118 self-cleaning ability. This feature is programmed with parameters of cleaning frequency of self-cleaning hours per run time hours and time of day start for self-cleaning. An example default self-cleaning, full load flow operating time is 30 minutes for every 168 hours (7 days) of part load operating time at 3 am in the morning. The default part load threshold is set at 90% of full load flow (duty flow).

In some examples, the user has access to sensor readings on the HX card 222. Connected pumps 102, 122 can display real time sensor data on their respective display screens(s). The HX card 222 uploads historic sensor data to the Cloud 308 where the user can access the sensor data.

In some examples, the HX card 222 can enable heat transfer algorithms (e.g., various heat transfer loop control), real time fouling tracking, and real time error monitoring and maintenance tracking.

The PC card 226 can communicatively connect to the HX card 222 and display, on the touch screen 530*a* (FIG. 5) of the respective control pump 102, 122, additional trending, fouling tracking, and maintenance record information. The Cloud 308 can monitor the information and performance reports and error tracking to the customer with current usage, savings, and recommended actions.

The HX card 222 can store individual heat exchanger data, such as heat transfer module model and serial numbers, design points, mapped heat transfer performance curves (U value as a function of flow). Mapped data of heat transfer curves to be tested in house for each individual heat exchanger 118.

Service history can be stored on the Cloud 308. Service history can be upload to the HX card 222 through Webserver UI, PC card 226, or Cloud 308. If the Cloud 308 does not have the most up to date version then the HX card 222 can push the records to the Cloud 308. If the Cloud 308 has the most up to date version, the Cloud 308 can push the record to the HX card 222.

For the HX card 222, in some examples, data sampling (inlet and outlet temperatures and pressure of hot and cold side, hot and cold side flow) can be taken every minute up to but not longer than every 5 minutes. Data can be regularly updated and stored on the Cloud 308. All inputs and calculated parameters can be updated as per the sampling time and can be shown on the display screen of the control pump 102, 122. The calculated parameters include, delta T, differential pressure, flow, Udirt (overall heat transfer coefficient of heat exchanger after some time of operation), and the heat exchanged (calculated for both the source and load side fluids), total pumping energy, and system efficiency (heat exchanged divided by the total pumping energy, shown in units of Btu/h in imperial and kW in metric).

The control pump 102, 122 can have a respective touch screen 530*a* (FIG. 5) on the PC card 226 showing trending heat exchanger performance data. Through the touch screen 530*a*, the user can access Heat Exchanged vs. Time, Temperature in and Temperature Out vs. Time, and Differential Pressure vs. Time. The touch screen 530*a* can display the heat transfer performance data for the respective fluid side that the pump 102, 122 is connected to.

Performance management service can provide additional trending data: Delta T over time for both hot and cold fluid side and heat transfer efficiency over time in the form Btu/hr (kW) of exchanged thermal energy per electrical kW spent by the pumps 102, 122 (on both source and load side).

Example various controls operations of the heat transfer system 300, 320 are as follows.

1. Constant speed control. The source size pump runs constantly at duty point speed. This speed can be changed if required.

2. Tsource, out control (Feedback Method). The outlet temperature on the source side of the heat transfer module 220, 230 is kept at a fixed set point as per design conditions or dynamically controlled by the BAS 302. Tsource, out is controlled by varying the source side pump flow.

3. Tload, out control (Feedback method). The supply temperature on the load side of the heat transfer module 220, 230 is kept at a fixed set point as per design conditions or controlled by a set temperature difference from Tsource, in. The setpoint is controlled by varying the source side pump flow.

4. Proportional Flow Matching. Proportional flow matching is the term used to express that the source side volumetric flow will match the load side volumetric flow according to the ratio of the absolute value of [ρload×Cload×abs(Tload, in, design−Tload, out, design)]/[ρsource×Csource×abs(Tsource, out, design−Tsource, in, design)]. For example, if the ratio is 1.2, then the required source side flow is 1.2 load side flow. The inputs used to calculate this ratio is taken from the selection software design conditions. The user can modify these parameters if any of these conditions change in the future.

5. Maximize Source Side Delta T with constant temperature approach and constant load side Delta T. The controllers 116 reduce the source side flow to attain lower return temperatures to the source in heating and higher return temperatures in cooling—maximizing the source side delta T. This is beneficial for applications using boilers and chillers as the return temperature directly affects the efficiency of the equipment. In this control method, the source side flow is reduced to ensure that the temperature difference between the source side supply temperature and the load side supply temperature remains the same as per design and the same load side design difference between Tload, in and Tload, out. For part load conditions, the source side flow is reduced even less than with the proportional flow matching scenario. For condensing boilers, the lower return temperature helps increase the efficiency of the boiler. For chillers, the high return temperature increase chiller efficiency. In addition, the lower source side flow saves pumping energy.

6. Maximize Source Side Delta T with variable temperature approach and variable load side Delta T. This algorithm is similar to "5. Maximize Source Side Delta T with constant temperature approach and constant load side Delta T", above, except that the temperature approach between Tsource, in and Tload, out can vary to maximize the source side delta T (the absolute difference between Tsource, in−Tsource, out). The load side can also vary depending on the current real-time requirements.

For the heat transfer system 300, 320:

(A) energy impact is predicted as: Fouling effect can be used to calculate excess pressure loss and increase in pumping energy due to the fouling for each fluid loop;

(B) based on fouling the system 300, 320 will self-flush the heat exchanger 118 to reduce the loss of performance;

(C) the impact of the self flushing/cleaning can be assessed and over time and can predict the percent impact of flushing (to assess temporary or permanent fouling);

(D) the flush/self cleaning cycle can be set for an off-schedule time up to a severity level of fouling in some examples, beyond which an emergency cleaning would occur;

(E) the economic trigger for a cleaning in place (chemical) by a service person can be sent via notification;

(F) the ability to isolate one heat exchanger of the heat transfer module for cleaning or service in situ while the remainder heat exchangers 118 continues to provide service to the building 104 (heat transfer function service);

(G) the rate of fouling progression can self-learn to trend to a scheduled cleaning date so that the maintenance cleaning can be booked as opposed to an emergency cleaning.

Figure 4A:
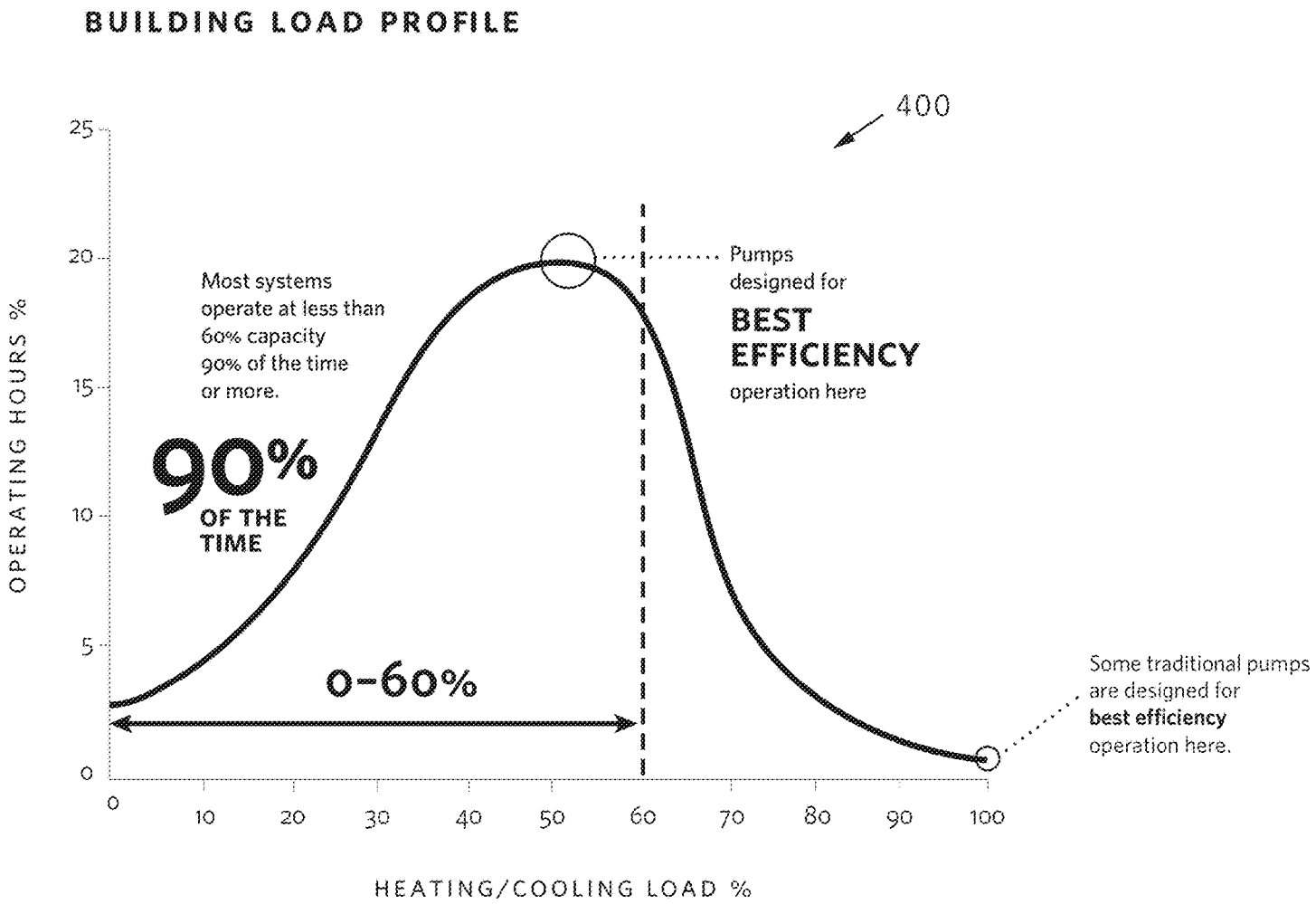
FIG. 4A illustrates a graph of an example heat load profile for a load such as a building.

FIG. 4A illustrates a graph 400 of an example heat load profile for a load such as for the load 110*a*, 110*b*, 110*c*, 110*d* of the building 104 (FIG. 1B), for example, for a projected or measured "design day". The load profile illustrates the operating hours percentage versus the heat load percentage (heat load refers to either heating load or cooling load). For example, as shown, many example systems may require operation at only 0% to 60% load capacity 90% of the time or more. In some examples, a control pump 102 may be selected for best efficiency operation at partial load, for example on or about 50% of peak load. Note that, ASHRAE®90.1 standard for energy savings requires control of devices that will result in pump motor demand of no more than 30% of design wattage at 50% of design water flow (e.g. 70% energy savings at 50% of peak load). The heat load can be measured in BTU/hr (kW). It is understand that the "design day" may not be limited to 24 hours, but can be determined for shorter or long system periods, such as one month, one year, or multiple years.

Figure 4B:
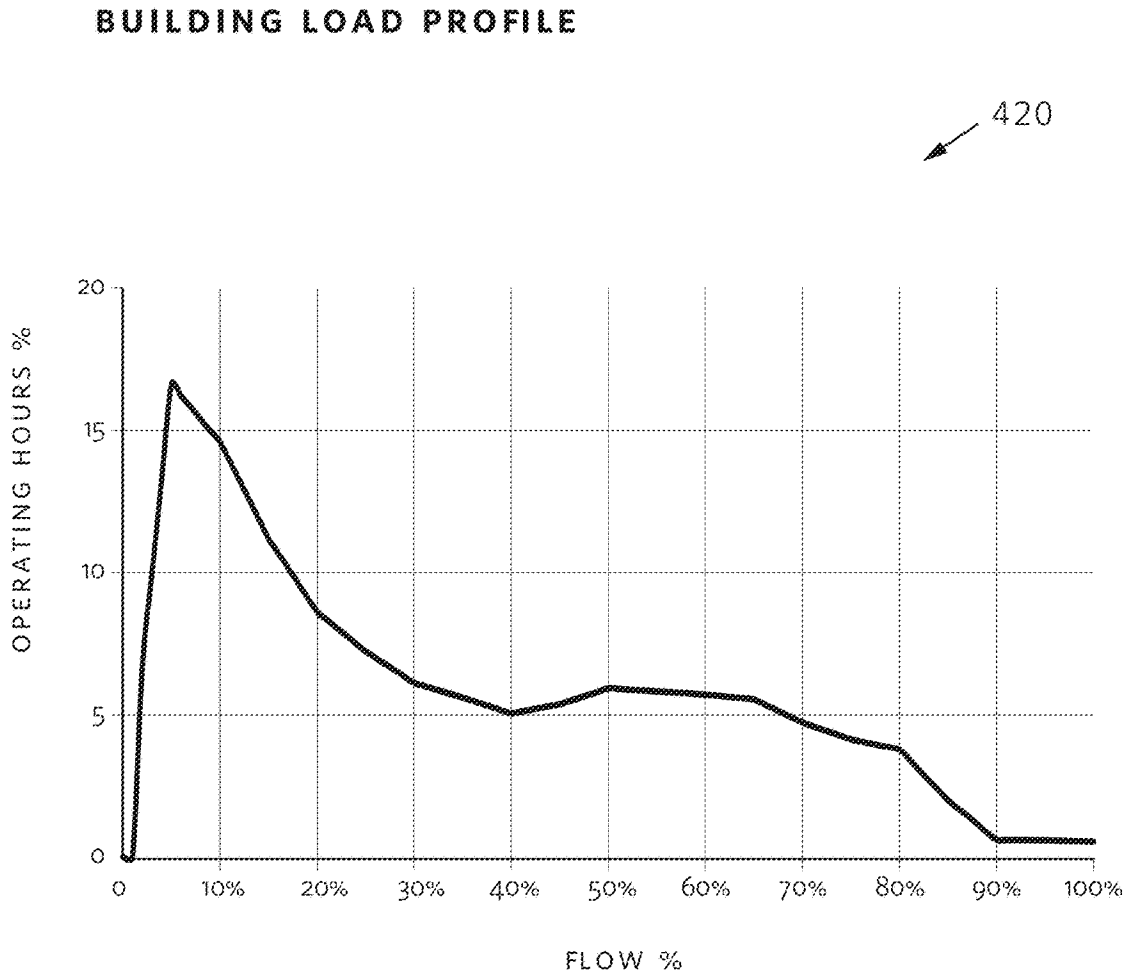
FIG. 4B illustrates a graph of an example flow load profile for a load such as a building.

Similarly, FIG. 4B a graph 420 of an example flow load profile for the load 110*a*, 110*b*, 110*c*, 110*d* of the building 104 (FIG. 1B), for a projected or measured "design day". The load 110*a*, 110*b*, 110*c*, 110*d* of the building 104 (FIG. 1B) defines pumping energy consumption. Example embodiment relate to optimizing the selection of the heat exchanger 118, the control pump 102, 122, and other devices of the building system 100, when the building 104 operates most of the time below 50% flow of duty capacity (100%).

The control pumps 102, 122 can be selected and controlled so that they are optimized for partial load rather than 100% load. For example, the control pumps 102, 122 can have the respective variably controllable motor be controlled along a "control curve" of head versus flow, so that operation has maximized energy efficiency during part load operation (e.g. 50%) of the particular system, such as in the case of the load profile graph 400 (FIG. 4A) or load profile graph 420 (FIG. 4B). Other example control curves may use different parameters or variables.

Figure 5:
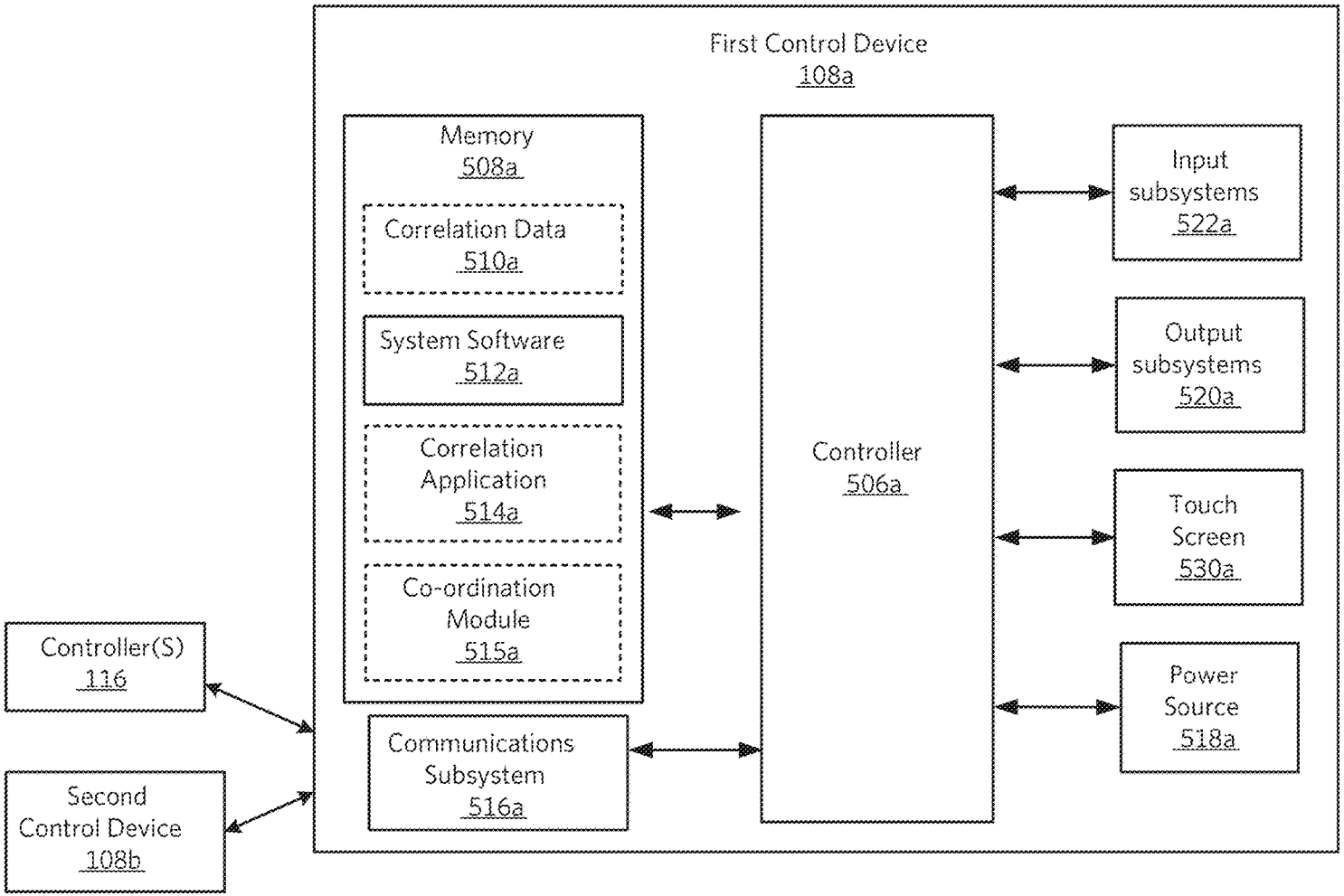
FIG. 5 illustrates an example detailed block diagram of a control device, in accordance with an example embodiment.

FIG. 5 illustrates an example detailed block diagram of the first control device 108*a*, for controlling the first control pump 102 (FIGS. 1A and 1B), in accordance with an example embodiment. The second control pump 122 having the second control device 108*b* can be configured in a similar manner as the first control pump 102, with similar elements. The first control device 108*a* can be embodied in the PC card 226. The first control device 108*a* may include one or more controllers 506*a* such as a processor or microprocessor, which controls the overall operation of the control pump 102. The control device 108*a* may communicate with other external controllers 116 or the HX card 222 of the heat exchangers or other control devices (one shown, referred to as second control device 108*b*) to coordinate the controlled aggregate output properties 114 of the control pumps 102, 122 (FIGS. 1A and 1B). The controller 506*a* interacts with other device components such as memory 508*a*, system software 512*a* stored in the memory 508*a* for executing applications, input subsystems 522*a*, output subsystems 520*a*, and a communications subsystem 516*a*. A power source 518*a* powers the control device 108*a*. The second control device 108*b* may have the same, more, or less, blocks or modules as the first control device 108*a*, as appropriate. The second control device 108*b* is associated with a second device such as second control pump 122 (FIGS. 1A and 1B).

The input subsystems 522*a* can receive input variables. Input variables can include, for example, sensor information or information from the device detector 304 (FIG. 3). Other example inputs may also be used. The output subsystems 520*a* can control output variables, for example for one or more operable elements of the control pump 102. For example, the output subsystems 520*a* may be configured to control at least the speed of the motor (and impeller) of the control pump 102 in order to achieve a resultant desired output setpoint for temperature (T), heat load (Q), head (H) and/or flow (F). Other example outputs variables, operable elements, and device properties may also be controlled. The touch screen 530*a* is a display screen that can be used to input commands based on direct depression onto the display screen by a user.

The communications subsystem 516*a* is configured to communicate with, directly or indirectly, the other controllers 116 and/or the second control device 108*b*. The communications subsystem 516*a* may further be configured for wireless communication. The communications subsystem

516*a* may further be configured for direct communication with other devices, which can be wired and/or wireless. An example short-range communication is Bluetooth® or direct Wi-Fi. The communications subsystem 516*a* may be configured to communicate over a network such as a wireless Local Area Network (WLAN), wireless (Wi-Fi) network, the public land mobile network (PLMN) (using a Subscriber Identity Module card), and/or the Internet. These communications can be used to coordinate the operation of the control pumps 102, 122 (FIGS. 1A and 1B).

The memory 508*a* may also store other data, such as the load profile graph 400 (FIG. 4) or load profile graph 420 (FIG. 4B) for the measured "design day" or average annual load. The memory 508*a* may also store other information pertinent to the system or building 104 (FIGS. 1A and 1B), such as height, flow capacity, and other design conditions. In some example embodiments, the memory 508*a* may also store performance information of some or all of the other devices 102, in order to determine the appropriate combined output to achieve the desired setpoint.

Figure 7A:
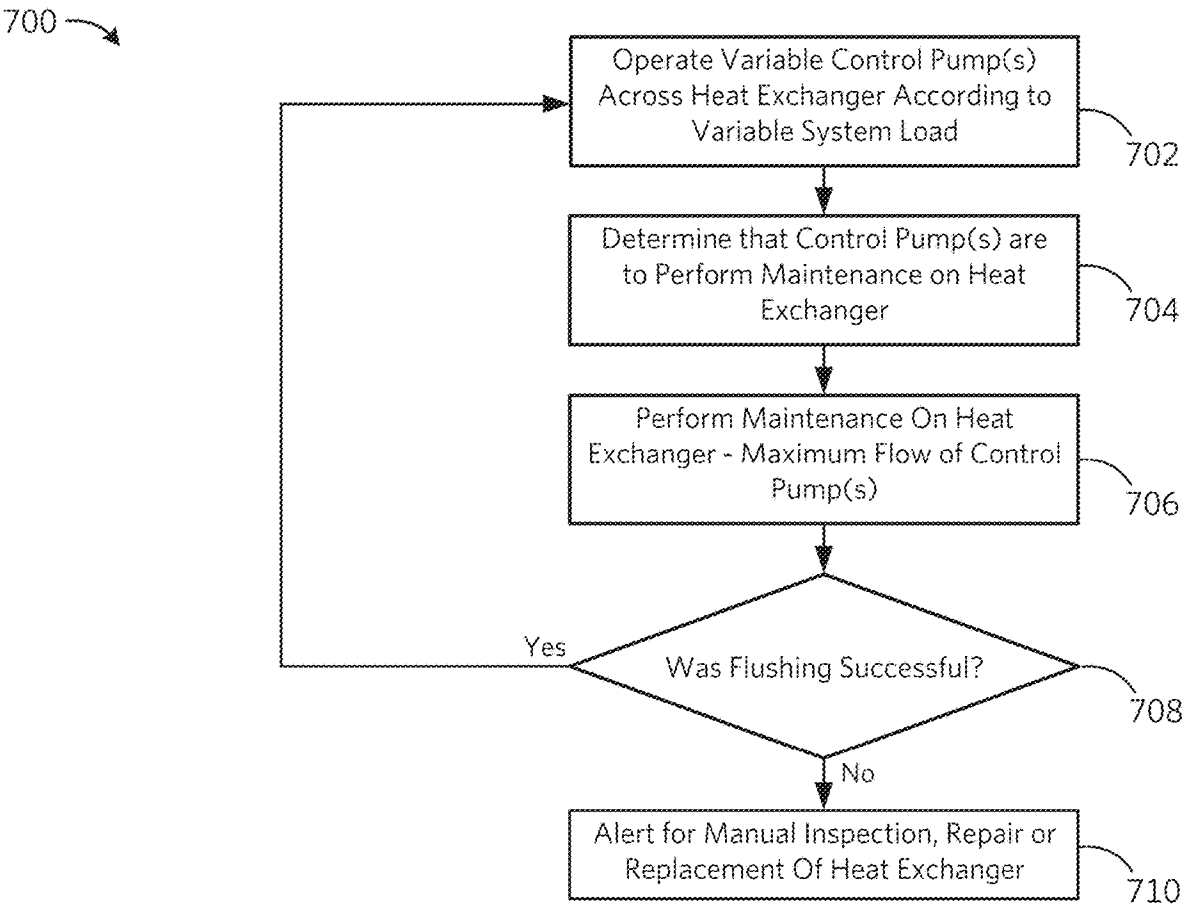
FIG. 7A illustrates a flow diagram of an example method for automatic maintenance on a heat exchanger, in accordance with an example embodiment.

FIG. 7A illustrates a flow diagram of an example method 700 for automatic maintenance on a heat exchanger 118, in accordance with an example embodiment. The method 700 is performed by the controllers 116 (which may include processing performed by the HX card 222 in an example). At step 702, the controllers 116 operate the control pumps 102, 122 across the heat exchanger 118 in accordance with the system load 110*a*, 110*b*, 110*c*, 110*d*. At step 704, the controllers 116 determines that maintenance (i.e. flushing) is required on the heat exchanger 118 based on real-time operation measurement when sourcing the system load 110*a*, 110*b*, 110*c*, 110*d*. At step 706, the controllers 116 performs automatic maintenance (flushing) on the heat exchanger 118 by controlling flow to a maximum flow. In various examples, maximum flow be can controlling of the control pumps 102, 122 to their respective maximum flow capacity, or a maximum flow that is supported by the load 110*a*, 110*b*, 110*c*, 110*d* (i.e., duty load), or a maximum flow capacity of the heat exchanger 118. The maximum flow is used to flush the fouling in the heat exchanger 118. In example embodiments, step 706 can be performed during real-time sourcing of the system load 110*a*, 110*b*, 110*c*, 110*d*. In some examples, each control pump 102, 122 can be controlled to perform their respective maximum flow at the same time. In other examples, each control pump 102, 122 is controlled to perform their maximum flow in a sequence at different times.

At step 708, the controllers 116 determine whether the flushing from step 706 was successful, and if so the method 700 returns to step 702. If not, the controllers 116 alert another device such as the BAS 302 or the smart device 304 that manual inspection, repair or replacement of the heat exchanger 118 is required.

Figure 7B:
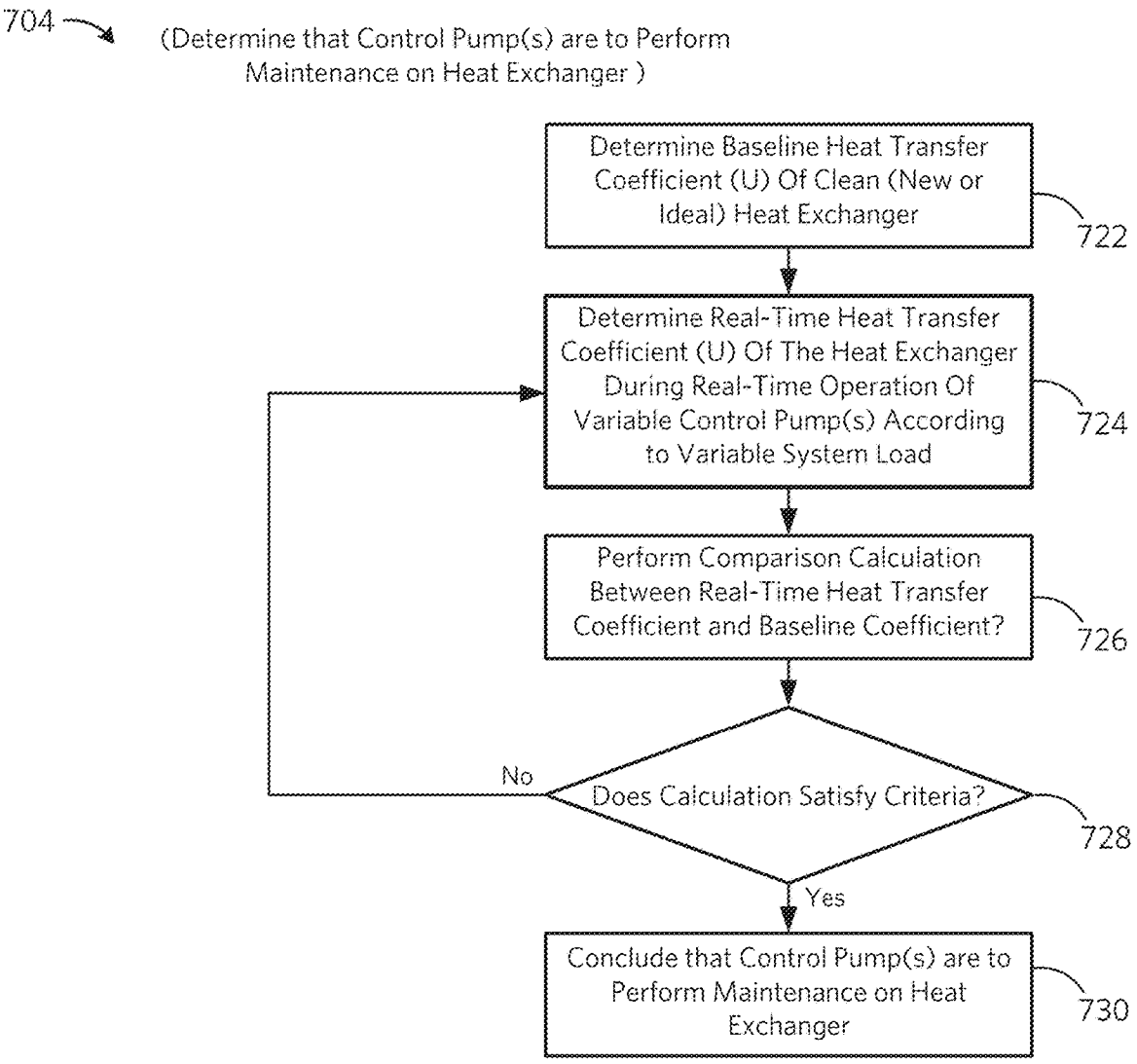
FIG. 7B illustrates a flow diagram of an example method for determining that one or more control pumps are to perform maintenance on the heat exchanger.

Step 704 will now be described in greater detail. Different alternative example embodiments of step 704 are outlined in FIGS. 7B, 7C and 7D. In FIG. 7B, the controllers 116 compare real-time operation measurement of the heat exchanger 118 with the new clean heat exchanger 118 as a baseline. At step 722, the controllers 116 determine a baseline heat transfer coefficient (U) of the new clean heat exchanger 118. Step 722 can be done using a testing rig, or can be performed using run-time setup and commissioning when installed in the building system 100, or both. At step 724, the controllers 116 determine, during real-time operation of the control pumps 102, 122 in order to source the system load 110*a*, 110*b*, 110*c*, 110*d*, the real-time heat transfer coefficient (U) of the heat exchanger 118. At step 726, the controllers 116 performs a comparison calculation between the real-time heat transfer coefficient (U) of the heat exchanger 118 and the baseline. In an example, the comparison calculation is a Fouling Factor calculation. At step 728, the controllers 116 determine whether the calculation satisfies criteria, and if so then at step 730 the controllers 116 concludes that the control pumps 102, 122 are to perform automatic maintenance on the heat exchanger 118. If not, the controllers 116 loops operation back to step 724, which is determining of the real-time heat transfer coefficient (U) of the heat exchanger 118.

Figure 7C:
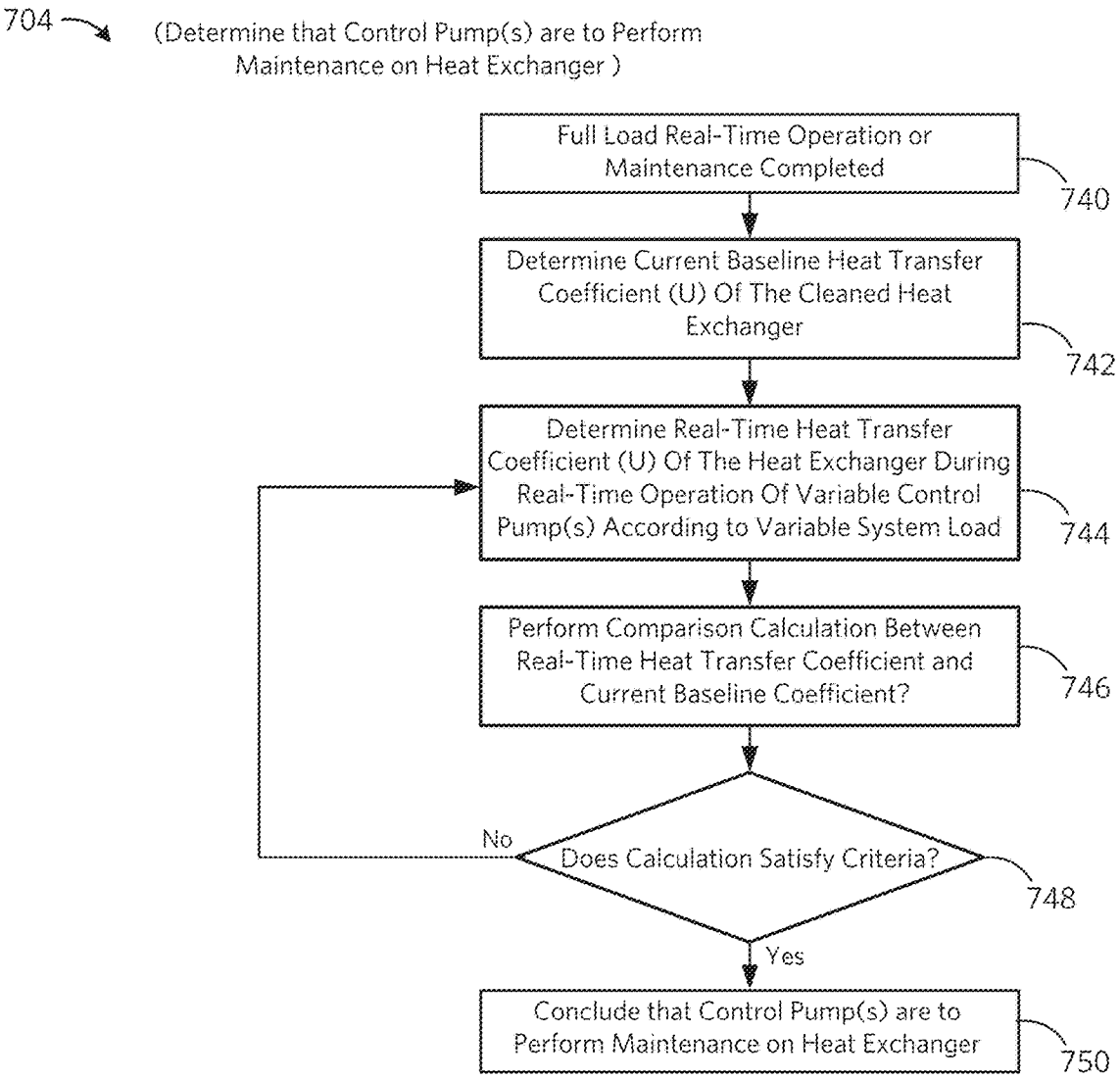
FIG. 7C illustrates a flow diagram of an alternate example method for determining that one or more control pumps are to perform maintenance on the heat exchanger.

FIG. 7C illustrates a flow diagram of an alternate example of step 704, for determining that the control pumps 102, 122 are to perform maintenance on the heat exchanger 118. In this example, the controllers 116 compares real-time operation measurement of the heat exchanger 118 with the just-cleaned heat exchanger 118 as a baseline. At step 740, maintenance (flushing) has been completed on the heat exchanger 118. In other examples, at step 740 the system has completed operating at full load (full flow) for a specified period of time, which has a similar effect. At step 742, the controllers 116 determine a baseline heat transfer coefficient (U) of the just-cleaned heat exchanger 118. Step 742 can be done while still sourcing the load 110*a*, 110*b*, 110*c*, 110*d* of the building system 100. At step 744, the controllers 116 determine, during real-time operation of the control pumps 102, 122 to source the system load 110*a*, 110*b*, 110*c*, 110*d*, the real-time heat transfer coefficient (U) of the heat exchanger 118. At step 746, the controllers 116 perform a comparison calculation between the real-time heat transfer coefficient (U) of the heat exchanger 118 and the baseline. At step 748, the controllers 116 determine whether the calculation satisfies criteria, and if so then at step 750 the controllers 116 conclude that the control pumps 102, 122 are to perform automatic maintenance on the heat exchanger 118. If not, the controllers 116 loop operation back to step 744, which is determining of the real-time heat transfer coefficient (U) of the heat exchanger 118.

Figure 7D:
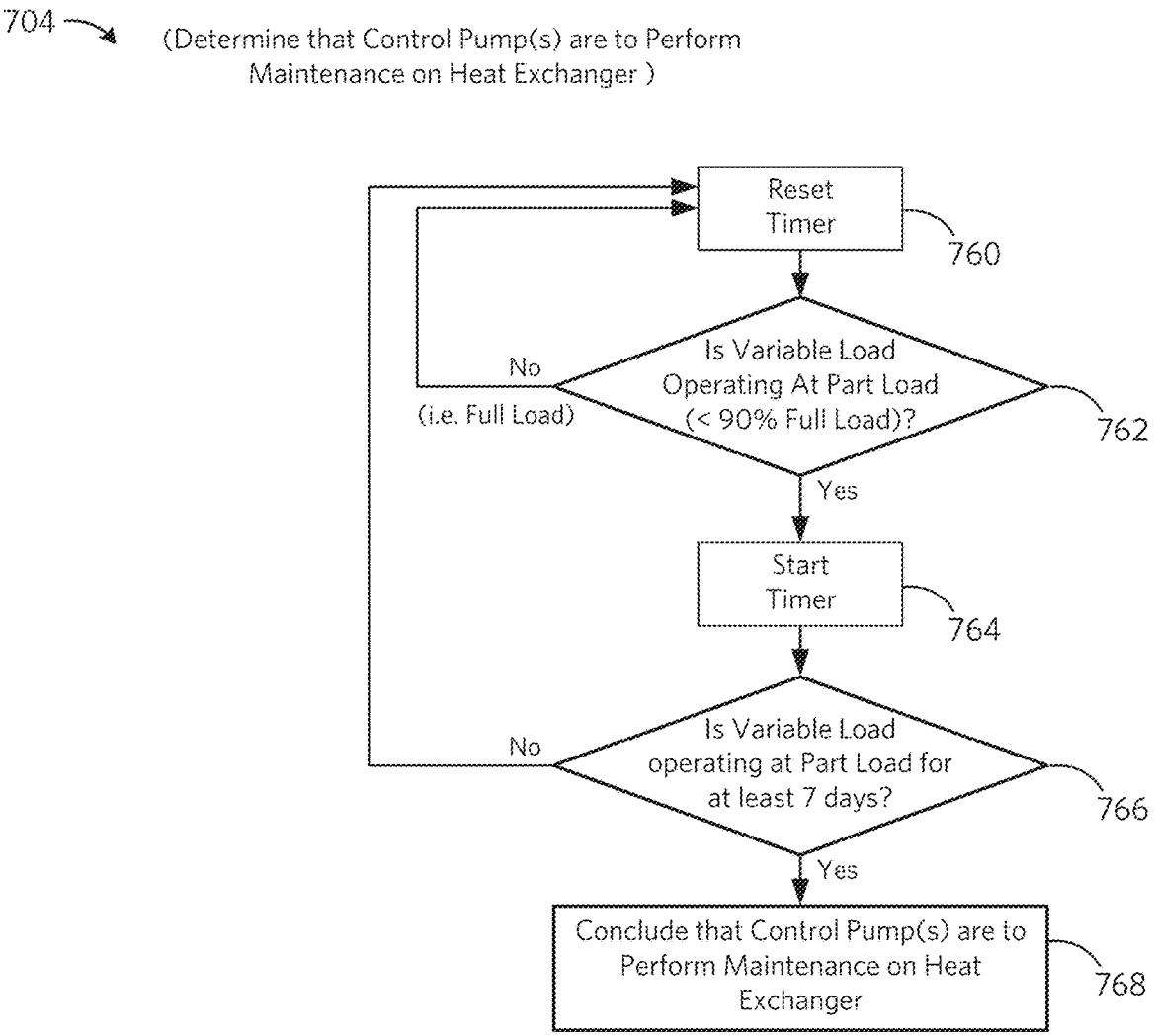
FIG. 7D illustrates a flow diagram of another alternate example method for determining that one or more control pumps are to perform maintenance on the heat exchanger.

FIG. 7D illustrates a flow diagram of another alternate example of step 704, for determining that the control pumps 102, 122 are to perform maintenance on the heat exchanger 118. In this example, the controllers 116 determine that the heat exchanger 118 has been operating continuously at part load for a specified period of time, and therefore requires flushing. At step 760, the controllers 116 reset a timer. At step 762, the controllers 116 determine whether the heat exchanger 118 has been operating continuously at part load, which can be any part load or can be a specified maximum such as at most 90% full load. If so, at event 764 the timer 764 is started. If not, the controllers 116 loop back to step 760. At step 766, the controllers 116 determines whether the part load has occurred continuously for a specified period of time, for example at least 7 days. If so, at step 768 the controllers 116 concludes that the control pumps 102, 122 are to perform automatic maintenance on the heat exchanger 118. If not, this means that the load 110*a*, 110*b*, 110*c*, 110*d* is operating at full load (full flow) anyway and therefore the controllers 116 loops back to step 760 and the timer is reset again.

In another alternative example embodiment of step 704, the controllers 116 are configured to determine that the heat exchanger requires maintenance due to fouling of the heat exchanger by: predicting, from previous measurement of the flow, pressure and/or temperatures sensors during the real-time operation measurement when sourcing the variable load, an actual present heat transfer coefficient (U) of the heat exchanger; and calculating a comparison between the predicted actual coefficient value of the heat exchanger and the clean coefficient value of the heat exchanger. The predicting can be performed based on: previous actual measurement results; first principals from physical properties of the devices; testing data from a testing rig, sensor data from previous actual operation, or other previous stored data from the actual device or devices having the same or different physical properties; and/or machine learning. Example parameters of the heat exchanger that can be predicted include: flow capacity, fouling factor (FF) and heat transfer coefficient (U). The prediction can be based using a polynomial fit over time to extrapolate future performance and parameters of the heat exchanger from past readings and calculations.

Referring again to FIG. 7A, step 706 (performing automatic maintenance on the heat exchanger 118) will now be described in greater detail. Step 706 is typically performed during real-time sourcing of the load 110*a*, 110*b*, 110*c*, 110*d*. Step 706 can be performed without disassembling or providing bypass loops to the heat exchanger 118. In one example, both pumps 102, 122 operate at full duty flow (or full permissible load) simultaneously for 30 minutes. In another example, both pumps 102, 122 operate at full duty flow (or full permissible load) in sequence, one at a time (e.g., 30 minutes each). In other example embodiments, rather than full flow, the pumps 102, 122 can be controlled to be at a sequence of specified flows, such as alternating between 90% flow and full flow, to assist in dislodging the fouling. In other example embodiments, the pumps 102, 122 can be controlled to provide backflow to the heat exchanger 118, e.g. when the load 110*a*, 110*b*, 110*c*, 110*d* is a 2-way load. The backflow may be performed on its own or as part of the sequence of specified flows.

In another example, the maintenance to the heat exchanger 118 is only applied to one fluid path. For example, when there is sourcing from the cooling towers 124 (FIG. 1A) or hot, dirty geothermal water (FIG. 1J), the automatic maintenance may be performed by only one pump 122 on the source side to flush the source fluid path only, which can contain an abundance of fouling.

In another example, step 706 can be delayed until a suitable off-hours time, such as the weekend or after business hours, where variable changes in flow for the maintenance will be less noticeable and the instantaneous load 110*a*, 110*b*, 110*c*, 110*d* is more predictable.

Referring again to FIG. 7A, step 708 (determining whether flushing was successful) will now be described in greater detail. Step 708 can be the same calculation as step 724 or step 744. Step 708 can be calculating or determining, during real-time operation of the control pumps 102, 122 to source the system load 110*a*, 110*b*, 110*c*, 110*d*, the real-time heat transfer coefficient (U) of the heat exchanger 118 as the new baseline coefficient (U). Therefore, immediately after the flushing was performed at step 706, the controllers 116 calculates the present heat transfer coefficient (U) of the heat exchanger 118 and compares with the baseline coefficient (U). If a calculation between the present heat transfer coefficient (U) and the baseline coefficient (U) (e.g., fouling factor, percentage difference, ratio, etc.) exceeds a threshold difference, then flushing was not successful and the alert is sent at step 710. In some examples, not shown, re-flushing (as in step 706) may be performed again for one or two more times when the flushing was found not to be successful. If the calculation is within a threshold difference, then flushing was successful and at step 702 the heat exchanger 118 and pumps 102, 122 operate as normal to source the load 110*a*, 110*b*, 110*c*, 110*d*. Based on the calculation, controllers 116 can output a notification to a display screen or another device in relation to the flushing of the fouling of the heat exchanger being successful or unsuccessful.

The method 700 of FIG. 7A can be applied to: a heat exchanger module having a single heat exchanger 118; the heat exchanger module 220 having two heat exchangers 118*a*, 118*b* (FIG. 2B); and the heat exchanger module 230 having three heat exchangers 118*a*, 118*b*, 118*c* (FIG. 2C), or a heat exchanger module having more than three heat exchangers 118. The method 700 can use the heat transfer coefficient (U) of the entire heat exchanger module 220, 230, rather than individual heat exchangers 118, in some examples. The method 700 can use the heat transfer coefficient (U) of the individual heat exchangers 118*a*, 118*b*, 118*c* in other examples. By monitoring individual heat exchangers 118*a*, 118*b*, 118*c*, the controllers 116 can determine that only one of the individual heat exchangers 118*a*, 118*b*, 118*c* in the heat exchanger module 230 requires automatic maintenance (flushing). It can also be determined by the controllers 116 whether only one individual heat exchanger 118*a*, 118*b*, 118*c* in the heat exchanger module 230 requires manual repair, replacement, maintenance, chemical flushing, etc.

For example, when performing step 706 (performing automatic maintenance on the heat exchanger 118), the flushing can be performed on individual heat exchangers 118*a*, 118*b*, 118*c*, for example by the controllers 116 (or HX card 222) opening or closing the applicable valves 224. In one example, less than all of the individual heat exchangers 118*a*, 118*b*, 118*c* may have fouling and only that heat exchanger 118*a*, 118*b*, 118*c* requires flushing. In other example, when the entire heat exchanger module 230 requires flushing, each individual heat exchanger 118*a*, 118*b*, 118*c* may be flushed one at a time (or less than all at a time). By having less than all of the individual heat exchangers 118*a*, 118*b*, 118*c* being open, this partial operation of the heat exchanger module 230 can offset the increased flow of the pumps 102, 122 to full flow when sourcing the variable load in real-time (which is often at partial load and doesn't require full flow).

Figure 8:
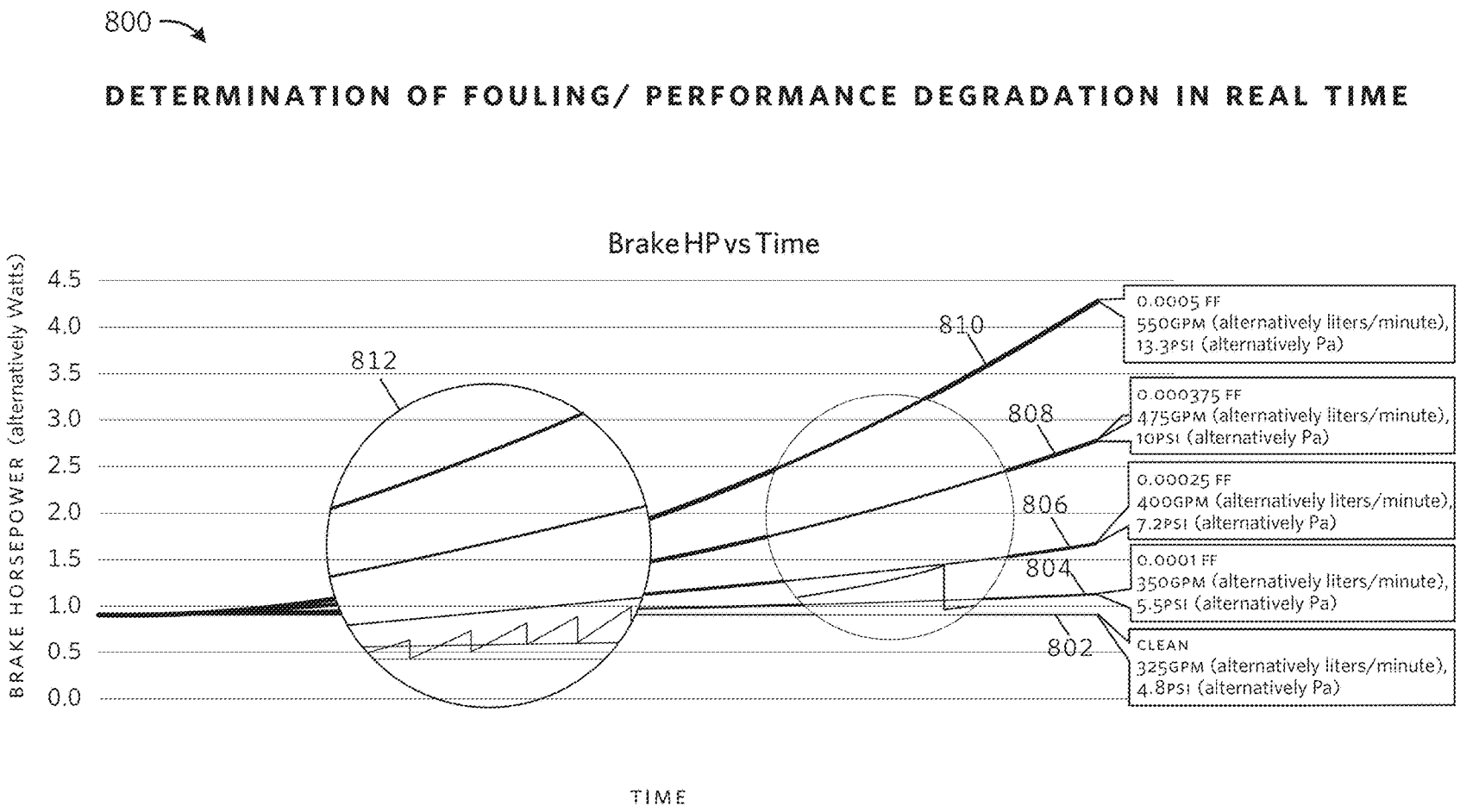
FIG. 8 illustrates a graph of simulation results of brake horsepower versus time of a control pump operating through various heat exchangers having various foul factors, including one heat exchanger having automatic maintenance in accordance with an example embodiment.

FIG. 8 illustrates a graph 800 of simulation results of brake horsepower versus time of a control pump 102, 122 operating through various heat exchangers having various foul factors. The y-axis is brake horsepower in horsepower (alternatively Watts). The x-axis is time. Plot line 802 is the clean, ideal brake horsepower, and remains horizontal over time as shown in the graph 800. Plot line 804 is the brake horsepower of the heat exchanger 118 having automatic maintenance in accordance with example embodiments. Plot line 804 illustrates that the Fouling Factor (FF) after the period of time is 0.0001. Additional plot lines are shown for the scenario when there is no automatic maintenance. Plot lines 806, 808, 810 illustrate higher Fouling Factors of the heat exchanger and higher brake horsepower of the control pump 102, 122 that result when operating at higher required pressures (in PSI, alternatively in Pa) and flow (in Gallons Per Minute (GPM), alternatively liters/minute), when there is no automatic maintenance. Circle 812 is a detail view of the graph 800, which illustrates in plot line 804 that vertexes 814 occur when there is automatic flushing, and therefore the required brake horsepower is reduced after each flushing.

In an example, the plot lines on the graph 800 are plotted based on actual measurement results from one or more of the sensors. In some examples, using any or all of: the actual measurement results; first principals from physical properties of the devices; testing data from a testing rig, sensor data from actual operation, or other previous stored data from the actual heat exchanger or heat exchangers having the same physical properties or different physical properties; and/or machine learning, the plot lines can be predicted by the controllers 116 for determining the future parameters over time (or at a specific future time) of the heat exchanger. The parameters can include, e.g. flow capacity, fouling factor (FF) and heat transfer coefficient (U). In an example, the plot lines can be determined and represented using a function such as a polynomial equation, e.g. quadratic or a higher order polynomial.

For example, the controllers 116 can be configured to calculate and predict the parameters of the heat exchanger, such as present flow capacity, fouling factor (FF) and heat transfer coefficient (U). Given the rate or amount of fouling, the controllers 116 can be configured to calculate and predict the future parameters of the heat exchanger. The controllers 116 can be configured to calculate and predict the parameters of the heat exchanger to further account for accumulated fouling, instances of flushing (manual, or automated as described herein), instances of chemical washing, etc. For example, plot line 804 illustrates that there is still a small amount fouling that occurs, even with the automated flushing. Historical information and historical performance response of the heat exchanger, or other heat exchangers, can be used for the predicting. In some examples, the controllers 116 can compare actual sensor information and calculations of the heat exchanger with the predicted parameters to provide data training sets for future predictions by the controllers 116.

Figure 9:
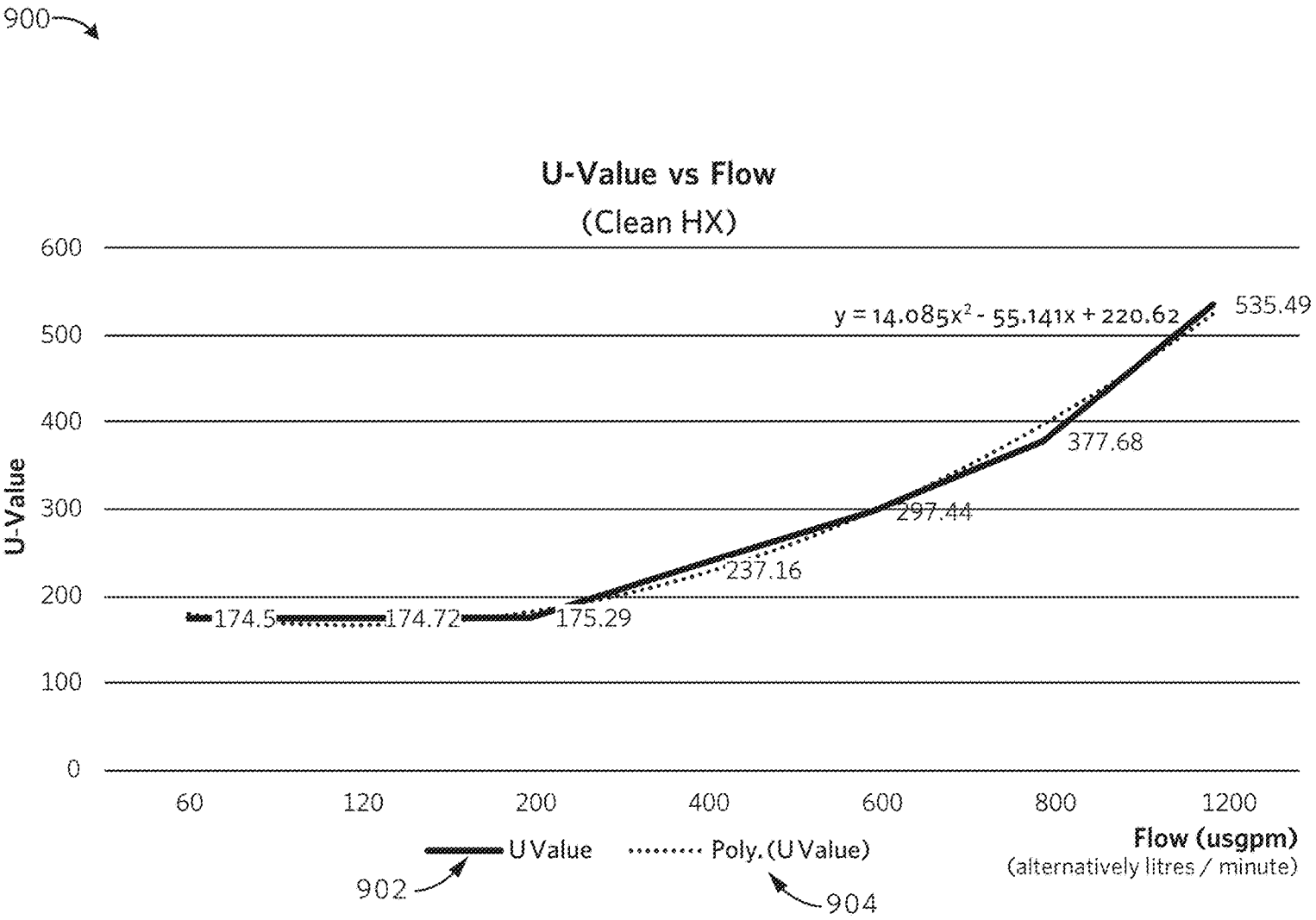
FIG. 9 illustrates a graph of testing results of heat exchanger coefficient value (U-Value) versus flow of a clean heat exchanger.

FIG. 9 illustrates a graph 900 of testing results of heat transfer coefficient (U-Value) versus flow of a clean heat exchanger 118. The testing was performed prior to shipping and/or prior to installation of the heat exchanger 118. The solid line 902 represents the measured U-Values. The dotted line 904 represents a polynomial fit of the measured U-Values. The coefficients of the solid line 902 can be stored in memory in an example, and can be compared directly with real-time measurements (at the same or interpolated flows). The polynomial fit for the dotted line 904 is a quadratic in this example, and can be also be higher order polynomials, depending on the amount of fit required.

To determine the measured U-Values for the solid line 902, performance mapping is performed at duty conditions and one alternate condition with different temperatures, using a testing rig. The source flow (Fsource) and load flow (Fload) are varied proportionally to operate at 100%, 90%, 80%, 70%, 60%, 50%, 40%, and 30% of full duty flow, in order to determine the U-values.

Performance is mapped for each heat exchanger 118 and the data is stored on the HX card 222 and the cloud 308, and the stored data linked to the unique serial number of the heat exchanger 118*a*, 118*b*, 118*c*. At the time when the heat exchanger 118*a*, 118*b*, 118*c* is installed or assembled onto the heat transfer module 230, the performance map for each heat exchanger 118*a*, 118*b*, 118*c* is uploaded to the cloud server and stored onto the HX card 222. In an example, this testing to be completed on a testing rig at the factory, prior to shipping and/or installation of the heat transfer module 230. In other examples, the testing rig is performed at a third party testing facility, prior to shipping and/or installation of the heat transfer module 230. Required capacities for the testing rig can to be up to 600 gpm (or in liters/min) and up to 15,000,000 btu/hr (or in kW) at a 20F (or equivalent in differential Celsius) liquid temperature difference.

The clean U-values can then be compared with the real-time calculated U-values determined during real-time sourcing of loads 110*a*, 110*b*, 110*c*, 110*d* using the heat exchanger 118 and the control pumps 102, 122, at the various flow rates. The polynomial fit, first principals based on physical properties of the heat exchanger, and/or predictive future performance can be used for determining expected U-values of the heat exchanger during real-time operation and sourcing of the variable load. Interpolation can also be performed between specifically tested flow values.

The heat transfer coefficient U of the clean heat exchanger 118 can be calculated as follows:

$$Uclean = Qavg / (A \times LMTD)$$

Where Qavg is the average of the measured heat transfer across the load fluid path and the source fluid path, as follows:

$$Qavg = (Qload + Qsource) / 2$$

Qload can be calculated from measurements of flow sensors and temperature sensors, as follows (similar calculation for Qsource):

$$Qload = C \times m \times \text{abs}(Tin - Tout)$$

=Cload×ρload×Fload,measured×abs(Tload,out,measured−Tload,in, measured), where:

C, is the is the specific heat capacity as a function of pressure and temperature, m is the mass flow rate, Fload is Flow of the load, ρload is the fluid density at the average of Tload, out, measured−Tload, in, measured, Cload is the specific heat capacity of the load side fluid at the average of Tload, out, measured−Tload, in, measured.

In some examples, the heat transfer coefficient Uclean can be determined using a testing rig that simulates the flow and temperature conditions. In some examples, the heat transfer coefficient Uclean can also be determined and calculated using real-time operation when the heat exchanger 118 is initially installed to service the system load 110*a*, 110*b*, 110*c*, 110*d*.

The operating point(s) at duty conditions can be tested and then stored to the HX card 222. Such operating points include Fsource, design, Tsource, in, design, Tsource, out, design, Fload, design, Tload, out, design and Tload, in, design, Qload, design, FluidTypesource, FluidTypeload, Psource, design, and Pload, design. There is a provision to store multiple sets of duty conditions on the HX card 222 and can be editable.

Referring still to FIG. 9, rather than by testing, in other examples the graph 900 can be determined by first principle calculations, e.g. based on known dimensions of the heat exchanger 118 (and the brazed plates 202) and the fluid properties of the circulation mediums.

Referring to step 724 (FIG. 7B) and step 744 (FIG. 7C), calculating the heat transfer coefficient (U) of the heat exchanger 118 when sourcing the system load 110*a*, 110*b*, 110*c*, 110*d* in real-time will now be described in greater detail. A similar process can be performed when determining the clean heat transfer coefficient (U) of the heat exchanger 118.

The amount of fouling in the heat exchanger 118 can be output to a screen or transmitted to another device for showing heat transfer performance. The performance can be indicated by color coding, where Green is indicative of a clean exchanger, Yellow is indicative of some fouling, and Red as maintenance and cleaning required. In an example, the processing of this heat exchanger fouling is completed by the HX card 222 and sent to the Cloud 308, for output to the screen of the smart device 304, or sent to the BAS 302. Units of displayed data can be available in both imperial (F, ft, gpm, BTU/h) and metric units (C, m, l/s, kW).

The heat exchanged can be calculated for fluids that comprise of water and ethylene/propylene glycol mixtures up to 60%. Thermodynamic data for these fluids are available on the HX card 222, with 5% minimum increments for glycol mixtures.

The heat transfer calculations are follows.

$$Q = m \times C \times (Tin - Tout),$$

where,

Q, is the heat transferred,

C, is the is the specific heat capacity as a function of pressure and temperature, m, is the mass flow rate, Tin is the inlet temperature of the fluid stream, Tout is the outlet temperature of the fluid stream.

For a heat exchanger:

$$QHX = U \times A \times (LMTD),$$

Where,

QHX, is the heat transferred through the heat exchanger,

U is the overall heat transfer coefficient for the specific heat exchanger,

A, is the heat transfer surface area (generally constant).

LMTD (counter flow configuration) is the log-mean temperature difference defined by (sometimes source side is referred to as hot side and load side is referred to as cold side):

$$LMTD = [(Tsource, \text{in} - Tload, \text{out}) - (Tsource, \text{out} - Tload, \text{in})] / \ln[(Tsource, \text{in} - Tload, \text{out}) / (Tsource, \text{out} - Tload, \text{in})],$$

Where,

Tsource, in is the inlet (to heat exchanger) fluid temperature on source side,

Tsource, out is the outlet (from heat exchanger) fluid temperature on source side, Tload, in is the inlet (to heat exchanger) fluid temperature on load side, Tload, out is the outlet (from heat exchanger) fluid temperature on load side.

Uclean is the overall heat transfer coefficient with a clean, ideal heat exchanger, Udirt is the overall heat transfer coefficient at a specific time during operation. The U-values (under clean conditions) can be adjusted during factory testing and mapped into the HX card 222. The Uclean (Fsource, Fload, Tsource, in, Tsource, out, Tload, in, Tload, out) is a function specific to selection and geometry for each heat exchanger, as a mathematical formula, and can be verified during factory testing and mapped on to the HX card 222.

In order to determine the current U value, Udirt:

$$Udirt = Qavg / (A \times LMTD)$$

Where Qavg is the average of the measured heat transfer across the load fluid path and the source fluid path, as follows:

$$Qavg = (Qload + Qsource) / 2$$

Calculations for Qload and Qsource have been provided in equations herein above.

If Udirt is smaller than Uclean by more than 20% (or other suitable threshold), then a warning is output by the HX card 222, for example to the BAS 302, the cloud 308 and the smart device 304.

In some examples, Uclean and Udirt should be only compared for a certain range of flows from 100% to 50% of duty point.

One example comparison calculating for the heat transfer coefficient is a fouling factor (FF):

$$FF = 1 / Udirt - 1 / Uclean.$$

A lower FF is desired. In an example, when the FF is at least 0.00025, then it is concluded that maintenance (flushing) should be performed on the heat exchanger 118. A FF of 0.0001 can be deemed to be acceptable, and no maintenance is required. A baseline FF can also be calculated for the clean heat exchanger 118.

Referring to step 724 (FIG. 7B) and step 744 (FIG. 7C), as an alternative to calculating the heat transfer coefficient (U), it can be appreciated that other parameters or coefficients can be calculated by the controllers 116 to determine whether maintenance is required on the heat exchanger 118 due to fouling, and that flushing maintenance is required.

In an example, heat load (Q) can be used to determine that maintenance is required. Flow measurement can be received from a first flow sensor of the source fluid path, and a second flow sensor of the load fluid path. The flow measurement information from the flow sensors is used for said determining that the heat exchanger 118 requires maintenance due to fouling of the heat exchanger 118. A heat load (Q) can be calculated for each fluid path based on the respective flow and the temperatures. First, a clean heat load (Q) for each of the source fluid path and the load fluid path of the heat exchanger 118 when in a clean state can be determined for a baseline. During real-time sourcing of the load 110*a*, 110*b*, 110*c*, 110*d*, real-time flow and temperature measurement can be determined from each of the source fluid path and the load fluid path of the heat exchanger 118. A real-time heat load (Q) can be calculated from the real-time measurements. Calculating a comparison between the baseline and the actual heat load (Q) can be used to determine that maintenance is required, when the comparison calculation exceeds a threshold difference.

If Qsource varies more than Qload by more than 10%, for example, then a warning is given to the user. In other words, if:

$$\mathrm{Abs}(Qsource - Qload) / \max(Qsource - Qload) > 0.10$$

The variation can be taken from the running average of 100 consecutive readings. Any spikes can be filtered to avoid erratic controls. A difference of more than 3 standard deviations can be excluded.

In an example, pressure measurement can be used to determine that maintenance is required. A first differential pressure sensor is used to detect differential pressure across the source fluid path. A second differential pressure sensor is used to detect differential pressure across the load fluid path. A clean pressure differential value across each of the fluid paths of the heat exchanger 118 is determined when the heat exchanger 118 is in a clean state, as a baseline. When sourcing the load 110*a*, 110*b*, 110*c*, 110*d*, real-time measurement of the pressure differential is determined by the controllers 116 and a comparison is calculated between the real-time measurement and the baseline. If the comparison calculation exceeds a threshold difference, then maintenance is required.

For example, if the differential pressure is 20% higher than that of the pressure drop curve across the clean heat exchanger, then a warning is given to indicate some fouling (Yellow). If the differential pressure is 30% higher than that of the pressure drop curve across the clean heat exchanger, then a warning is given to indicate fouling (Red).

In an example, temperature measurement can be used to determine that maintenance of the heat exchanger 118 is required. A clean temperature differential value across each of the source fluid path and the second fluid path of the heat exchanger 118 when in a clean state is determined as a baseline. The controllers 116 can determined real-time temperature measurements, and calculate a comparison between the actual temperature differential value of the heat exchanger 118 and the baseline temperature differential value of the heat exchanger 118. If the comparison calculation exceeds a threshold difference, then maintenance is required.

When there is more than one heat exchanger 118*a*, 118*b*, 118*c* within the heat transfer module 230, the temperature sensors on each heat exchanger 118*a*, 118*b*, 118*c* is used to monitor individual heat exchanger fouling. The temperature of the inlet and outlet fluid streams are measured for every heat exchanger. If the fluid stream temperature difference on a specific heat exchanger differs by more than 1F (or equivalent in Celsius) than the average of fluid steam temperature difference for all heat exchangers, then a warning given to indicate that the specific heat exchanger 118*a*, 118*b*, 118*c* is fouled and needs to be checked or have automatic flushing performed thereon. In an example, this scenario must be present for more than 1000 consecutive readings before a warning is sent.

Figure 6:
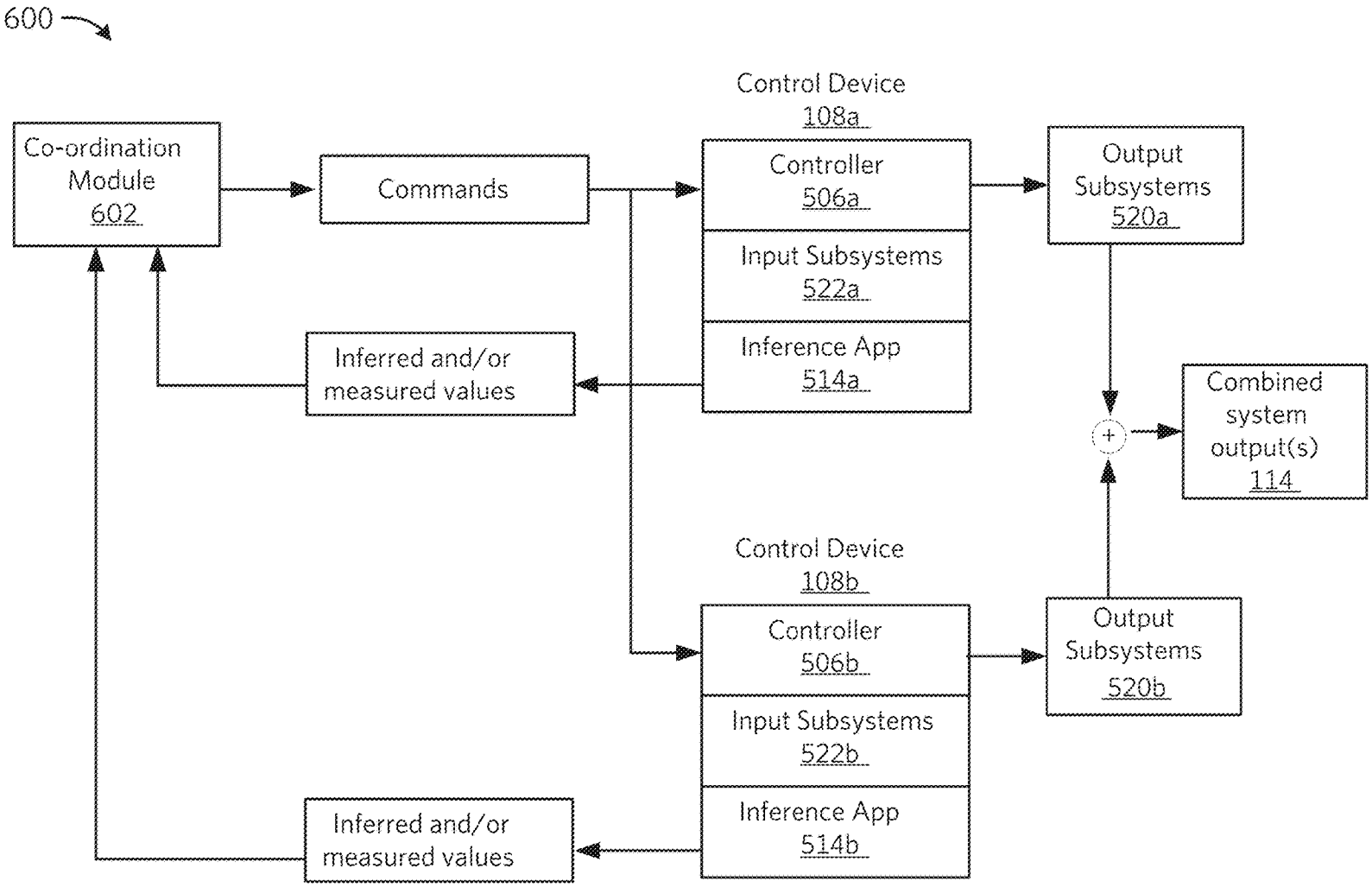
FIG. 6 illustrates a control system for co-ordinating control of devices, in accordance with an example embodiment.

Reference is now made to FIG. 6, which illustrates an example embodiment of a control system 600 for co-ordinating two or more control devices (two shown), illustrated as first control device 108*a* of the control pump 102 and second control device 108*b* of the control pump 122. Similar reference numbers are used for convenience of reference. As shown, each control device 108*a*, 108*b* may each respectively include the controller 506*a*, 506*b*, the input subsystem 522*a*, 522*b*, and the output subsystem 520*a*, 520*b* for example to control at least one or more operable device members (not shown here) such as a variable motor of the control pumps 102, 122.

A co-ordination module 602 is shown, which may either be part of at least one of the control devices 108*a*, 108*b*, or a separate external device such as the controllers 116 (FIG. 1B). Similarly, the inference application 514*a*, 514*b* may either be part of at least one of the control devices 108*a*, 108*b*, or part of a separate device such as the controllers 116 (FIG. 1B). In an example, the co-ordination module 602 is in the HX card 222.

In operation, the coordination module 602 coordinates the control devices 108*a*, 108*b* to produce a coordinated output (s). In the example embodiment shown, the control devices 108*a*, 108*b* work together to satisfy a certain demand or shared load (e.g., one or more output properties 114), and which infer the value of one or more of each device output(s) properties by indirectly inferring them from other measured input variables and/or device properties. This co-ordination is achieved by using the inference application 514*a*, 514*b* which receives the measured inputs, to calculate or infer the corresponding individual output properties at each device 102, 122 (e.g. temperature, heat load, head and/or flow at each device). From those individual output properties, the individual contribution from each device 102, 122 to the load (individually to output properties 114) can be calculated based on the system/building setup. From those individual contributions, the co-ordination module 602 estimates one or more properties of the aggregate or combined output properties 114 at the system load of all the control devices 108*a*, 108*b*. The co-ordination module 602 compares with a setpoint of the combined output properties (typically a temperature variable or a pressure variable), and then determines how the operable elements of each control device 108*a*, 108*b* should be controlled and at what intensity.

It would be appreciated that the aggregate or combined output properties 114 may be calculated as a non-linear combination of the individual output properties, depending on the particular output property being calculated, and to account for losses in the system, as appropriate.

In some example embodiments, when the co-ordination module 602 is part of the first control device 108*a*, this may be considered a master-slave configuration, wherein the first control device 108*a* is the master device and the second control device 108*b* is the slave device. In another example embodiment, the co-ordination module 602 is embedded in more of the control devices 108*a*, 108*b* than actually required, for fail safe redundancy.

Referring still to FIG. 6, in another example embodiment, each control pump 102, 122 may be controlled so as to best optimize the efficiency of the respective control pumps 102, 122 at partial load, for example to maintain their respective control curves or arrive at a best efficiency point on their respective control curve, in another example embodiment, each control pump 102, 122 may be controlled so as to best optimize the efficiency of the entire building system 100 and design day load profile 400 (FIG. 4A) or load profile 420 (FIG. 4B).

Referring again to FIG. 1A, the pump device 106*a* may take on various forms of pumps which have variable speed control. In some example embodiments, the pump device 106*a* includes at least a sealed casing which houses the pump device 106*a*, which at least defines an input element for receiving a circulation medium and an output element for outputting the circulation medium. The pump device 106*a* includes one or more operable elements, including a variable motor which can be variably controlled from the control device 108*a* to rotate at variable speeds. The pump device 106*a* also includes an impeller which is operably coupled to the motor and spins based on the speed of the motor, to circulate the circulation medium. The pump device 106*a* may further include additional suitable operable elements or features, depending on the type of pump device 106*a*. Some device properties of the pump device 106*a*, such as the motor speed and power, may be self-detected by an internal sensor of the control device 108*a*.

Referring again to FIG. 1A, the control device 108*a*, 108*b* for each control pump 102, 122 may include an internal detector or sensor, typically referred to in the art as a "sensorless" control pump because an external sensor is not required. The internal detector may be configured to self-detect, for example, device properties such as the power and speed of the pump device 106*a*. Other input variables may be detected. The pump speed of the pump device 106*a*, 106*b* may be varied to achieve a pressure and flow setpoint, or a temperature and heat load setpoint, of the pump device 106*a* in dependence of the internal detector. A program map may be used by the control device 108*a*, 108*b* to map a detected power and speed to resultant output properties, such as head output and flow output, or temperature output and heat load output.

The relationship between parameters may be approximated by particular affinity laws, which may be affected by volume, pressure, and Brake Horsepower (BHP) (hp/kW). For example, for variations in impeller diameter, at constant speed: $D1/D2=Q1/Q2$; $H1/H2=D1^2/D2^2$; $BHP1/BHP2=D1^3/D2^3$. For example, for variations in speed, with constant impeller diameter: $S1/S2=Q1/Q2$; $H1/H2=S1^2/S2^2$; $BHP1/BHP2=S1^3/S2^3$. wherein: D=Impeller Diameter (Ins/mm); H=Pump Head (Ft/m); Q=Pump Capacity (gpm/lps); S=Speed (rpm/rps); BHP=Brake Horsepower (Shaft Power–hp/kW).

Variations may be made in example embodiments of the present disclosure. Some example embodiments may be applied to any variable speed device, and not limited to variable speed control pumps. For example, some additional embodiments may use different parameters or variables, and may use more than two parameters (e.g. three parameters on a three dimensional map, or N parameters on a N-dimensional map). Some example embodiments may be applied to any devices which are dependent on two or more correlated parameters. Some example embodiments can include variables dependent on parameters or variables such as liquid, temperature, viscosity, suction pressure, site elevation and number of devices or pump operating.

Figure 10:
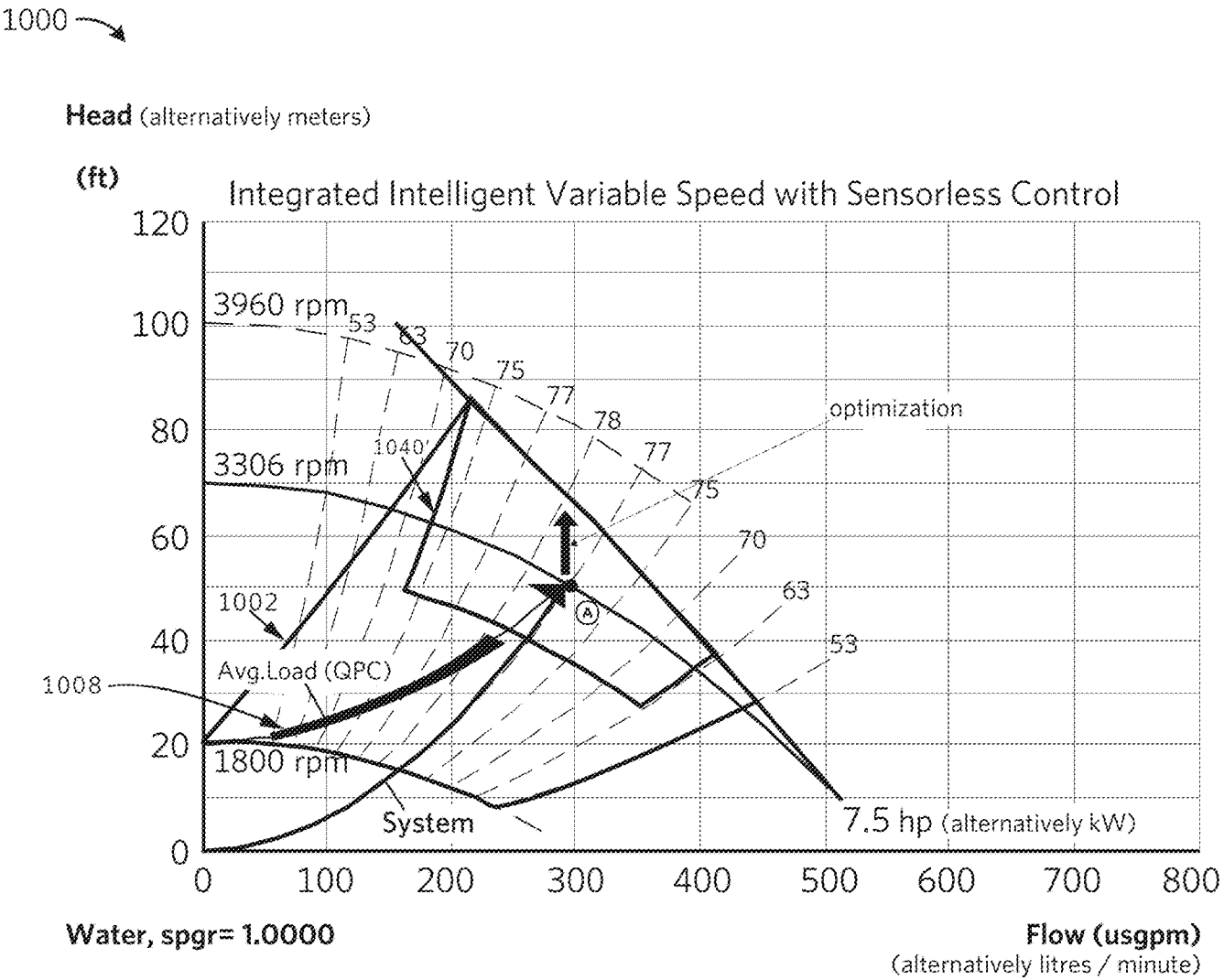
FIG. 10 illustrates a graph of an example range of operation and selection range of a variable speed control pump for a heat transfer system.

FIG. 10 illustrates a graph 1000 of an example range of operation and selection range of a variable speed control pump 102, 122 for a heat transfer system. The following relates to control pump 102, and a similar process can be applied to control pump 122. Efficiency curves (in percentage) are shown that bottom left to top right, and have a peak efficiency curve of 78% in this example.

The range of operation 1002 is illustrated as a polygon-shaped region or area on the graph 1000, wherein the region is bounded by a border represents a suitable range of operation 1002. A design point region 1040 is within the range of operation 1002 and includes a border which represents the suitable range of selection of a design point for a particular control pump 102, 122. The design point region 1040 may be referred to as a "selection range", "composite curve" or "design envelope" for a particular control pump 102, 122. In some example embodiments, the design point region 1040 may be used to select an appropriate model or type of control pump 102, 122, which is optimized for part load operation based on a particular design point. For example, a design point may be, e.g., a maximum expected system load as in the full load duty flow illustrated by point A as required by a system such as the building 104 (FIG. 1B).

The design point can be estimated by the system designer based on the maximum flow (duty flow) that will be required by a system for effective operation and the head/pressure loss required to pump the design flow through the system piping and fittings. Note that, as pump head estimates may be over-estimated, most systems will never reach the design pressure and will exceed the design flow and power. Other systems, where designers have under-estimated the required head, will operate at a higher pressure than the design point. For such a circumstance, one feature of properly selecting an intelligent variable speed pump is that it can be properly adjusted to delivery more flow and head in the system than the designer specified.

The graph 1000 includes axes which include parameters which are correlated. For example, head squared is proportional to flow, and flow is proportional to speed. In the example shown, the abscissa or x-axis illustrates flow in U.S. gallons per minute (GPM) (alternatively litres/minute) and the ordinate or y-axis illustrates head (H) in pounds per square inch (psi) (alternatively in feet or metres). The range of operation 1002 is a superimposed representation of the control pump 102, 122 with respect to those parameters, onto the graph 1000.

As shown in FIG. 10, one or more control curves 1008 (one shown) may be defined and programmed for an intelligent variable speed device, such as the control pump 102. Depending on changes to the detected parameters (e.g. external or internal detection of changes in flow/load), the operation of the control pump 102, 122 may be maintained to operate on the same control curve 1008 based on instructions from the control device 108*a*, 108*b* (e.g. at a higher or lower flow point). This mode of control may also be referred to as quadratic pressure control (QPC), as the control curve 1008 is a quadratic curve between two operating points (e.g., maximum head, and minimum head which is 40% of maximum head). Reference to "intelligent" devices herein includes the control pump 102, 122 being able to self-adjust operation of the control pump 102, 122 along the control curve 1008, depending on the particular required or detected load. A thicker region on the control curve 1008 represents the average load when operating to source the building 104.

Other example control curves other than quadratic curves include constant pressure control and proportional pressure control. Selection may also be made to another control curve (not shown), depending on the particular application.

The total costs of the building system 100 are comprised of the first installed costs and operating costs. First installed costs comprised of the heat exchanger, pumps, valves, suction guides, piping (including any headers), and installation costs. Operation costs are comprised of pumping energy. The total cost is compared to other selections using the net present value method based on the user defined discount years and discount rate. The default number of years is, e.g., 10 years and the default discount rate is, e.g., 5%.

The pressure drop across the heat exchanger 118 is varied in 0.5 psi increments and the lifecycle cost is obtained and stored in memory for each scenario. Equipment is then ranked based on the lowest lifecycle costs.

The net present value (NPV) is calculated as:

$$NPV(i, N) = \sum_{t=0}^{N} \frac{R_t}{(1+i)^t}$$

where:

Rt is the cost at a specific year t,

N is the number of years, i is the discount rate, t is the specific year.

The building load profile are selected, using one or more processors, based on the user application and location. In an example, the NPV is optimized so as to minimize cost. The building load profile can be taken from the parallel redundancy specifications. The building load profile can be taken from the load profile graph 400 (FIG. 4A) or the load profile graph 420 (FIG. 4B). The total pumping energy is calculated by integrating the pump energy with the chosen load profile.

In example embodiments, as appropriate, each illustrated block or module may represent software, hardware, or a combination of hardware and software. Further, some of the blocks or modules may be combined in other example embodiments, and more or less blocks or modules may be present in other example embodiments. Furthermore, some of the blocks or modules may be separated into a number of sub-blocks or sub-modules in other embodiments.

While some of the present embodiments are described in terms of methods, a person of ordinary skill in the art will understand that present embodiments are also directed to various apparatus such as a server apparatus including components for performing at least some of the aspects and features of the described methods, be it by way of hardware components, software or any combination of the two, or in any other manner. Moreover, an article of manufacture for use with the apparatus, such as a pre-recorded storage device or other similar non-transitory computer readable medium including program instructions recorded thereon, or a computer data signal carrying computer readable program instructions may direct an apparatus to facilitate the practice of the described methods. It is understood that such apparatus, articles of manufacture, and computer data signals also come within the scope of the present example embodiments.

While some of the above examples have been described as occurring in a particular order, it will be appreciated to persons skilled in the art that some of the messages or steps or processes may be performed in a different order provided that the result of the changed order of any given step will not prevent or impair the occurrence of subsequent steps. Furthermore, some of the messages or steps described above may be removed or combined in other embodiments, and some of the messages or steps described above may be separated into a number of sub-messages or sub-steps in other embodiments. Even further, some or all of the steps of the conversations may be repeated, as necessary. Elements described as methods or steps similarly apply to systems or subcomponents, and vice-versa.

In example embodiments, the one or more controllers can be implemented by or executed by, for example, one or more of the following systems: Personal Computer (PC), Programmable Logic Controller (PLC), Microprocessor, Internet, Cloud Computing, Mainframe (local or remote), mobile phone or mobile communication device.

The term "computer readable medium" as used herein includes any medium which can store instructions, program steps, or the like, for use by or execution by a computer or other computing device including, but not limited to: magnetic media, such as a diskette, a disk drive, a magnetic drum, a magneto-optical disk, a magnetic tape, a magnetic core memory, or the like; electronic storage, such as a random access memory (RAM) of any type including static RAM, dynamic RAM, synchronous dynamic RAM (SDRAM), a read-only memory (ROM), a programmable-read-only memory of any type including PROM, EPROM, EEPROM, FLASH, EAROM, a so-called "solid state disk", other electronic storage of any type including a charge-coupled device (CCD), or magnetic bubble memory, a portable electronic data-carrying card of any type including COMPACT FLASH, SECURE DIGITAL (SD-CARD), MEMORY STICK, and the like; and optical media such as a Compact Disc (CD), Digital Versatile Disc (DVD) or BLU-RAY® Disc.

An example embodiment is a heat transfer system for sourcing a variable load, comprising: a heat exchanger that defines a first fluid path and a second fluid path; a first variable control pump for providing variable flow of a first circulation medium through the first fluid path of the heat exchanger; at least one controller configured for: controlling the first variable control pump to control the first circulation medium through the heat exchanger in order to source the variable load, determining, based on real-time operation measurement when sourcing the variable load, that the heat exchanger requires maintenance due to fouling of the heat exchanger, and in response to said determining, controlling the first variable control pump, to a first flow amount of the first circulation medium in order to flush the fouling of the heat exchanger.

In any of the above example embodiments, the controlling the first variable control pump to the first flow amount in order to flush the fouling of the heat exchanger is performed during real-time sourcing of the variable load.

In any of the above example embodiments, the system further comprises a second variable control pump for providing variable flow of a second circulation medium through the second fluid path of the heat exchanger.

In any of the above example embodiments, the first fluid path is between the heat exchanger and the variable load, and the second fluid path is between a temperature source and the heat exchanger.

In any of the above example embodiments, the first fluid path is between a temperature source and the heat exchanger, and the second fluid path is between the heat exchanger and the variable load.

In any of the above example embodiments, the at least one controller is configured for, in response to said determining, controlling the second variable control pump to a second flow amount of the second circulation medium in order to flush the fouling of the heat exchanger.

In any of the above example embodiments, the first flow amount or the second flow amount is a maximum flow setting.

In any of the above example embodiments, the controlling the first variable control pump to the first flow amount and the controlling the second variable control pump to the second flow amount are performed at the same time.

In any of the above example embodiments, the controlling the first variable control pump to the first flow amount and the controlling the second variable control pump to the second flow amount are performed in a sequence at different times.

In any of the above example embodiments, the system further comprises a heat transfer module that includes the heat exchanger and at least one further heat exchanger in parallel with the heat exchanger and each other, wherein the first fluid path and the second fluid path are further defined by the at least one further heat exchanger.

In any of the above example embodiments, the system further comprises a respective valve for each heat exchanger that is controllable by the at least one controller, wherein, when flushing the fouling of each heat exchanger, one or more of the respective valves are controlled to be closed and less than all of the heat exchangers are flushed at a time.

In any of the above example embodiments, the system further comprises: a first pressure sensor configured to detect pressure measurement of input to the first fluid path of the heat transfer module; a second pressure sensor configured to detect pressure measurement of input to the second fluid path of the heat transfer module; a first pressure differential sensor across the input to output of the first fluid path of the heat transfer module; a second pressure differential sensor across the input to output of the second fluid path of the heat transfer module; a first temperature sensor configured to detect temperature measurement of the input of the first fluid path of the heat transfer module; a second temperature sensor configured to detect temperature measurement of the output of the first fluid path of the heat transfer module; a third temperature sensor configured to detect temperature measurement of the input of the second fluid path of the heat transfer module; a fourth temperature sensor configured to detect temperature measurement of the output of the second fluid path of the heat transfer module; a respective temperature sensor to detect temperature measurement of output of each fluid path of each heat exchanger of the heat transfer module; wherein the at least one controller is configured to receive data indicative of measurement from the pressure sensors, the pressure differential sensors, and the temperature sensors, for said determining that the heat exchanger requires maintenance due to fouling of the heat exchanger.

In any of the above example embodiments, the system further comprises: a first flow sensor configured to detect first flow measurement of first flow through heat transfer module that includes the first fluid path and a corresponding first fluid path of the at least one further heat exchanger; a second flow sensor configured to detect second flow measurement of second flow through the heat transfer module that includes the second fluid path of and a corresponding second fluid path of the at least one further heat exchanger; wherein the at least one controller is configured to: receive data indicative of the flow measurement from the first flow sensor and the second flow sensor, calculate a respective heat load (Q) of the first flow through the heat transfer module and the second flow through the heat transfer module from: the first flow measurement, the second flow measurement, the respective temperature measure from the first temperature sensor, the respective temperature measure from the third temperature sensor, and the respective temperature measurement from the respective temperature sensor of the output of each heat exchanger from the respective temperature sensor, and calculate a comparison between the heat load (Q) of the first flow and the heat load (Q) of the second flow, for said determining that the heat exchanger requires maintenance due to fouling of the heat exchanger.

In any of the above example embodiments, the system further comprises: at least one pressure sensor or temperature sensor configured to detect measurement at the heat exchanger, wherein the at least one controller is configured to determine a clean coefficient value of the heat exchanger when in a clean state; wherein said determining that the heat exchanger requires maintenance due to fouling of the heat exchanger, further includes: calculating, from measurement of the at least one pressure sensor or temperature sensor during the real-time operation measurement when sourcing the variable load, an actual coefficient value of the heat exchanger; and calculating a comparison between the actual coefficient value of the heat exchanger and the clean coefficient value of the heat exchanger.

In any of the above example embodiments, the at least one controller is configured to determine a clean heat transfer coefficient (U) of the heat exchanger when in a clean state; wherein said determining that the heat exchanger requires maintenance due to fouling of the heat exchanger, further includes: calculating, from measurement of the at least one pressure sensor or temperature sensor during the real-time operation measurement when sourcing the variable load, an actual heat transfer coefficient (U) of the heat exchanger; and calculating a comparison between the actual heat transfer coefficient (U) of the heat exchanger and the clean heat transfer coefficient (U) of the heat exchanger.

In any of the above example embodiments, the calculating the comparison is calculating a fouling factor (FF) based on the actual heat transfer coefficient (U) of the heat exchanger and the clean heat transfer coefficient (U) of the heat exchanger.

In any of the above example embodiments, the calculating of the fouling factor (FF) is calculated as:

$$FF = 1/Udirt - 1/Uclean,$$

where:

Uclean is the clean heat transfer coefficient (U),

Udirt is the actual heat transfer coefficient (U).

In any of the above example embodiments, the at least one controller is configured to determine a clean pressure differential value across the first fluid path of the heat exchanger when in a clean state; wherein said determining, based on real-time operation measurement when sourcing the variable load, that the heat exchanger requires maintenance due to fouling of the heat exchanger further includes: calculating, from measurement of the at least one pressure sensor during the real-time operation measurement when sourcing the variable load, an actual pressure differential value across the first fluid path of the heat exchanger; calculating a comparison between the actual pressure differential value of the heat exchanger and the clean pressure differential value of the heat exchanger.

In any of the above example embodiments, the at least one controller is configured to determine a clean temperature differential value across the first fluid path of the heat exchanger when in a clean state; wherein said determining that the heat exchanger requires maintenance due to fouling of the heat exchanger further includes: calculating, from measurement of the temperature sensors during the real-time operation measurement when sourcing the variable load, an actual temperature differential value of the first fluid path of the heat exchanger; and calculating a comparison between the actual temperature differential value of the heat exchanger and the temperature differential value of the heat exchanger.

In any of the above example embodiments, the clean coefficient value of the heat exchanger when in the clean state is previously determined by testing prior to shipping or installation of the heat exchanger and is stored to a memory, wherein the determining by the at least one controller of the clean coefficient value of the heat exchanger when in the clean state is performed by accessing the clean coefficient value from the memory.

In any of the above example embodiments, the system further comprises at least one sensor configured to detect measurement indicative of the heat exchanger; wherein the at least one controller is configured to determine a clean coefficient value of the heat exchanger when in a clean state; wherein said determining that the heat exchanger requires maintenance due to fouling of the heat exchanger further includes: predicting, from previous measurement of the at least one sensor during the real-time operation measurement when sourcing the variable load, an actual present coefficient value of the heat exchanger; and calculating a comparison between the predicted actual coefficient value of the heat exchanger and the clean coefficient value of the heat exchanger.

In any of the above example embodiments, said determining that the heat exchanger requires maintenance due to fouling of the heat exchanger further includes: determining that the variable load is being sourced by the heat exchanger continuously at a maximum specified part load for a specified period of time.

In any of the above example embodiments, said maximum specified part load is 90% of full load of the variable load and said specified period of time is at least on or about 7 days.

In any of the above example embodiments, the at least one controller is configured to determine flushing of the fouling of the heat exchanger was successful or unsuccessful by: determining a clean coefficient value of the heat exchanger when in a clean state, calculating, from the measurement the real-time operation measurement when sourcing the variable load, an actual coefficient value of the heat exchanger, and calculating a comparison between the actual coefficient value of the heat exchanger and the clean coefficient value of the heat exchanger, wherein, based on the calculating the comparison, the at least one controller is configured to output a notification in relation to the flushing of the fouling of the heat exchanger being successful or unsuccessful.

In any of the above example embodiments, the first flow amount is: a maximum flow setting of the first variable control pump; or a maximum duty flow of the variable load; or a maximum flow capacity of the heat exchanger.

In any of the above example embodiments, the first flow amount comprises a back flow of the first variable control pump.

In any of the above example embodiments, the heat exchanger is a plate and frame counter current heat exchanger that includes a plurality of brazed plates for causing turbulence when facilitating heat transfer between the first fluid path and the second fluid path.

In any of the above example embodiments, the heat exchanger is a shell and tube heat exchange or a gasketed plate heat exchanger.

In any of the above example embodiments, the at least one controller is integrated with the heat exchanger.

An example embodiment is a method for sourcing a variable load using a heat transfer system, the heat transfer system including a heat exchanger that defines a first fluid path and a second fluid path, the heat transfer system including a first variable control pump for providing variable flow of a first circulation medium through the first fluid path of the heat exchanger, the method being performed by at least one controller and comprising: controlling the first variable control pump to control the first circulation medium through the heat exchanger in order to source the variable load, determining, based on real-time operation measurement when sourcing the variable load, that the heat exchanger requires maintenance due to fouling of the heat exchanger, and in response to said determining, controlling the first variable control pump, to a first flow amount of the first circulation medium in order to flush the fouling of the heat exchanger.

An example embodiment is a heat transfer module, comprising: a sealed casing that defines a first port, a second port, a third port, and a fourth port; a plurality of parallel heat exchangers within the sealed casing that collectively define a first fluid path between the first port and the second port and collectively define a second fluid path between the third port and the fourth port; a first pressure sensor within the sealed casing configured to detect pressure measurement of input to the first fluid path of the heat transfer module; a second pressure sensor within the sealed casing configured to detect pressure measurement of input to the second fluid path of the heat transfer module; a first pressure differential sensor within the sealed casing and across the input to output of the first fluid path of the heat transfer module; a second pressure differential sensor within the sealed casing and across the input to output of the second fluid path of the heat transfer module; a first temperature sensor within the sealed casing configured to detect temperature measurement of the input of the first fluid path of the heat transfer module; a second temperature sensor within the sealed casing configured to detect temperature measurement of the output of the first fluid path of the heat transfer module; a third temperature sensor within the sealed casing configured to detect temperature measurement of the input of the second fluid path of the heat transfer module; a fourth temperature sensor within the sealed casing configured to detect temperature measurement of the output of the second fluid path of the heat transfer module; a respective temperature sensor within the sealed casing to detect temperature measurement of output of each fluid path of each heat exchanger of the heat transfer module; and at least one controller configured to receive data indicative of measurement from the pressure sensors, the pressure differential sensors, and the temperature sensors.

In any of the above example embodiments, the at least one controller is configured to instruct one or more variable control pumps to operate flow through the heat exchanger.

In any of the above example embodiments, the at least one controller is configured to: determine a clean coefficient value of the heat exchanger when in a clean state; determine that the heat exchanger requires maintenance due to fouling of the heat exchanger, including: calculating, from measurement of the pressure sensors, the pressure differential sensors, the temperature sensors, or from external flow sensors, during real-time operation measurement when sourcing a variable load, an actual coefficient value of the heat exchanger, calculating a comparison between the actual coefficient value of the heat exchanger and the clean coefficient value of the heat exchanger, concluding that the heat exchanger requires maintenance due to fouling of the heat exchanger; and instructing the one or more variable control pumps to operate at a maximum flow setting through the heat exchanger in order to flush the fouling of the heat exchanger.

In any of the above example embodiments, the instructing the one or more variable control pumps is performed during real-time sourcing of the variable load.

In any of the above example embodiments, one of the variable control pumps is attached to the first port, and another one of the variable control pumps is attached to the third port.

In any of the above example embodiments, the at least one controller is at the sealed casing.

In any of the above example embodiments, each of the plurality of parallel heat exchangers is a plate heat exchanger.

In any of the above example embodiments, each of the plurality of parallel heat exchangers is a shell and tube heat exchange or a gasketed plate heat exchanger An example embodiment is a system for tracking heat exchanger performance, comprising: a heat exchanger for installation in a system that has a load; an output subsystem; and at least one controller configured to: determine a clean coefficient value of the heat exchanger when in a clean state, calculate, from measurement of real-time operation measurement when sourcing the load, an actual coefficient value of the heat exchanger, calculate a comparison between the actual coefficient value of the heat exchanger and the clean coefficient value of the heat exchanger, and output to the output subsystem when the comparing satisfies criteria.

In any of the above example embodiments, the outputting comprises sending a signal to control one or more variable control pumps to a maximum flow amount in order to flush the heat exchanger.

In any of the above example embodiments, the outputting comprises outputting an alert to the output subsystem, wherein the output subsystem includes a display screen or a communication subsystem.

In any of the above example embodiments, the alert indicates that flushing or maintenance of the heat exchanger is required.

In any of the above example embodiments, the alert indicates that there is performance degradation of the heat exchanger.

In any of the above example embodiments, the coefficient value is a heat transfer coefficient (U).

In any of the above example embodiments, the at least one controller is integrated with the heat exchanger.

An example embodiment is a method for tracking performance of a heat exchanger for installation in a system that has a load, the method being performed by at least one controller and comprising: determining a clean coefficient value of the heat exchanger when in a clean state; calculating, from measurement of real-time operation measurement when sourcing the load, an actual coefficient value of the heat exchanger; calculating a comparison between the actual coefficient value of the heat exchanger and the clean coefficient value of the heat exchanger; and outputting to an output subsystem when the comparing satisfies criteria.

An example embodiment is a non-transitory computer readable medium having instructions stored thereon executable by at least one controller for performing any of the above described methods.

Variations may be made to some example embodiments, which may include combinations and sub-combinations of any of the above. The various embodiments presented above are merely examples and are in no way meant to limit the scope of this disclosure. Variations of the innovations described herein will be apparent to persons of ordinary skill in the art having the benefit of the present disclosure, such variations being within the intended scope of the present disclosure. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present disclosure as a whole. The subject matter described herein intends to cover and embrace all suitable changes in technology.

Certain adaptations and modifications of the described embodiments can be made. Therefore, the above discussed embodiments are considered to be illustrative and not restrictive.

What is claimed is:

1. A heat transfer system for sourcing a variable load, comprising:

a heat exchanger that defines a first fluid circuit and a second fluid circuit;

a first variable control pump for providing variable flow of a first circulation medium through the first fluid circuit of the heat exchanger;

a second variable control pump for providing variable flow of a second circulation medium through the second fluid circuit of the heat exchanger;

at least one pressure sensor or at least one temperature sensor configured to detect measurement at the heat exchanger; and at least one controller configured to:

receive data indicative of measurement from the at least one pressure sensor or the at least one temperature sensor, control the first variable control pump to control the first circulation medium through the heat exchanger in order to source the variable load, determine, based on the data from the at least one pressure sensor or the at least one temperature sensor from real-time operation measurement when sourcing the variable load, that the heat exchanger requires maintenance due to fouling of the heat exchanger, and in response to said determining, control the first variable control pump, during real-time sourcing of the variable load, to a first flow amount of the first circulation medium in order to flush the fouling through the first fluid circuit of the heat exchanger, and control the second variable control pump to a second flow amount in order to flush the fouling through the first fluid circuit of the heat exchanger, wherein the control of the first variable control pump to the first flow amount and the control of the second variable control pump to the second flow amount are performed at different times.

2. The heat transfer system as claimed in claim 1, wherein the first fluid circuit is between the heat exchanger and the variable load, and the second fluid circuit is between a temperature source and the heat exchanger.

3. The heat transfer system as claimed in claim 1, wherein the first fluid circuit is between a temperature source and the heat exchanger, and the second fluid circuit is between the heat exchanger and the variable load.

4. The heat transfer system as claimed in claim 1, wherein the second flow amount is a second maximum flow setting, wherein during the second maximum flow setting the at least one controller is configured to simultaneously control the first variable control pump, during real-time sourcing of the variable load, to a decreased flow amount of the first circulation medium to account for the second maximum flow setting of the second flow amount in order to source the variable load.

5. The heat transfer system as claimed in claim 1, wherein the heat exchanger and at least one additional heat exchanger are in parallel, wherein the heat exchanger and the at least one additional heat exchanger are part of a heat exchanger unit.

6. The heat transfer system as claimed in claim 5, wherein each of the at least one additional heat exchanger include a respective fluid path in the first fluid circuit that is flushable by the first variable control pump, further comprising a respective valve for each heat exchanger that is controllable by the at least one controller, wherein, when flushing the fouling of each heat exchanger, one or more of the respective valves are controlled by the at least one controller to be closed so that less than all of the heat exchangers are flushed at a time.

7. The heat transfer system as claimed in claim 5:

wherein the system includes the at least one pressure sensor and the at least one temperature sensor;

wherein the at least one pressure sensor includes:

a first pressure sensor configured to detect pressure measurement of input to the first fluid circuit of the heat exchanger unit, and a second pressure sensor configured to detect pressure measurement of input to the second fluid circuit of the heat exchanger unit;

wherein the at least one temperature includes:

a first temperature sensor configured to detect temperature measurement of the input of the first fluid circuit of the heat exchanger unit, a second temperature sensor configured to detect temperature measurement of output of the first fluid circuit of the heat exchanger unit, a third temperature sensor configured to detect temperature measurement of the input of the second fluid circuit of the heat exchanger unit, a fourth temperature sensor configured to detect temperature measurement of output of the second fluid circuit of the heat exchanger unit, and a respective temperature sensor to detect temperature measurement of output of each fluid path of each heat exchanger of the unit;

wherein the at least one controller is configured to receive data indicative of measurement from the pressure sensors and the temperature sensors, for said determining that the heat exchanger requires maintenance due to fouling of the heat exchanger.

8. The heat transfer system as claimed in claim 7, further comprising:

a first flow sensor configured to detect first flow measurement of first flow through the heat exchanger unit that includes the first fluid circuit; and a second flow sensor configured to detect second flow measurement of second flow through the heat exchanger unit that includes the second fluid circuit;

wherein the at least one controller is configured to:

receive data indicative of the flow measurement from the first flow sensor and the second flow sensor, calculate a respective heat load (Q) of the first flow through the heat exchanger unit and the second flow through the heat exchanger unit from: the first flow measurement, the second flow measurement, the respective temperature measure from the first temperature sensor, the respective temperature measure from the third temperature sensor, and the respective temperature measurement from the respective temperature sensor of the output of each heat exchanger from the respective temperature sensor, and calculate a comparison between the heat load (Q) of the first flow and the heat load (Q) of the second flow in a clean state with an actual state of the heat load (Q) of the first flow and the heat load (Q) of the second flow, for said determining that the heat exchanger requires maintenance due to fouling of the heat exchanger.

9. The heat transfer system as claimed in claim 1, wherein the at least one controller is configured to determine a clean heat transfer coefficient (U) of the heat exchanger when in a clean state;

wherein said determining that the heat exchanger requires maintenance due to fouling of the heat exchanger, further includes:

calculating, from measurement of the at least one pressure sensor or the at least one temperature sensor during the real-time operation measurement when sourcing the variable load, an actual heat transfer coefficient (U) of the heat exchanger; and calculating a fouling factor (FF) based on the actual heat transfer coefficient (U) of the heat exchanger and the clean heat transfer coefficient (U) of the heat exchanger.

10. The heat transfer system as claimed in claim 9, wherein the calculating of the fouling factor (FF) is calculated as:

$$FF = 1/Udirt - 1/Uclean,$$

where:

Uclean is the clean heat transfer coefficient (U),

Udirt is the actual heat transfer coefficient (U).

11. The heat transfer system as claimed in claim 1, wherein the at least one pressure sensor includes at least two pressure sensors, wherein the at least one controller is configured to determine a clean pressure differential value across the first fluid circuit of the heat exchanger when in a clean state;

wherein said determining, based on real-time operation measurement when sourcing the variable load, that the heat exchanger requires maintenance due to fouling of the heat exchanger further includes:

calculating, from measurement of the at least two pressure sensors during the real-time operation measurement when sourcing the variable load, an actual pressure differential value across the first fluid circuit of the heat exchanger; and calculating a comparison between the actual pressure differential value of the heat exchanger and the clean pressure differential value of the heat exchanger.

12. The heat transfer system as claimed in claim 1, wherein the at least one temperature sensor includes at least two temperature sensors, wherein the at least one controller is configured to determine a clean temperature differential value across the first fluid circuit of the heat exchanger when in a clean state;

wherein said determining that the heat exchanger requires maintenance due to fouling of the heat exchanger further includes:

calculating, from measurement of the at least two temperature sensors during the real-time operation measurement when sourcing the variable load, an actual temperature differential value of the first fluid circuit of the heat exchanger; and calculating a comparison between the actual temperature differential value of the heat exchanger and the clean temperature differential value of the heat exchanger.

13. The heat transfer system as claimed in claim 12, wherein the clean temperature differential value of the heat exchanger when in the clean state is previously determined by testing prior to shipping or installation of the heat exchanger and is stored to a memory, wherein the determining by the at least one controller of the clean temperature differential value of the heat exchanger when in the clean state is performed by accessing the clean temperature differential value from the memory.

14. The heat transfer system as claimed in claim 1, wherein said determining that the heat exchanger requires maintenance due to fouling of the heat exchanger further includes:

resetting a timer; and determining, from the timer and the at least one pressure sensor or the at least one temperature sensor, that the variable load is being sourced by the heat exchanger continuously at a part load for a specified period of time.

15. The heat transfer system as claimed in claim 14, wherein said part load is at most 90% of maximum load of the variable load and said specified period of time is at least 7 days.

16. The heat transfer system as claimed in claim 1, wherein the at least one controller is configured to determine flushing of the fouling of the heat exchanger was successful or unsuccessful by:

determining a clean coefficient value of the heat exchanger when in a clean state, calculating, from the measurement the real-time operation measurement when sourcing the variable load, an actual coefficient value of the heat exchanger, and calculating a comparison between the actual coefficient value of the heat exchanger and the clean coefficient value of the heat exchanger, wherein, based on the calculating the comparison, the at least one controller is configured to output a notification in relation to the flushing of the fouling of the heat exchanger being successful or unsuccessful.

17. The heat transfer system as claimed in claim 1, wherein the first flow amount includes a maximum flow setting.

18. The heat transfer system as claimed in claim 17, wherein the maximum flow setting is: a maximum flow setting of the first variable control pump; or a maximum duty flow of the variable load; or a maximum flow capacity of the heat exchanger.

19. The heat transfer system as claimed in claim 1, wherein the heat exchanger is a plate and frame counter current heat exchanger that includes a plurality of brazed plates for causing turbulence when facilitating heat transfer between the first fluid circuit and the second fluid circuit.

20. The heat transfer system as claimed in claim 1, wherein the heat exchanger is a shell and tube heat exchange or a gasketed plate heat exchanger.

21. The heat transfer system as claimed in claim 1, wherein the at least one controller is integrated with the heat exchanger.

22. The heat transfer system as claimed in claim 1, wherein the first flow amount is an alternating sequence between a maximum flow setting and a partial flow setting.

23. The heat transfer system as claimed in claim 1, wherein the flush the fouling of the heat exchanger is performed without disassembling the heat transfer system and without using a bypass loop.

24. A method for sourcing a variable load using a heat transfer system, the heat transfer system including a heat exchanger that defines a first fluid circuit and a second fluid circuit, the heat transfer system including a first variable control pump for providing variable flow of a first circulation medium through the first fluid circuit of the heat exchanger and a second variable control pump for providing variable flow of a second circulation medium through the second fluid circuit of the heat exchanger, the method being performed by at least one controller and comprising:

receiving data indicative of measurement at the heat exchanger from at least one pressure sensor or at least one temperature sensor;

controlling the first variable control pump to control the first circulation medium through the heat exchanger in order to source the variable load;

determining, based on the data from the at least one pressure sensor or the at least one temperature sensor from real-time operation measurement when sourcing the variable load, that the heat exchanger requires maintenance due to fouling of the heat exchanger; and in response to said determining, controlling the first variable control pump, during real-time sourcing of the variable load, to a first flow amount of the first circulation medium in order to flush the fouling through the first fluid circuit of the heat exchanger, and controlling the second variable control pump to operate at a second flow amount in order to flush the fouling through the second fluid circuit of the heat exchanger, wherein the controlling the first variable control pump to the first flow amount and the controlling the second variable control pump to the second flow amount are performed at different times.

25. The method as claimed in claim 24, wherein the second flow amount is a second maximum flow setting, wherein during the second maximum flow setting the at least one controller is configured to simultaneously control the first variable control pump, during real-time sourcing of the variable load, to a decreased flow amount of the first circulation medium to account for the second maximum flow setting of the second flow amount in order to source the variable load.

26. A non-transitory computer readable medium having instructions stored thereon executable by at least one controller for performing the method as claimed in claim 24.

27. A heat transfer module, comprising:

a sealed casing that defines a first port, a second port, a third port, and a fourth port;

a plurality of parallel heat exchangers within the sealed casing that collectively define a first fluid circuit between the first port and the second port and collectively define a second fluid circuit between the third port and the fourth port;

a respective valve pair for each of the plurality of parallel heat exchangers having a first respective valve to control the first fluid circuit through that respective heat exchanger and a second respective valve to control the second fluid circuit through that respective heat exchanger; and at least one controller configured to:

instruct opening and/or closing of at least one of the valve pairs leaving remaining opened at least one but not all of the valve pairs to, during real-time sourcing of a variable load, flush the fouling of the respective heat exchanger having the remaining opened at least one but not all of the valve pairs.

28. The heat transfer module as claimed in claim 27, further comprising:

a first pressure sensor within the sealed casing configured to detect pressure measurement of input to the first fluid circuit of the heat transfer module;

a second pressure sensor within the sealed casing configured to detect pressure measurement of input to the second fluid circuit of the heat transfer module;

a first temperature sensor within the sealed casing configured to detect temperature measurement of the input of the first fluid circuit of the heat transfer module;

a second temperature sensor within the sealed casing configured to detect temperature measurement of output of the first fluid circuit of the heat transfer module;

a third temperature sensor within the sealed casing configured to detect temperature measurement of the input of the second fluid circuit of the heat transfer module; and a fourth temperature sensor within the sealed casing configured to detect temperature measurement of output of the second fluid circuit of the heat transfer module;

wherein the respective temperature sensor within the sealed casing detect temperature measurements of output of each fluid path of each heat exchanger of the heat transfer module; and wherein the at least one controller is configured to:

determine a clean coefficient value of the heat exchanger when in a clean state; and determine that the heat exchanger requires maintenance due to fouling of the heat exchanger, including:

calculating, from measurement of at least one of the pressure sensors, the temperature sensors, or from external flow sensors, during real-time operation measurement when sourcing the variable load, an actual coefficient value of the heat exchanger, calculating a comparison between the actual coefficient value of the heat exchanger and the clean coefficient value of the heat exchanger, and concluding that the heat exchanger requires maintenance due to fouling of the heat exchanger.

29. The heat transfer module as claimed in claim 27, wherein the at least one controller is at the sealed casing.

30. The heat transfer module as claimed in claim 27, wherein each of the plurality of parallel heat exchangers is a plate heat exchanger.

31. The heat transfer module as claimed in claim 27, wherein each of the plurality of parallel heat exchangers is a shell and tube heat exchange or a gasketed plate heat exchanger.

* * * * *